US006382437B1

(12) United States Patent
Okada et al.

(10) Patent No.: US 6,382,437 B1
(45) Date of Patent: May 7, 2002

(54) CRANE APPARATUS

(75) Inventors: Takashi Okada; Takashi Chikura; Hisanori Abiru; Tetsuo Ichikizaki; Masanori Masumoto; Shinichi Masumoto; Ikko Yasunaga; Tatsuya Hirano, all of Hiroshima (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/319,505

(22) PCT Filed: Dec. 3, 1998

(86) PCT No.: PCT/JP98/05448

§ 371 Date: Aug. 5, 1999

§ 102(e) Date: Aug. 5, 1999

(87) PCT Pub. No.: WO99/28230

PCT Pub. Date: Jun. 10, 1999

(30) Foreign Application Priority Data

Dec. 3, 1997 (JP) ..... 9-332752
Aug. 18, 1998 (JP) ..... 10-231462

(51) Int. Cl.[7] ..... B66C 11/16

(52) U.S. Cl. ..... 212/274; 212/312; 212/323; 212/324; 212/327

(58) Field of Search ..... 212/274, 320, 212/321, 322, 323, 345, 312, 327, 324; 414/626

(56) References Cited

U.S. PATENT DOCUMENTS 563,258 A * 7/1896 Connet ..... 212/323
2,154,128 A * 6/1939 Medenwald ..... 212/274
3,207,329 A * 9/1965 Bevard ..... 212/323
3,429,453 A * 2/1969 Kahle et al. ..... 212/321
3,833,129 A * 9/1974 Madsen ..... 212/14
3,887,080 A * 6/1975 Wilson ..... 212/274
4,076,127 A * 2/1978 Hupkes ..... 212/274
4,094,493 A * 6/1978 Polen ..... 212/323
4,214,664 A * 7/1980 Polen ..... 212/274
4,883,184 A * 11/1989 Albus ..... 212/274
5,186,342 A 2/1993 Shimizu

FOREIGN PATENT DOCUMENTS

| | | |
|---|---|---|
| JP | 4815246 | 2/1973 |
| JP | 49094045 | 9/1974 |
| JP | 50012749 | 2/1975 |
| JP | 8175784 | 7/1996 |

* cited by examiner

*Primary Examiner*—Thomas J. Brahan

(57) ABSTRACT

A crane system for carrying a load while suspending it from a portal-shaped body frame via wire ropes includes first and second wire ropes on both sides, in a right-and-left direction, of an upper portion of the body frame for fixing the suspended load, and means for taking up and paying out the first and second wire ropes. The system also includes means for winding the first and second wire ropes in opposite directions, or winding them in the same direction. The first and second wire ropes may be looped together with the means of taking up and paying out the wire ropes. Connection points or sheaves may be provided on the suspended load. It is also permissible to route the first and second wire ropes parallel to each other. Further, the above takeup and payout means may be in a tapered drum form.

11 Claims, 29 Drawing Sheets

CRANE APPARATUS

This application is the national phase under 35 U.S.C. §371 of PCT International Application No. PCT/JP98/05448 which has an International filing date of Dec. 3, 1998 which designated the United States of America.

BACKGROUND OF THE INVENTION

1. Technical Field

This invention relates to a crane system which has a wire rope stretched from a frame of a body to a hoisting accessory, and which pays out the wire rope from a drum or winds the wire rope around the drum to carry a load transversely, or move it up or down.

2. Related Art

A crane system for carrying a container (load) is present in a place such as a container yard at a port. The crane system is used to unload containers from a vehicle or the like and stack them on the container yard, or load containers from the container yard into a vehicle or the like.

FIG. 1 shows an example of a gantry crane system which has existed so far. This type of crane system has a pair of gate-shaped body frames, i.e., front and rear body frames 101. The crane system includes a plurality of traveling wheels 103 provided at a lower end of each of legs 101*a* for supporting a transverse girder 101*b* of each of the body frames 101, and traction motors 102 for driving the traveling wheels 103. The traction motor 102 rotationally drives the traveling wheels 103, thereby moving the body frames 101 in a front-and-back direction (a direction along the front and the back of the body frames 101 disposed at the front and at the back, respectively; the same will hold hereinbelow).

On the front and rear transverse girders 101*b* of these body frames 101, rails 104 are laid. The front and rear rails 104 and 104 as a pair are spanned by a traversing trolley 105, which is supported on the rails laterally movably.

On the traversing trolley 105, a takeup drum 106 is borne. The takeup drum 106 is wound with a plurality of wire ropes 107 for suspending a load, and a hoisting accessory 108 is suspended via these plural wire ropes 107. A container C as a suspended load is attached to the hoisting accessory 108.

The conventional crane system of the foregoing constitution carries the container C in the following manner: As shown in FIG. 2 as well, with the body frames 101 at a halt, the hoisting accessory 108 is lowered, and the container C is attached to the hoisting accessory 108. Then, the takeup drum 106 is driven to wind the wire ropes 107, thereby moving the hoisting accessory 108 upward. As a result, the container C is raised and suspended. Then, the traversing trolley 105 is moved in a traversing direction (a direction of an arrow A in FIG. 2 in which a traversing motion is made rightward or leftward on the gate-shaped body frames 101; the same will hold hereinbelow) along the rails 104, whereby the container C is moved to a predetermined position.

Once the container C arrives at the predetermined position, the traversing trolley 10S is stopped. In this state, the wire ropes 107 are paid out by driving the takeup drum 106 to move the hoisting accessory 108 vertically downward (in a direction of an arrow C in FIG. 2), thereby lowering the container C. The container C is placed at a predetermined position as shown by a two-dot chain line in FIG. 2.

With this conventional crane system, it is necessary to provide the rails 104 on the transverse girders 101*b* of the body frames 101, and install the traversing trolley 105 on these rails 104. In this case, there is need to consider the weight of the rails 104, the weight of the traversing trolley 105, and the weight of the container C imposed on the hoisting accessory 108. Thus, not only the transverse girders 101*b*, but also the entire crane system must have great rigidity and large weight.

In the crane system illustrated in FIG. 1, consider that with the container C being held by the hoisting accessory 108, the traversing trolley 105 is moved laterally (horizontally) along the rails 104, and stopped at a predetermined position. In this case, sway in a direction of an arrow B in FIG. 2 occurs in the hoisting accessory 108 and the container C owing to the inertial force of the traversing trolley 105 moving in the lateral direction. This sway often does not settle quickly.

Actually, therefore, the traversing trolley 105 is moved at a low speed so that no sway occurs in the hoisting accessory 108 and the container C when the traversing trolley 105 is stopped. If such sway takes place, the operator waits until settlement of the sway, and then the wire ropes 107 are paid out from the takeup drum 106 to lower the container C.

This practice of moving the traversing trolley 105 at a low speed, or resuming operation after waiting until settlement of the sway of the hoisting accessory 108 and the container C, takes a long time for operation, thus deteriorating the operating efficiency.

There may be a case in which a load handling operation is performed on a floor FL inclined to drain rainwater or the like, as shown in FIG. 3. In this case, with the crane system of FIG. 1, the body frames 101 become inclined according to the slope of the floor FL. Nevertheless, the hoisting accessory 108 and the container C, attached to the traversing trolley 105 via the plurality of wire ropes 107, are suspended vertically, in other words, obliquely relative to the floor FL, by their own weight.

Then, it is attempted to lower and place the container C at a predetermined position indicated by a two-dot chain line in FIG. 3. However, the container C held by the hoisting accessory 108 may touch a container C nearby, depending on the number of containers C stacked or the distance between the adjacent stacks of containers C. This may make it difficult to place the suspended container C exactly at the predetermined position.

FIG. 4 shows a wire rope crane at a port, proposed by the applicant, for loading onto a ship or unloading from a ship onto the land. This crane system in FIG. 4 has a relay yard 120 for the efficient carriage of a container C. Between the relay yard 120 and a floor FL of a container yard, wire ropes 122 stretched between a hoisting accessory 108 and hoists 121, which are disposed at upper right and upper left positions, are extended and contracted. By this measure, the container C is carried between the relay yard 120 and the floor FL. There is a disclosure that the rightward and leftward wire ropes 122 are connected to the hoisting accessory 108 at its one or two (including another in the depth direction) connection points P.

This proposal shown in FIG. 4 has a structure in which the hoisting accessory 108 is suspended by the wires 121 from obliquely upward sites. This structure permits anti-sway of the portion 122 corresponding to the wire rope up to the connection point P in the aforementioned crane system shown in FIGS. 1 to 3. Thus, the hoisting accessory 108 and the container C may be prevented from swaying, and drawbacks due to the aforesaid low-speed movement or lengthy time until settle of sway may be diminished.

For the rope crane of FIG. 4, the relevant structure has been disclosed, but there have been no disclosures of problems encountered during actual operation, such as the weight and rigidity of the crane, control for each of the delivery and winding of the wire 122, and difficulty with the placement of a container on the slope of the floor FL. What has been disclosed is only the crane system using the wires 122.

SUMMARY OF THE INVENTION

The present invention has been accomplished in light of the foregoing problems. An object of the invention is to provide a crane system in which wire ropes are pulled obliquely upwardly to suspend a hoisting accessory, and wire rope actions for traversing and hoisting/lowering of the hoisting accessory are coordinated for actual operation.

It is another object of the invention to provide a crane system of a downsized, simplified structure which has diminished the great rigidity and heavy weight of a conventional crane.

It is still another object of the invention to provide a crane system which has further ensured the anti-sway of a suspended load such as a container.

It is a further object of the invention to provide a crane system capable of favorably stacking a suspended load, such as a container, even when a floor surface is inclined.

A crane system according to the present invention comprises a body frame; a hoisting accessory provided with a connection point; a wire rope winding/unwinding drum attached to the body frame; sheaves attached to both ends, in a hoisting accessory traversing direction, of an upper surface of the body frame; a first wire rope attached at one end to the connection point, and passed at the other end round the drum via the sheave located at one of the ends; a second wire rope attached at one end to the connection point, and passed at the other end round the drum via the sheave located at the other end in a direction opposite to the direction of the first wire rope; and means attached to the body frame for moving the drum in a direction in which the hoisting accessory ascends or descends.

Another crane system according to the present invention comprises a body frame; a hoisting accessory provided with a connection point; a wire rope winding/unwinding drum attached to the body frame; sheaves attached to both ends, in a hoisting accessory traversing direction, of an upper surface of the body frame; a first wire rope attached at one end to the connection point, and passed at the other end round the drum via the sheave located at one of the ends; a second wire rope attached at one end to the connection point, and passed at the other end round the drum via the sheave located at the other end in a direction opposite to the direction of the first wire rope; a first movable pulley wound with the first wire rope located between the drum and the sheave at the one end; a second movable pulley wound with the second wire rope located between the drum and the sheave at the other end; and means attached to the body frame for moving the first and second movable pulleys in a direction in which the hoisting accessory ascends or descends.

Another crane system according to the present invention comprises a body frame; a hoisting accessory provided with a connection point; a wire rope winding/unwinding drum attached to the body frame; sheaves attached to both ends, in a hoisting accessory traversing direction, of an upper surface of the body frame; a first wire rope attached at one end to the connection point, and passed at the other end round the drum via the sheave located at one of the ends; a second wire rope attached at one end to the connection point, and passed at the other end round the drum via the sheave located at the other end in the same direction as the direction of the first wire rope; and means attached to the body frame for moving the drum in a direction in which the hoisting accessory traverses.

Another crane system according to the present invention comprises a body frame; a hoisting accessory provided with a connection point; a wire rope winding/unwinding drum attached to the body frame; sheaves attached to both ends, in a hoisting accessory traversing direction, of an upper surface of the body frame; a first wire rope attached at one end to the connection point, and passed at the other end round the drum via the sheave located at one of the ends; a second wire rope attached at one end to the connection point, and passed at the other end round the drum via the sheave located at the other end in the same direction as the direction of the first wire rope; a first movable pulley wound with the first wire rope located between the drum and the sheave at the one end; a second movable pulley wound with the second wire rope located between the drum and the sheave at the other end; and means attached to the body frame for moving the first and second movable pulleys in a direction in which the hoisting accessory traverses.

Thus, the wire ropes are stretched obliquely upwardly relative to the hoisting accessory. Because of a restraining force due to the horizontal tension of the wire ropes, sway of the hoisting accessory or a suspended load can be suppressed effectively. Furthermore, it is not necessary to consider the weight of the trolley or the weight of the transverse girders, or to give great rigidity to the transverse girders, as in the case of a conventional crane system. Basically, it suffices to support only the weights of the wire ropes, the hoisting accessory, and the suspended load. By so doing, a marked weight decrease can be achieved, and downsizing and simplification of the structure can be realized. Besides, the rope crane can be simplified and downsized because of decreased weight and rigidity, and preferred control of the suspended load can be attained through coordination between traversing and hoisting/lowering due to driving of the drum.

Another crane system according to the present invention comprises a body frame; a hoisting accessory provided with a connection point; a wire rope winding/unwinding drum attached to the body frame, and having two input shafts and two output shafts, the output shafts being rotatable in the same direction responsive to input from one of the shafts, and being rotatable in opposite directions responsive to input from the other shaft; sheaves attached to both ends, in a hoisting accessory traversing direction, of an upper surface of the body frame; a first wire rope attached at one end to the connection point, and passed at the other end round one of the output shafts of the drum via the sheave located at one of the ends; and a second wire rope attached at one end to the connection point, and passed at the other end round the other output shaft of the drum via the sheave located at the other end.

Another crane system according to the present invention comprises a body frame; a hoisting accessory provided with a connection point; a pair of first sheaves installed at the connection point; a wire rope winding/unwinding drum attached to the body frame, and having two input shafts and two output shafts, the output shafts being rotatable in the same direction responsive to input from one of the shafts, and being rotatable in opposite directions responsive to input from the other shaft; second sheaves attached to both ends, in a hoisting accessory traversing direction, of an upper surface of the body frame; a first wire rope attached at one end to one end, in the traversing direction, of an upper surface of the body frame, and passed at the other end round one of the output shafts of the drum via one of the first sheaves and the second sheave provided on a side where the one end of the first wire rope has been attached; and a second wire rope attached at one end to the other end, in the traversing direction, of the upper surface of the body frame, and passed at the other end round the other output shaft of the drum via the other first sheave and the second sheave provided on a side where the one end of the second wire rope has been attached.

Thus, the constituent drums can be easily rotationally driven in the same direction and in opposite directions by the wire rope winding/unwinding drum mechanism. Hence, a traversing and hoisting/lowering action can be performed by operation of a single driving unit. In addition, electric power consumption of the motor can be decreased regardless of the position of the suspended load.

According to the crane system of the present invention, wire rope length adjusting means may be provided between the connection point and the first wire rope and/or between the connection point and the second wire rope. Alternatively, wire rope length adjusting means may be provided between the body frame and the first wire rope and/or between the body frame and the second wire rope.

According to the crane system of the present invention, the drum is provided with taper portions; and the first and the second wire ropes are passed round the taper portions so that when tensions on the first and second wire ropes equal, portions of the first and second wire ropes passed round the drum have the same diameter, and when tensions on the first and second wire ropes do not equal, a portion of the wire rope passed round the drum and undergoing the higher tension has a smaller diameter, while a portion of the wire rope passed round the drum and undergoing the lower tension has a larger diameter.

Thus, no imbalance occurs in the ways of winding or in the diameters of the wound ropes on the drum, so that uniform load is imposed. Even if the hoisting accessory leans rightward or leftward in the traversing direction, torques acting on the drum are counterbalanced.

According to the crane system of the present invention, a second hoisting accessory following the aforementioned hoisting accessory and capable of ascending and descending relative to that hoisting accessory is provided below that hoisting accessory. By moving the lower hoisting accessory upward or downward relative to the upper hoisting accessory, interference by the obliquely upward wire rope is prevented. Thus, unloading onto a ship's hold, for example, can be performed without a hitch.

According to the crane system of the present invention, various modifications are available, such as the installation of the drum and the movable pulley moving means on an upper beam constituting the body frame, the installation of the drum and the drum moving means on the upper beam constituting the body frame, and the installation of the drum on the upper beam constituting the body frame.

The crane system of the present invention may have a constitution in which the aforementioned connection points are provided at four sites at the four corners of the hoisting accessory, and two of the sheaves corresponding to the connection points are attached to each of the four corners of the body frame; and may also have a constitution in which the connection points where the first sheaves are installed are provided at four sites at the four corners of the hoisting accessory, and two of the second sheaves corresponding to the first sheaves are attached to each of the four corners of the body frame. Thus, the anti-sway of the suspended load by the wire ropes can be further improved, and the posture of the suspended load can be controlled.

The crane system of the present invention may have a constitution in which a group of the first wire ropes and a group of the second wire ropes stretched between the connection points at the four sites and the corresponding sheaves are parallel to the traversing direction when viewed as a plan view, or may have a constitution in which a group of the first wire ropes and a group of the second wire ropes stretched between the body frame and the first sheaves and between the first sheaves and the corresponding second sheaves are parallel to the traversing direction when viewed as a plan view.

According to the crane system of the present invention, the length of the hoisting accessory in a direction perpendicular to the traversing direction is made greater than the length of the suspended load, whereby interference with stacked cargo by the hoisting accessory or the wire ropes can be prevented.

According to the crane system of the present invention, the group of the first wire ropes stretched from the connection points arranged at two sites in the traversing direction to the corresponding sheaves are parallel and of the same length when viewed as a vertical cross sectional view perpendicular to the traversing direction, and the group of the second wire ropes stretched from the connection points arranged at two sites in the traversing direction to the corresponding sheaves are parallel and of the same length when viewed as a vertical cross sectional view perpendicular to the traversing direction. Alternatively, the group of the first wire ropes stretched from the first sheaves arranged at two sites in the traversing direction to the corresponding second sheaves are parallel and of the same length when viewed as a vertical cross sectional view perpendicular to the traversing direction, and the group of the second wire ropes stretched from the first sheaves arranged at two sites in the traversing direction to the corresponding second sheaves are parallel and of the same length when viewed as a vertical cross sectional view perpendicular to the traversing direction. Thus, a group of adjacent parallel wire ropes of the plurality of wire ropes can be controlled to be taken up or paid out as a single unit, so that control can be simplified.

According to the crane system of the present invention, the connection points are movable so as to extend or contract in a direction perpendicular to the traversing direction, and the sheaves are movable so as to extend or contract in a direction perpendicular to the traversing direction. Alternatively, the connection points are movable so as to extend or contract in a direction perpendicular to the traversing direction, and portions of the first wire rope and the second wire rope mounted on the body frame, and the second sheaves are movable so as to extend or contract in a direction perpendicular to the traversing direction. Thus, even if the size of the suspended load changes, the changed size can be accommodated.

According to the crane system of the present invention, means for turning the hoisting accessory in a horizontal plane is provided. Thus, even if there is misalignment or the like of the suspended load, the suspended load can be hoisted or lowered without moving the entire crane system.

Another crane system according to the present invention comprises a body frame; a hoisting accessory provided with connection points at four sites at four corners; wire rope winding/unwinding drums attached to both ends, in a traversing direction, of an upper surface of the body frame; a group of first wire ropes attached at one end to the connection points, and passed at the other end round the drum located at one of the ends in the same direction for all the wire ropes; and a group of second wire ropes attached at one end to the connection points, and passed at the other end round the drum located at the other end in the same direction for all the wire ropes.

Another crane system according to the present invention comprises a body frame; a hoisting accessory provided with connection points at four sites at four corners; sheaves attached to both ends, in a traversing direction, of an upper surface of the body frame; a first wire rope winding/unwinding drum attached to the body frame; a second wire rope winding/unwinding drum attached to the body frame; a group of first wire ropes attached at one end to the connection points, and passed at the other end round the first drum via the sheave located at one of the ends in the same direction for all the wire ropes; and a group of second wire ropes attached at one end to the connection points, and passed at the other end round the drum via the sheave located at the other end in the same direction for all the wire ropes.

Another crane system according to the present invention comprises a body frame; a hoisting accessory provided with a connection point; a pair of first sheaves installed at the connection point; a first wire rope winding/unwinding drum attached to the body frame; a second wire rope winding/unwinding drum attached to the body frame; second sheaves attached to both ends, in a hoisting accessory traversing direction, of an upper surface of the body frame; a first wire rope passed at one end round the first drum, and passed at the other end round the second drum via the second sheave located at one of the ends and via one of the first sheaves; and a second wire rope passed at one end round the first drum in the same direction as the direction of the first wire rope, and passed at the other end round the second drum via the second sheave located at the other end and via the other first sheave in a direction opposite to the direction of the first wire rope.

Another crane system according to the present invention comprises a body frame; a hoisting accessory provided with a connection point; a pair of first sheaves installed at the connection point; a wire rope winding/unwinding drum attached to the body frame, and having two input shafts and two output shafts, the output shafts being rotatable in the same direction responsive to input from one of the shafts, and being rotatable in opposite directions responsive to input from the other shaft; a pair of second sheaves attached to each of both ends, in a hoisting accessory traversing direction, of an upper surface of the body frame; a first wire rope attached at one end to one end, in the traversing direction, of an upper surface of the body frame, and passed at the other end round one of the output shafts of the drum via one of the second sheaves provided on a side where the one end of the first wire rope has been attached, one of the first sheaves, and the other second sheave provided on the side where the one end of the first wire rope has been attached; and a second wire rope attached at one end to the other end, in the traversing direction, of the upper surface of the body frame, and passed at the other end round the other output shaft of the drum via one of the second sheaves provided on a side where the one end of the second wire rope has been attached, the other first sheave, and the other second sheave provided on the side where the one end of the second wire rope has been attached.

Another crane system according to the present invention comprises a body frame; a hoisting accessory provided with connection points at four sites at four corners; a pair of first sheaves installed at each of the connection points; a first wire rope winding/unwinding drum attached to the body frame; a second wire rope winding/unwinding drum attached to the body frame; a pair of second sheaves attached to each of both ends, in a hoisting accessory traversing direction, of an upper surface of the body frame; a group of first wire ropes attached at one end to one end, in the traversing direction, of the upper surface of the body frame, and passed at the other end round the first drum in the same direction for all the wire ropes via one of the second sheaves provided on a side where the one end has been attached, one of the first sheaves, and the other of the second sheaves provided on the side where the one end has been attached; and a group of second wire ropes attached at one end to the other end, in the traversing direction, of the upper surface of the body frame, and passed at the other end round the second drum in the same direction for all the wire ropes via one of the second sheaves provided on a side where the one end has been attached, the other of the first sheaves, and the other of the second sheaves provided on the side where the one end has been attached.

According to the crane system of the present invention, the connection points where the first sheaves are installed are provided at four sites at the four corners of the hoisting accessory, the second sheaves corresponding to the first sheaves are provided parallel at two sites each in the traversing direction at both ends of two transverse girders of the body frame, and mounting portions, at one end, of the first and second wire ropes are opposite end portions of the two transverse girders of the body frame.

According to the crane system of the present invention, the drums are placed at the middle of the two transverse girders such that the shaft center of one of the output shafts and the shaft center of the other output shaft are arranged parallel in the traversing direction, two of the first wire ropes passed from the second sheaves at the two sites on one end side of each of the two transverse girders and wound round one of the output shafts of the drum placed on the same transverse girder are wound symmetrically with respect to a line passing through the center of the length of the one output shaft, two of the second wire ropes passed from the second sheaves at the two sites on the other end side of each of the two transverse girders and wound round the other output shaft of the drum placed on the same transverse girder are wound symmetrically with respect to a line passing through the center of the length of the other output shaft, and the first wire ropes and the second wire ropes wound round the output shafts are symmetric with respect to a line passing through the center of the length of each of the transverse girders.

Where necessary, any of the above-described constitutions may be modified in any of the foregoing modes designed for anti-sway, downsizing and structure simplification by weight reduction, and so forth.

According to the crane system of the present invention, the crane may be a container crane, the connection point or connection points may be provided directly on a suspended load as a replacement for the hoisting accessory, the body frame may be mobile, and the body frame portion supporting the transverse girders may be a building.

The present invention also concerns a method for manipulating the position of a hoisting accessory of a crane, which comprises providing connection points at four sites at the four corners of the crane; stretching a first wire rope from each of the connection points toward one end, in a hoisting accessory traversing direction, of an upper surface of a crane body frame; stretching a second wire rope from each of the connection points toward the other end, in the hoisting accessory traversing direction, of the upper surface of the crane body frame; taking up one of the first and second wire ropes and paying out the other of the first and second wire ropes to make the hoisting accessory mainly traverse; and taking up or paying out both of the first and second wire ropes to make the hoisting accessory mainly ascend or descend.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DETAILED DESCRIPTION

The embodiments of the present invention will now be described in detail by reference to FIGS. 5 to 29.

Figure 5:
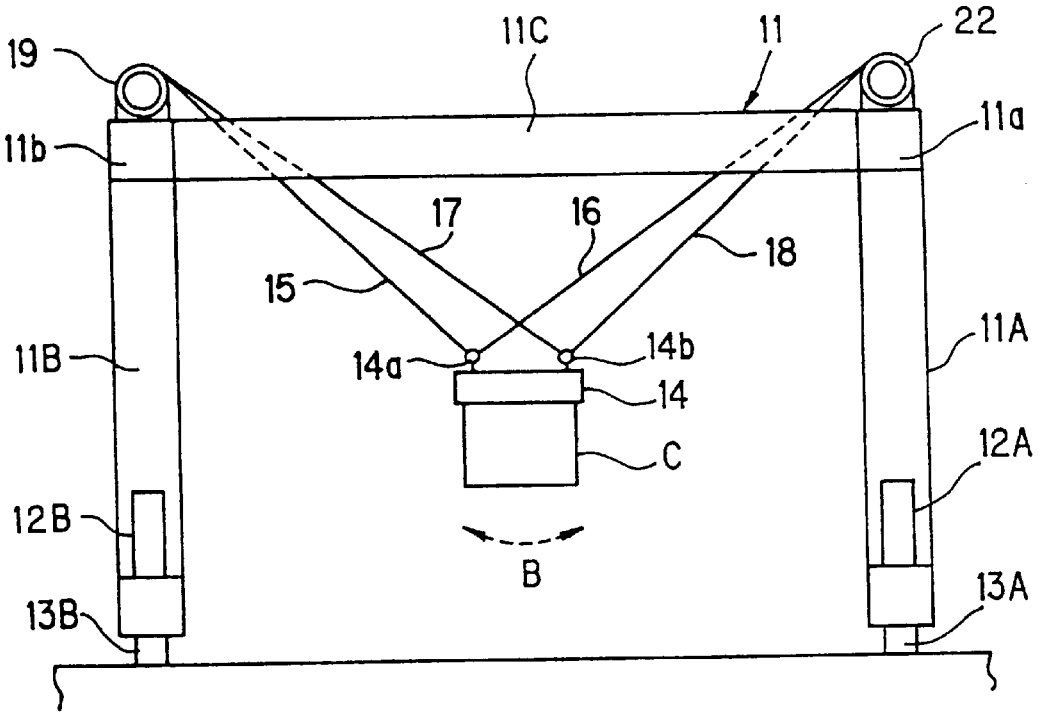
FIG. 5 is a constitution drawing showing a first embodiment of the present invention.
Figure 6:
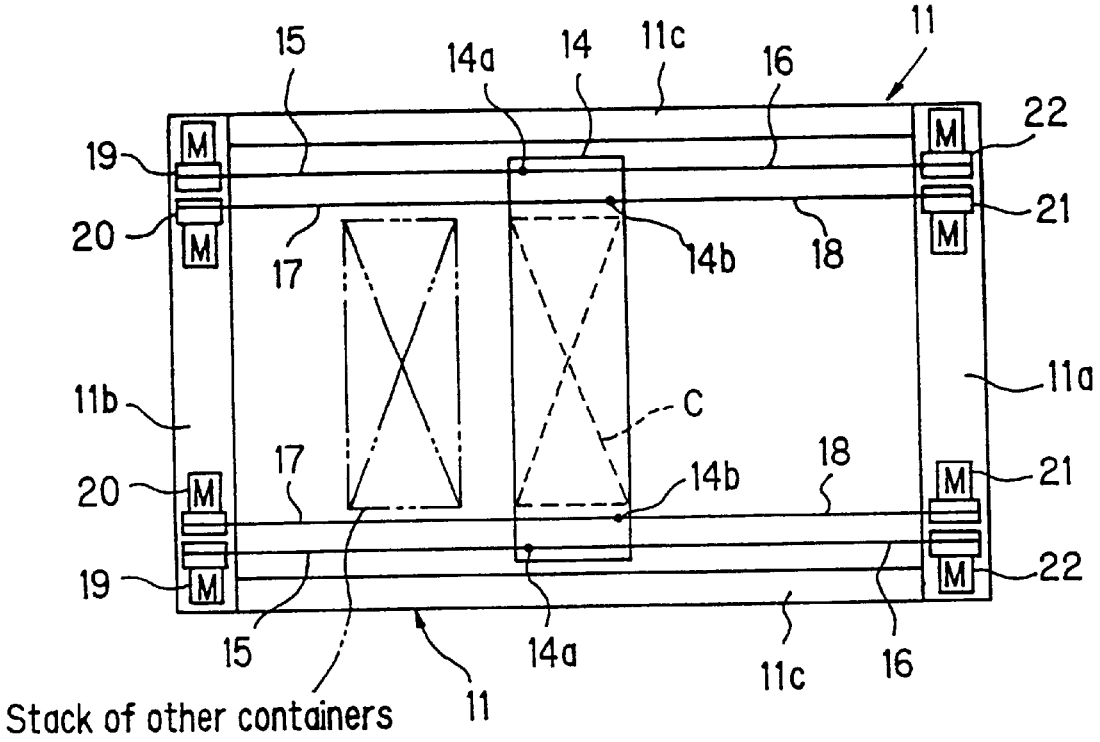
FIG. 6 is a plan view of FIG. 5.

FIGS. 5 and 6 show a first embodiment of the present invention applied to a gantry crane system. In FIGS. 5 and 6, the present crane system has a pair of front and rear body frames 11 each composed of legs 11A, 11B and a transverse girder 11*c* together shaped in a portal These front and rear body frames 11 are connected together by side beams 11*a*, 11*b*. The legs 11A, 11B of these body frames 11 are equipped at lower ends with a plurality of traveling wheels 13A, 13B. These traveling wheels 13A, 13B are rotationally driven by traction motors 12A, 12B, so that the body frames 11 can be moved in a forward or backward direction.

On the side beams 11*a*, 11*b* connecting the body frames 11, a plurality of electrically operated takeup drums 19, 20, 21, 22 for taking up and paying out wire ropes 15, 16, 17, 18 for load suspension are placed at each of the front and rear body frames 11, as shown in FIG. 6 as well.

Of these takeup drums 19, 20, 21, 22, the left takeup drums 19, 20 are borne on the side beam 11*b* provided at the left side (left side in FIG. 6) of the body frame 11, and are wound with end portions of the wire ropes 15, 17. The takeup drums 21, 22 are borne on the side beam 11*a* provided at the right side (right side in FIG. 6) of the body frame 11, and are wound with end portions of the wire ropes 16, 18.

At the back of a hoisting accessory 14 to which a container C is to be attached, four connection points 14*a*, 14*b* are provided at the four corners of the hoisting accessory 14. The two connection points 14*a* are provided in end portions in a front-to-back direction close to the left side of the hoisting accessory 14 shown in FIG. 6, and end portions of the wire ropes 15, 16 are connected to these connection points by turnbuckles. The other two connection points 14*b* are provided in end portions in the front-to-back direction close to the right side of the hoisting accessory 14 shown in FIG. 6, and end portions of the wire ropes 17, 18 are connected to these connection points by turnbuckles.

Thus, one end portion of the wire rope 15 is attached to the left takeup drum 19, while the other end portion of the wire rope 15 is connected to the connection point 14*a* on the hoisting accessory 14 by the turnbuckle. To the connection point 14*a* on the hoisting accessory 14, the other end portion of the wire rope 16 having an end portion attached to the right takeup drum 22 is also connected by the turnbuckle.

One end portion of the wire rope 17 is attached to the left takeup drum 20, while the other end portion of the wire rope 17 is connected to the connection point 14*b* on the hoisting accessory 14 by the turnbuckle. To the connection point 14*b* on the hoisting accessory 14, the other end portion of the wire rope 18 having an end portion attached to the right takeup drum 21 is also connected by the turnbuckle.

In this manner, the plural wire ropes 15, 16, 17, 18 are wound round the left takeup drums 19, 20 and the right takeup drums 21, 22, and the hoisting accessory 14 is suspended from the body frames 11 via these wire ropes 15, 16, 17, 18. To this hoisting accessory 14, the container C as a suspended load is attached.

The hoisting accessory 14 is formed such that its length in the front-to-back direction of the body frames 11 (the vertical direction in FIG. 6) is larger than the length in the depth direction (the front-to-back direction) of the container C, as shown in FIG. 6. When the container C is attached to the so formed hoisting accessory 14, both end portions in the depth direction of the hoisting accessory 14 protrude outward of both end portions in the depth direction of the container C.

The reason why the length in the depth direction of the hoisting accessory 14 protrudes relative to the length in the depth direction of the container C is that by so doing, the wire ropes 15, 16, 17, 18 are kept from touching a stack of other containers C. If the connection points 14*a*, 14*b* existed at positions inward of the length in the depth direction of the container C, the wire ropes 15, 16, 17, 18 would touch an adjacent stack of containers C. To prevent this, the length in the depth direction of the hoisting accessory 14 is extended relative to the length in the depth direction of the container C, and the connection points 14*a*, 14*b* are provided in this extension.

In this way, the four takeup drums, i.e., the left takeup drums 19, 20 and the right takeup drums 21, 22, are provided for each of the front and rear body frames 11, on the right and left side beams 11*a*, 11*b*. The left takeup drums 19, 20 are wound with the wire ropes 15, 17, while the right takeup drums 21, 22 are wound with the wire ropes 18, 16. Each of the takeup drums 19, 20, 21, 22 is provided with a motor M for driving, and the rotational driving of the motors M results in the taking-up or paying-out of the wire ropes 15, 16, 17, 18. In this case, when the wire ropes 15, 16, 17, 18 are taken up or paid out, the hoisting accessory 14 is moved upward or downward, or rightward or leftward. A description of this motion will be offered later on.

According to the crane system of the present embodiment, the takeup drums 19, 20, 21, 22 are borne on the side beams 11*a*, 11*b*, and only the loads of the wire ropes 15, 16, 17, 18, hoisting accessory 14 and container C are imposed. Thus, the crane system is freed from the load of a trolley, and the weight and rigidity of transverse girders, unlike the conventional crane system. This leads to a marked decrease in weight or a reduction in rigidity.

Also, the connection points 14*a*, 14*b* are provided at the four corners of the hoisting accessory 14, and they are pulled by the wire ropes 15, 16, 17, 18 obliquely upwardly. Thus, a vertical component of force, i.e., the weight of the container C, and a horizontal component of force act on the wire rope. This horizontal component of force serves as a lateral restraining force, which can suppress sway, even if the container is subject to an inertial force during movement, or a force from a strong wind or the like. Furthermore, the connection points are present at the four corners of the hoisting accessory 14; namely, there are the connection points 14*a*, 14*b* at different positions in the width direction (right-to-left direction) of the hoisting accessory 14, as shown in FIG. 5. Hence, sway B can be suppressed more effectively.

Figure 7:
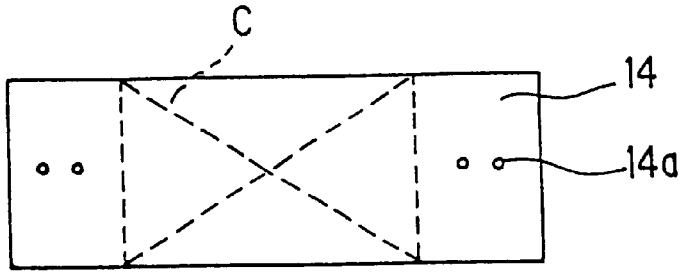
FIGS. 7(*a*) to 7(*e*) are views showing the state of placement of a connection point or connection points.
Figure 7:
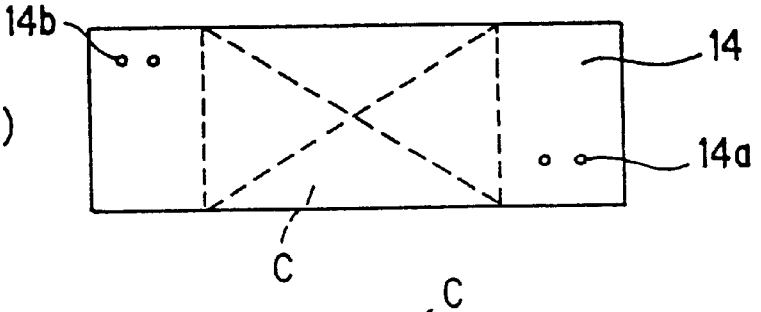
Figure 7:
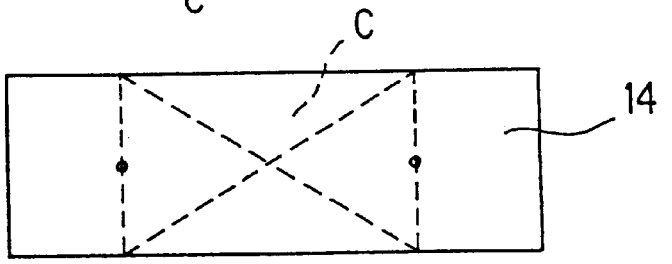
Figure 7:
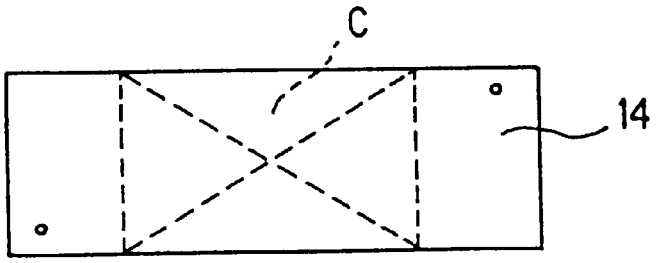
Figure 7:
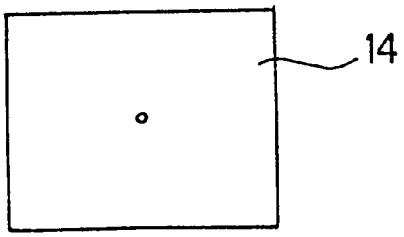

The positions of the connection points 14*a*, 14*b* on the hoisting accessory 14 are not limited to the structure shown in FIG. 6, but a structure as illustrated in FIG. 7 is also conceivable. That is, there may be a structure (a) in which the connection points 14*a* are provided in a row at the center in the width direction of the hoisting accessory 14, or a structure (b) in which the connection points 14*a* are provided on the left side (the lower side in the drawing) at one end in the depth direction of the hoisting accessory 14, while the connection points 14*b* are provided on the right side (the upper side in the drawing) at the other end in the depth direction of the hoisting accessory 14; namely, the connection points 14*a*, 14*b* are provided at two corners on a diagonal line.

Various other states of arrangement of the connection points are also available as shown in FIG. 7(*c*), 7(*d*) and 7(*e*) (although not restricted to FIGS. 7(*a*) to 7(*e*)), and the locations and the number of the connection points can exist diversely depending on the type of a suspended load, and so forth. In any of FIGS. 7(*a*), 7(*b*), 7(*c*), 7(*d*) and 7(*e*), sway of the suspended load cannot be completely prevented because of the arrangement of the connection points. However, sway of the connection points can be prevented, since the wire ropes are pulled obliquely upwardly. To keep a horizontal posture as will be described later, or where necessary, to follow a slope of the floor, support needs to be provided through three or more connection points.

In addition, when the connection points are provided at the four corners of the hoisting accessory 14 as shown in FIG. 6, the amounts of the wire ropes 15, 16, 17, 18 taken up or paid out are adjusted by the left takeup drums 19, 20 and the right takeup drums 21, 22. By this measure, the hoisting accessory 14, eventually the container C, can be brought to a horizontal posture, or tilted in the right-to-left direction, or in the front-to-back direction. As noted from this, posture adjustment can be made. Hence, even if the aforementioned floor is sloped, and the entire crane system is inclined, control of the posture of the container would enable the hoisting accessory 14 and the container C to move up or down or right or left without touching other containers stacked.

Of the wire ropes 15, 16, 17, 18, the wire ropes 15 and 18 are short in the length up to the left takeup drum 19 and the right takeup drum 21, respectively, and pulled at a steep angle of inclination as shown in FIG. 5. Whereas the wire ropes 16 and 17 are longer than the wire ropes 15 and 18 in the length up to the right takeup drum 22 and the left takeup drum 20, and pulled at a relatively mild angle of inclination as shown in FIG. 5. Thus, the vertical component of force and the horizontal component of force acting on the wire ropes 15, 18 are different from those acting on the wire ropes 16, 17. Consequently, the wire ropes 15, 18 mainly serve to move the hoisting accessory 14 and the container C in an up-and-down direction and a right-and-left direction, while the wire ropes 16, 17 mainly serve to keep the hoisting accessory 14 and the container C in a horizontal posture.

Besides, the connection point 14*a* and the connection point 14*b* are provided so as to be displaced from each other on the hoisting accessory 14 in the depth (front-to-back)

direction of the body frames 11, as shown in FIG. 6. Thus, the longer wire rope 16 connected to the connection point 14*a*, and the longer wire rope 17 connected to the connection point 14*b* are prevented from crossing and touching each other.

The left takeup drums 19, 20 and the right takeup drums 21, 22 are driven in a coordinated manner to adjust the takeup amounts and the payoff amounts for the wire ropes 15, 16, 17, 18 attached thereto. By this means, the hoisting accessory 14 and the container C can be made to move in a traversing direction (horizontal direction) and in an up-and-down direction (vertical direction). In other words, when the container C is caused to traverse, it is sufficient for the right takeup drums 21, 22 and the left takeup drums 19, 20 to take up and pay out the wire ropes in the same amount. To make the container C traverse in a posture kept horizontal, however, there is need to provide a difference between the takeup or payoff amount of the right takeup drums 21, 22 and that of the left takeup drums 19, 20. This difference needs to be increased as the container C and the hoisting accessory 14 lean rightward or leftward, i.e., become closer to the leg 11A or 11B. This means that during the traversal or upward or downward movement of the hoisting accessory 14 and the container C positioned at the center in the right-and-left direction of the body frames 11, the amounts of takeup and payoff by the left takeup drums 19, 20 and the right takeup drums 21, 22 may be the same. However, it is necessary to consider the amount of movement in the hoisting or lowering direction as the hoisting accessory 14 and the container C lean rightward or leftward during traversing. When the hoisting accessory 14 and the container C are hoisted or lowered while they are leaning rightward or leftward, there is need to consider the amount of their movement in the traversing direction. The aforementioned coordination between the left takeup drums 19, 20 and the right takeup drums 21, 22 refers to control taking into consideration the hoisting or lowering (upward or downward) position during traversing, and control taking into consideration the traversing (rightward or leftward) position during hoisting or lowering.

According to the present crane system, as noted above, the left takeup drums 19, 20 and the right takeup drums 21, 22 are driven in a coordinated manner, whereby the wire ropes 15, 16, 17, 18 are taken up to move the hoisting accessory 14 upward, while the wire ropes 15, 16, 17, 18 are paid off to move the hoisting accessory 14 downward.

At this time, the amount of takeup or payoff of the wire ropes 15, 16, 17, 18 is calculated, whereby the hoisting accessory 14 and the container C can be moved upward or downward, with the lateral position of the hoisting accessory 14 and the container C being adjusted, and with their horizontal posture being held by adjustment.

On the other hand, the left takeup drums 19, 20 and the right takeup drums 21, 22 are driven in a coordinated manner, whereby the wire ropes 15, 17 are taken up or paid off and the wire ropes 16, 18 are paid off or taken up to move the hoisting accessory 14 rightward or leftward. That is, when the container C is to be moved rightward (rightward in FIG. 5), the left takeup drums 19, 20 and the right takeup drums 21, 22 are driven in a coordinated manner to pay out the wire ropes 15, 17 and also take up the wire ropes 16, 18, thereby moving the hoisting accessory 14.

When the container C is to be moved leftward (left ward in FIG. 5), by contrast, the left take up drums 19, 20 and the right takeup drums 21, 22 are driven in a coordinated manner to take up the wire ropes 15, 17 and also pay out the wire ropes 16, 18, thereby moving the hoisting accessory 14.

In this case, too, the amounts of takeup or payoff of the wire ropes 15, 16, 17, 18 are calculated, whereby the hoisting accessory 14 and the container C can be moved in a lateral direction, with the hoisting or lowering position of the hoisting accessory 14 and the container C being adjusted and with their horizontal posture being held by adjustment.

According to the present crane system, the amounts of takeup and payoff of the wire ropes 15, 16, 17, 18 can be adjusted by the takeup drums 19, 20, 21, 22. Thus, the container C can be moved in an up-and-down direction and a traversing direction in a stable posture, or in some cases with a changed posture, while being suspended only by the wire ropes 15, 16, 17, 18.

According to the crane system relevant to the present embodiment, therefore, there is no need to provide rails or a traversing trolley on transverse girders as done with the aforementioned conventional crane system. Consequently, the load on the body frames 11 can be decreased, so that the body frames 11 can be made light-weight and simplified.

Furthermore, it suffices to provide the hoisting accessory 14 with the connection points 14*a*, 14*b*, so that the hoisting accessory 14 can also be made light-weight and simplified. Hence, the advantage is produced that the entire crane system can be made light-weight and simplified.

Also, the wire ropes 15, 16, 17, 18 are pulled obliquely upwardly, whereby the horizontal component of force can be exerted as a restraining force, thus making the anti-sway of the hoisting accessory 14 and the container C possible. Depending on the positions of the connection points 14*a*, 14*b* of the hoisting accessory 14, further anti-sway becomes possible. Thus, the hoisting accessory 14 and the container C can be moved at a high speed, and operation performed in a short time. This brings the advantage that the operating efficiency can be increased.

Furthermore, the takeup drums 19, 20, 21, 22 are driven in a coordinate manner for hoisting or lowering during traversing, and for traversing during hoisting or lowering, thereby making possible a traversing movement kept at a horizontal position, or an upward or downward movement kept at a traversing (right-and-left) position.

The above-described coordination also makes it possible to adjust the horizontal posture of the hoisting accessory 14 and the container C. Thus, even when work is done on a sloped floor FL, the posture of the hoisting accessory 14 and the container C can be always kept horizontal. With its contact with other container C being avoided, the container C can be positioned accurately. Since the container C can be placed reliably at a predetermined position, the advantage that the operating efficiency can be increased is presented.

Since the connection points 14*a*, 14*b* are provided in both end portions of the hoisting accessory 14 beyond the container C, moreover, the wire ropes 15, 16, 17, 18 can be kept from contacting other containers C.

Figure 4:
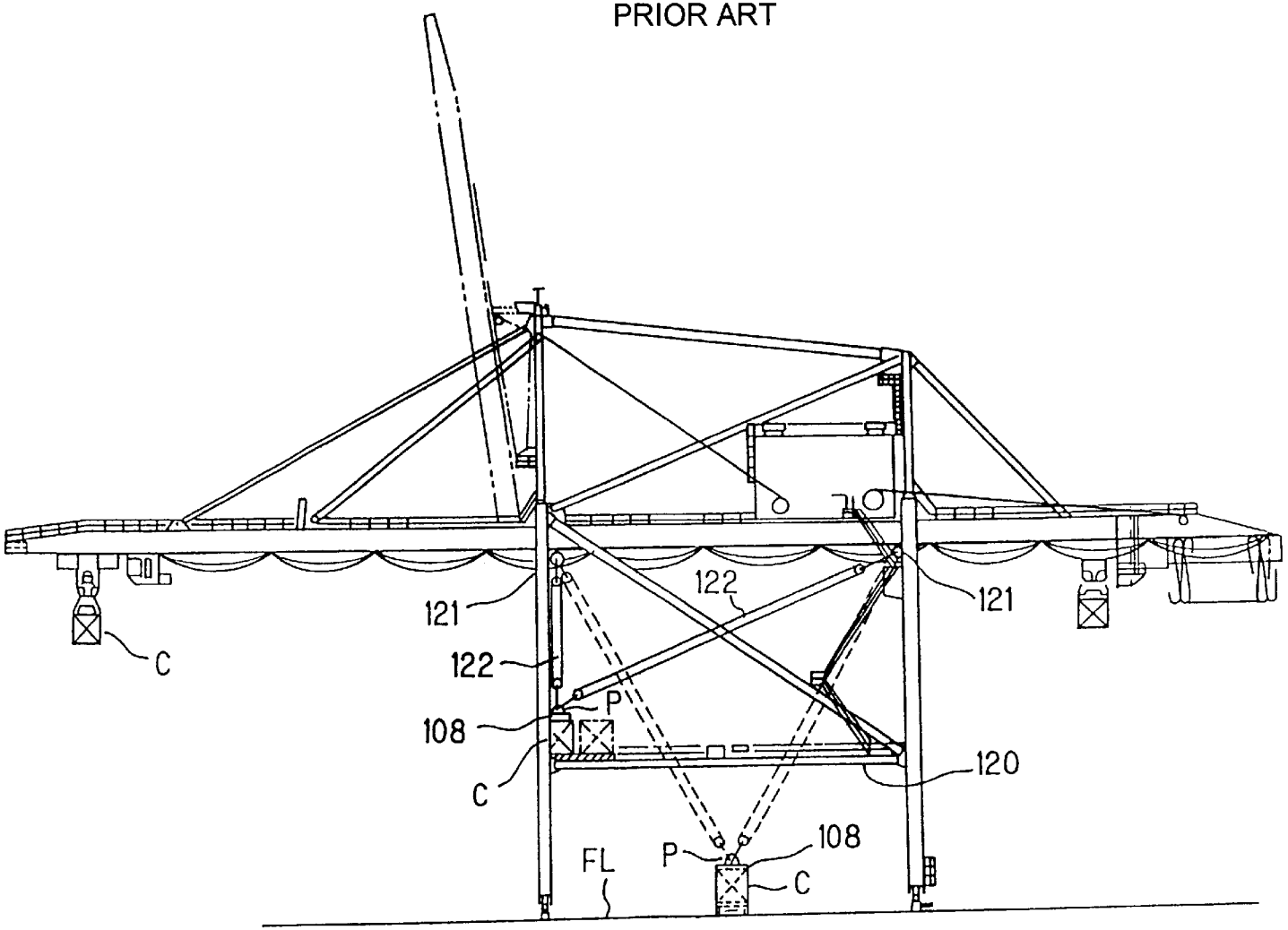
FIG. 4 PRIOR ART
FIG. 4 is a view showing a crane for loading and landing cargo, as a whole.

The foregoing structure shown in FIGS. 5 and 6 is useful as a concrete and feasible crane system, unlike the crane system of FIG. 4 with wire ropes merely stretched.

Next, a crane system according to a second embodiment of the present invention will be described with reference to FIGS. 8 and 9.

Figure 8:
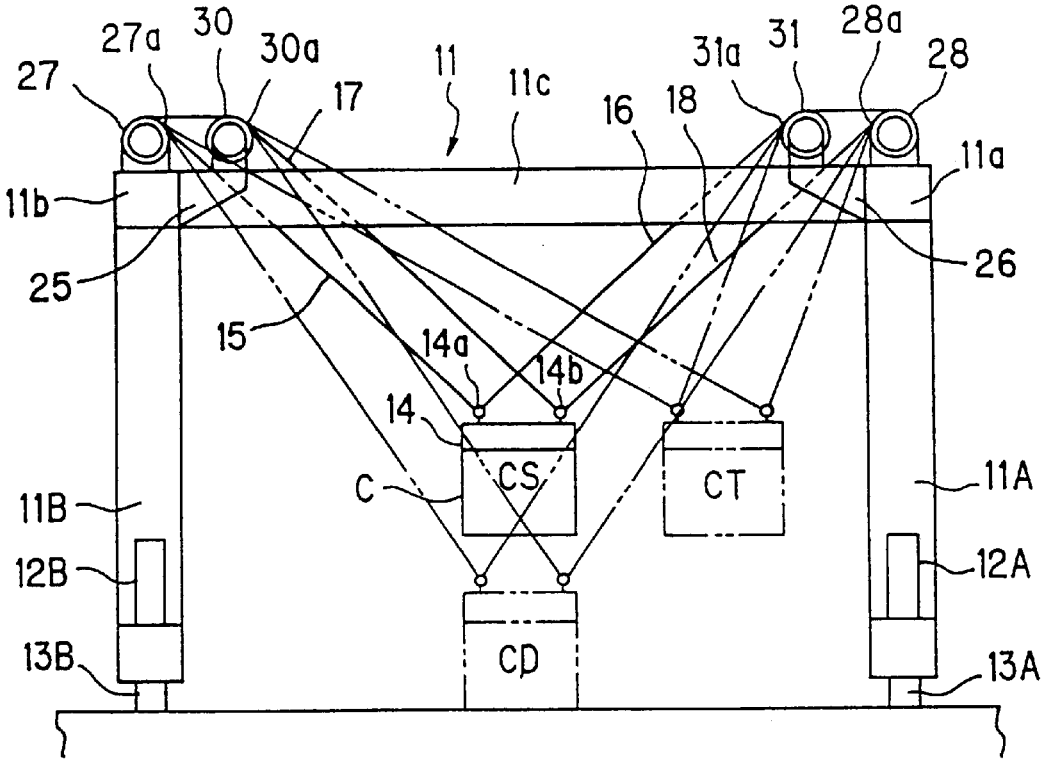
FIG. 8 is a constitution drawing of a second embodiment of the present invention.
Figure 9:
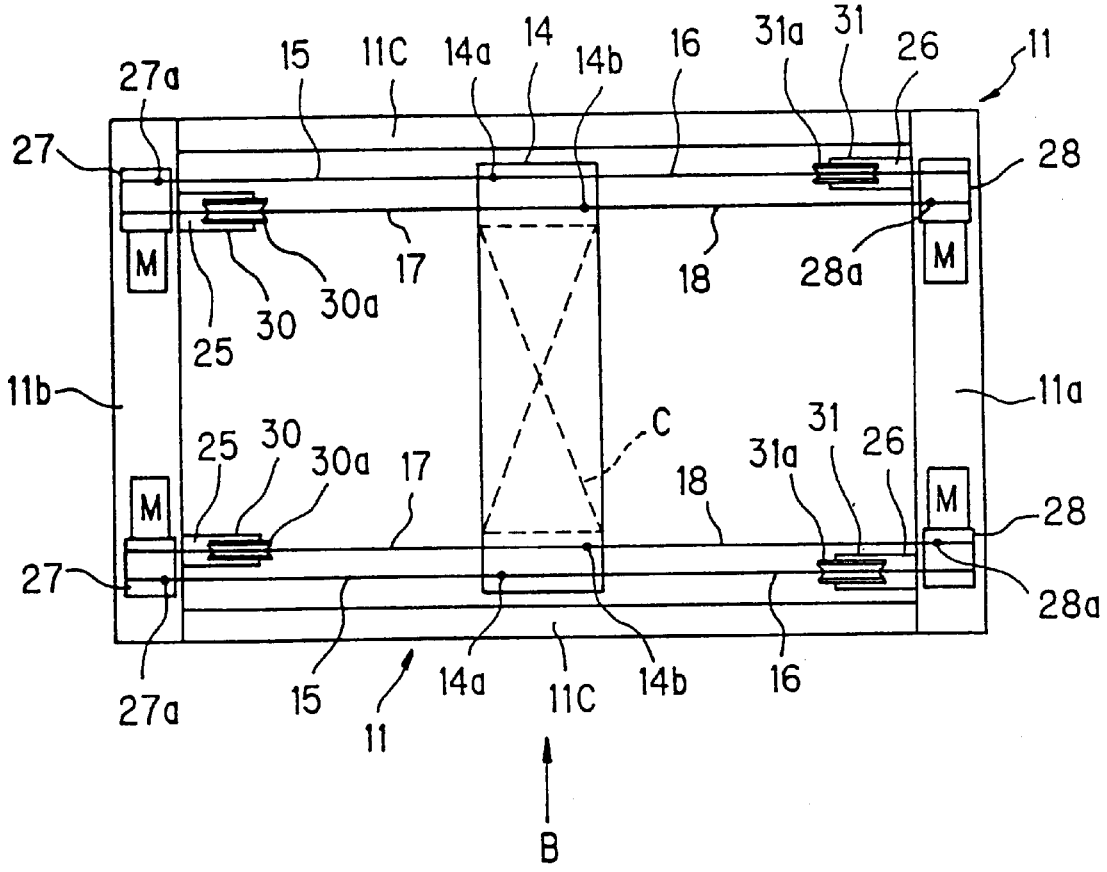
FIG. 9 is a plan view of FIG. 8.

The crane system according to this embodiment, as shown in FIGS. 8 and 9, is different from the crane system of the aforementioned first embodiment in that sheaves as guide members are added. Because of this constitution, a single takeup drum is enough to take up and pay out a plurality of wire ropes. Thus, the number of parts of the control system can be decreased, and control for takeup and payoff of the wire ropes by the takeup drums can be simplified.

That is, according to the present embodiment, a plurality of takeup drums 27, 28 for taking up and paying out wire ropes 15, 16, 17, 18 for load suspension are borne on side beams 11*a*, 11*b* for connecting body frames 11 together, as shown in FIGS. 8 and 9. Furthermore, the wire ropes 16, 17 are connected to connection points on a hoisting accessory 14 via sheaves 31, 30.

In FIGS. 8 and 9, the same parts as in FIGS. 5 and 6 are assigned the same numerals or symbols, except the takeup drums 27, 28.

In FIGS. 8 and 9, one end portion of each of the two wire ropes 15, 17 is attached to the left takeup drum 27. The other end portion of the wire rope 15 is connected to a connection point 14*a* on the hoisting accessory 14 by a turnbuckle. Whereas the other end portion of the wire rope 17 is connected to a connection point 14*b* on the hoisting accessory 14 by a turnbuckle via the sheave (guide member) 30.

To the right takeup drum 28, one end portion of each of the two wire ropes 16, 18 is attached. The other end portion of the wire rope 18 is connected to the connection point 14*b* on the hoisting accessory 14 by a turnbuckle. Whereas the other end portion of the wire rope 16 is connected to the connection point 14*a* by a turnbuckle via the sheave (guide member) 31.

In this case, the left takeup drum 27 functions to take up and pay out the two wire ropes 15, 17 simultaneously. Whereas the right takeup drum 28 functions to take up and pay out the two wire ropes 16, 18 simultaneously.

The sheaves 30, 31 are constituted such that the magnitude of their outer diameter is the same as the magnitude of the outer diameter of the left takeup drum 27 and the right takeup drum 28. These sheaves 30, 31 are attached to inner surfaces of the side beams 11*a*, 11*b* via mounting portions 25, 26.

In this case, the sheaves 30, 31 are arranged such that the horizontal height position of a point 27*a* where the wire rope 15 contacts the left takeup drum 27 is equal to the horizontal height position of a point 30*a* where the wire rope 17 contacts the sheave 30.

The sheave 30 is placed relative to the left takeup drum 27 such that the distance between the point 27*a* where the wire rope 15 contacts the left takeup drum 27 and the point 30*a* where the wire rope 17 contacts the sheave 30 is equal to the distance between the connection point 14*a* where the wire rope 15 is connected by the turnbuckle and the connection point 14*b* where the wire rope 17 is connected by the turnbuckle.

Likewise, the sheave 31 is placed relative to the right takeup drum 28 such that the distance between a point 28*a* where the wire rope 18 contacts the right takeup drum 28 and a point 31*a* where the wire rope 16 contacts the sheave 31 is equal to the distance between the connection points 14*a* and 14*b*.

Here, the points of contact, 27*a*, 30*a*, 28*a*, 31*a*, are called contact points.

These contact points 27*a* and 30*a* are moved along the circumferences of the left takeup drum 27 and the sheave 30 as the hoisting accessory 14 and the container C are moved. However, a line connecting the contact points 27*a* and 30*a* together is always horizontal, and the distance between the contact points 27*a* and 30*a* also always equals the distance between the connection points 14*a* and 14*b*. Thus, a quadrangle formed by the connection point 14*a*, the contact point 27*a*, the contact point 30*a* and the connection point 14*b* is always a parallelogram.

Hence, when the hoisting accessory 14 and the container C are to be moved, the length of the wire rope 15 from the contact point 27*a* to the connection point 14*a* can be made always equal to the length of the wire rope 17 from the contact point 30*a* to the connection point 14*b*, and the length of the wire rope 18 from the contact point 28*a* to the connection point 14*b* can be made always equal to the length of the wire rope 16 from the contact point 31*a* to the connection point 14*a*, regardless of the positions of the hoisting accessory 14 and the container C as shown in FIG. 8.

Unlike the constitution shown in FIGS. 5 and 6, therefore, the postures of the hoisting accessory 14 and the container C can be kept always horizontal, without need to adjust the length of the wire rope 15 and the length of the wire rope 17, and without need to adjust the length of the wire rope 18 and the length of the wire rope 16.

In other words, to keep the hoisting accessory 14 and the container C in horizontal postures, the amounts of takeup or payoff of the wire ropes 15, 16, 17, 18 need not be adjusted separately. As stated earlier, it suffices to attach the two wire ropes 15, 17 to the single left takeup drum 27, attach the two wire ropes 16, 18 to the single right takeup drum 28, and drive the left takeup drum 27 and the right takeup drum 28 in a coordinated manner. Simply by so doing, the hoisting accessory 14 and the container C can be moved in the up-and-down direction and the traversing direction, with their postures being kept horizontal. This obviates the need to coordinate the actions of the takeup drums as in the first embodiment, for the purpose of keeping a horizontal posture. If the hoisting accessory 14 and the container C lean rightward or leftward, however, hoisting or lowering (upward or downward) position adjustment is necessary for traversing, and traversing (leftward or rightward) position adjustment is necessary for hoisting or lowering, thus requiring coordination between the left takeup drum 27 and the right takeup drum 28. Consequently, there is no need for control for adjusting the amounts of payoff and takeup of the wire ropes intended to keep the horizontal posture of the hoisting accessory 14 and the container C. It is enough to carry out control for adjusting the amounts of payoff and takeup of the wire ropes merely in consideration of the positions to which the hoisting accessory 14 and the container C are to be brought. Hence, facilitation and simplification of the control can be achieved.

Figure 1:
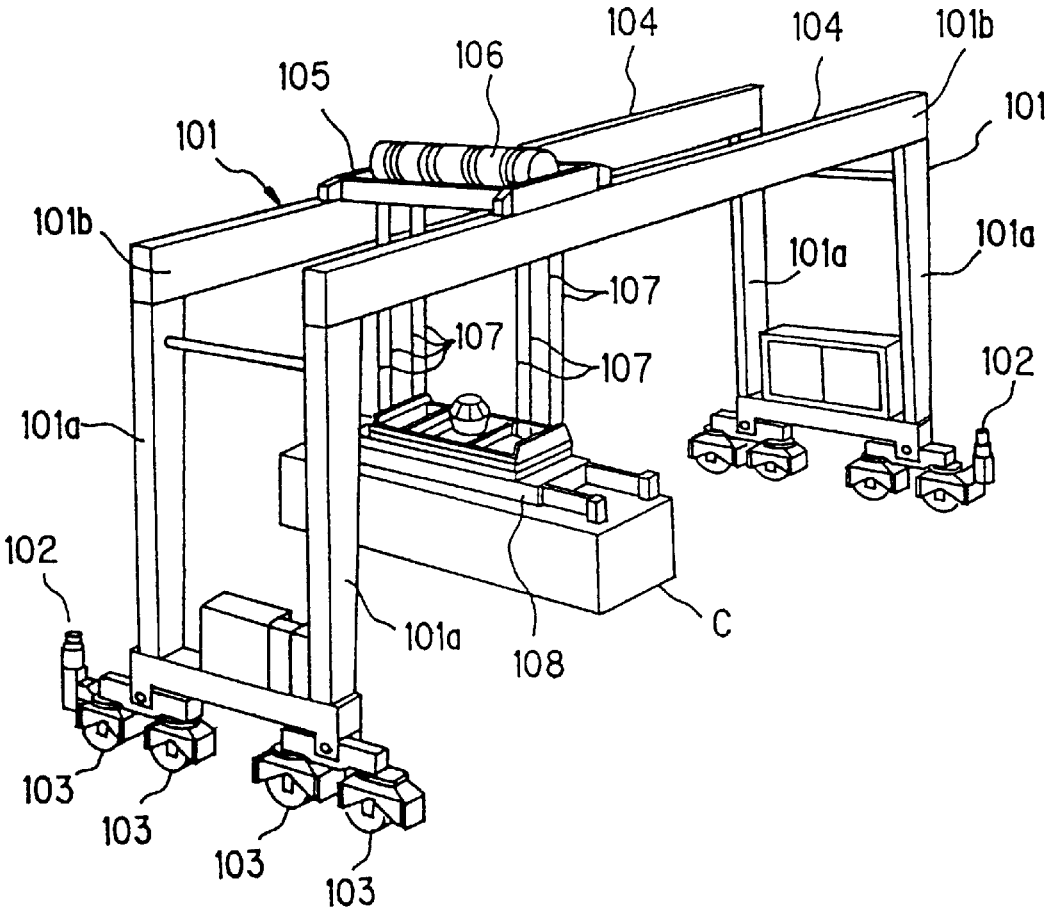
FIG. 1 PRIOR ART
FIG. 1 is a schematic perspective view showing the whole of a conventional gantry crane system.
Figure 2:
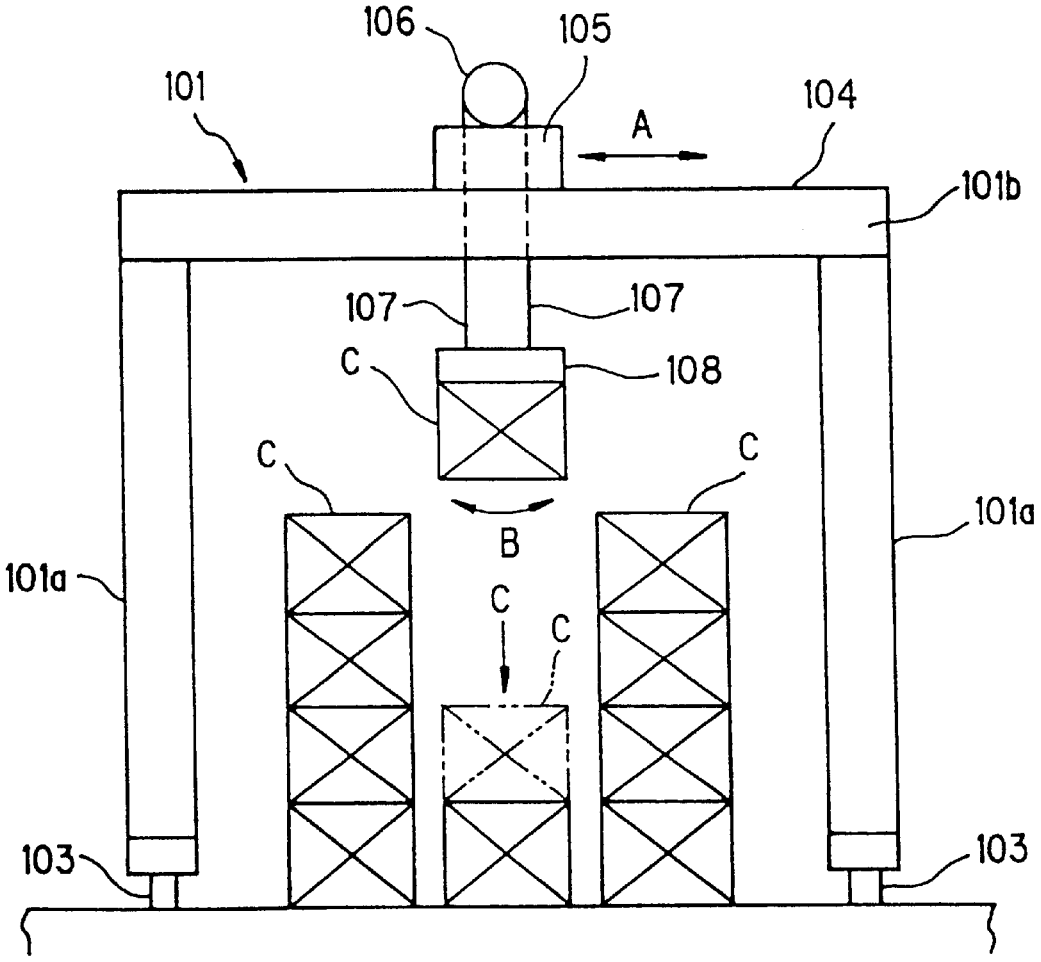
FIG. 2 PRIOR ART
FIG. 2 is a view showing the state of conventional carriage of a container.
Figure 3:
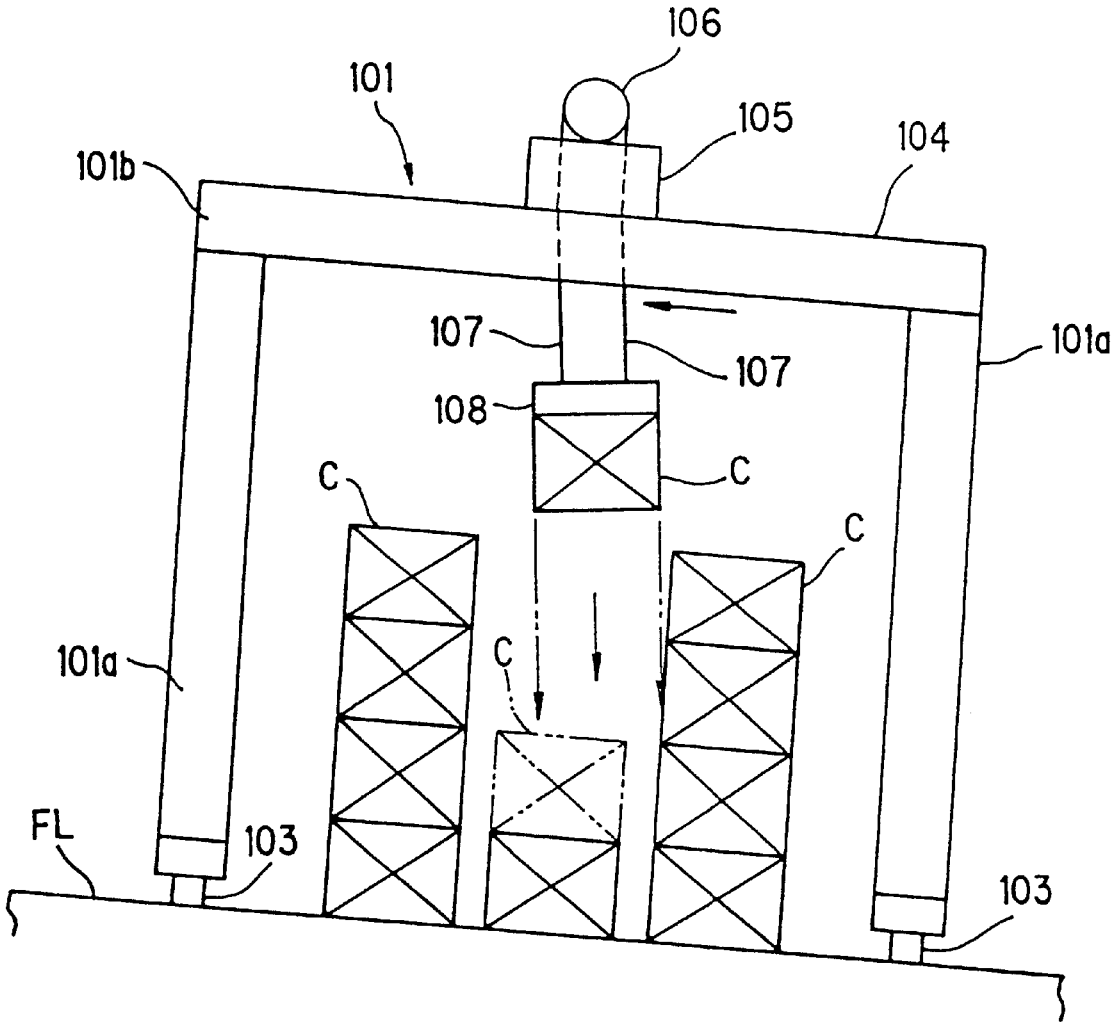
FIG. 3 PRIOR ART
FIG. 3 is a view showing the state of carriage of a container on a sloped floor.

Even when the containers C are piled up on a sloped floor FL as shown in FIG. 3, the container C is kept in a horizontal posture with respect to the floor FL. Thus, stacking of the containers C becomes possible, regardless of the slope.

According to the present crane system, the left takeup drum 27 and the right takeup drum 28 are driven in a coordinated manner, whereby the wire ropes 15, 16, 17, 18 are taken up to move the hoisting accessory 14 upward, or the wire ropes 15, 16, 17, 18 are paid out to move the hoisting accessory 14 downward.

Consider, for example, a case in which the container C in the state CD at a central position in the right-and-left direction shown in FIG. 8 is to be moved upward (i.e., the container C at position CD indicated by a two-dot chain line in FIG. 8 is to be moved to position CS indicated by a solid line). In this case, the left takeup drum 27 and the right takeup drum 28 are driven in a coordinated manner to take up the wire ropes 1S, 16, 17, 18, whereby the hoisting accessory 14 can be moved upward.

Consider, on the other hand, a case in which the container C is to be moved downward (i.e., the container C at position CS indicated by the solid line is to be moved to position CD indicated by the two-dot chain line in FIG. 8). In this case, the left takeup drum 27 and the right takeup drum 28 are driven in a coordinated manner to pay out the wire ropes 15, 16, 17, 18, whereby the hoisting accessory 14 can be moved downward.

In this case, the length of the wire rope 15 from the contact point 27*a* to the connection point 14*a* is always equal to the length of the wire rope 17 from the contact point 30*a* to the connection point 14*b*, and the length of the wire rope 18 from the contact point 28*a* to the connection point 14*b* is also always equal to the length of the wire rope 16 from the contact point 31*a* to the connection point 14*a*. Thus, the postures of the hoisting accessory 14 and the container C can be held always horizontal.

According to the present crane system, moreover, the left takeup drum 27 and the right takeup drum 28 are driven in a coordinated manner, whereby the wire ropes 15, 17 are taken up or paid out, and the wire ropes 16, 18 are paid out or taken up, to move the hoisting accessory 14 horizontally.

Consider, for example, a case in which the container C in FIG. 8 is to be moved rightward (i.e., the container C at position CS indicated by the solid line in FIG. 8 is to be moved to position CT indicated by a two-dot chain line). In this case, the left takeup drum 27 and the right takeup drum 28 are driven in a coordinated manner to pay out the wire ropes 15, 17 and take up the wire ropes 16, 18, whereby the hoisting accessory 14 can be moved rightward.

Consider, on the other hand, a case in which the container C is to be moved leftward in FIG. 8 (i.e., the container C at position CT indicated by the two-dot chain line is to be moved to position CS indicated by the solid line in FIG. 8). In this case, the left takeup drum 27 and the right takeup drum 28 are driven in a coordinated manner to take up the wire ropes 15, 17 and pay out the wire ropes 16, 18, whereby the hoisting accessory 14 can be moved leftward.

In this case, except that the container C is positioned at the center in the right-and-left direction of the body frames 11 as stated previously, it is necessary to make hoisting or lowering (upward or downward) adjustment between the left takeup drum 27 and the right takeup drum 28 during traversing, or make rightward or leftward adjustment between the left and right takeup drums 27 and 28 during hoisting or lowering, as the container C leans leftward or rightward.

The crane system according to the present embodiment, therefore, exhibits the same effects as in the aforementioned first embodiment, and also shows the following effects:

Because of the provision of the sheaves 30, 31, the length of the wire rope 15 from the contact point 27*a* to the connection point 14*a* can be always equated to the length of the wire rope 17 from the contact point 30*a* to the connection point 14*b*, and the length of the wire rope 18 from the contact point 28*a* to the connection point 14*b* can also be always equated to the length of the wire rope 16 from the contact point 31*a* to the connection point 14*a*.

Thus, the plural wire ropes 15, 17 can be attached to the single takeup drum 27, and the plural wire ropes 16, 18 can be attached to the single takeup drum 28. This presents the advantage that the number of parts of the drive system can be reduced.

Furthermore, it becomes unnecessary to adjust the amounts of payoff and takeup of the wire ropes 15, 16, 17, 18 in order to keep the posture of the hoisting accessory 14 and the container C horizontal. The only task to do is to adjust the amounts to payoff and takeup of the wire ropes 15, 16, 17, 18 based on consideration for the position at which the container C is to be placed. This brings the advantage that relevant control can be facilitated and simplified, so that facilities with high work efficiency can be supplied at a low cost.

According to the present second embodiment having the sheaves 30, 31 as guide members, the length of the wire rope 15 from the contact point 27*a* to the connection point 14*a* is always rendered equal to the length of the wire rope 17 from the contact point 30*a* to the connection point 14*b*, and the length of the wire rope 18 from the contact point 28*a* to the connection point 14*b* is always rendered equal to the length of the wire rope 16 from the contact point 31*a* to the connection point 14*a*. However, the guide members are not restricted to the sheaves 30, 31, but other guide members can be used, as long as they can support the wire ropes 15, 16, 17, 18.

For the crane system of this second embodiment as well, an example having the connection points at the four corners on the hoisting accessory 14 is shown. Since these connection points are arranged out of alignment in the width direction of the hoisting accessory 14, the sheaves are provided to give the same amounts of takeup or payoff by the takeup drums. However, it is permissible to provide a single connection point at the center-of-gravity position, or provide the connection points as shown in FIG. 7. In this case, the sheaves may become unnecessary, but it becomes possible to wind two wire ropes about the same takeup drum.

In the above-described first and second embodiments, the wire ropes 15 and 16 from left and right, and the wire ropes 17 and 18 from left and right are tied to the same connection point, respectively. However, it is possible, needless to say, to constitute the wire ropes 15 and 16, or the wire ropes 17 and 18, from a single wire rope by fixing this wire rope at the connection point.

The traversing-hoisting/lowering coordination type crane system described above is a practically feasible, useful crane system among wire rope crane systems adapted to move a suspended load by a combination of only body frames, takeup drums, and wire ropes, intended for a light-weight, simplified structure of the system. This type of crane system has achieved coordination of the takeup drums for traversing and hoisting/lowering, efficient operation due to the anti-sway effect on the hoisting accessory and suspended load depending on the locations and the number of the connection points, retention of a horizontal posture, and a light-weight, simplified structure ascribed to reductions in the rigidity and increased weight of the crane system. Furthermore, the present crane system has attained retention of a horizontal posture by sheaves, and light weight and simplified coordinated action because of winding of the plural wire ropes around the takeup drum.

The inventors have further invented a further modified embodiment for light weight, simplification or reduced power consumption of the system while upgrading coordination between traversing and hoisting/lowering and maintaining an anti-sway effect.

Figure 10:
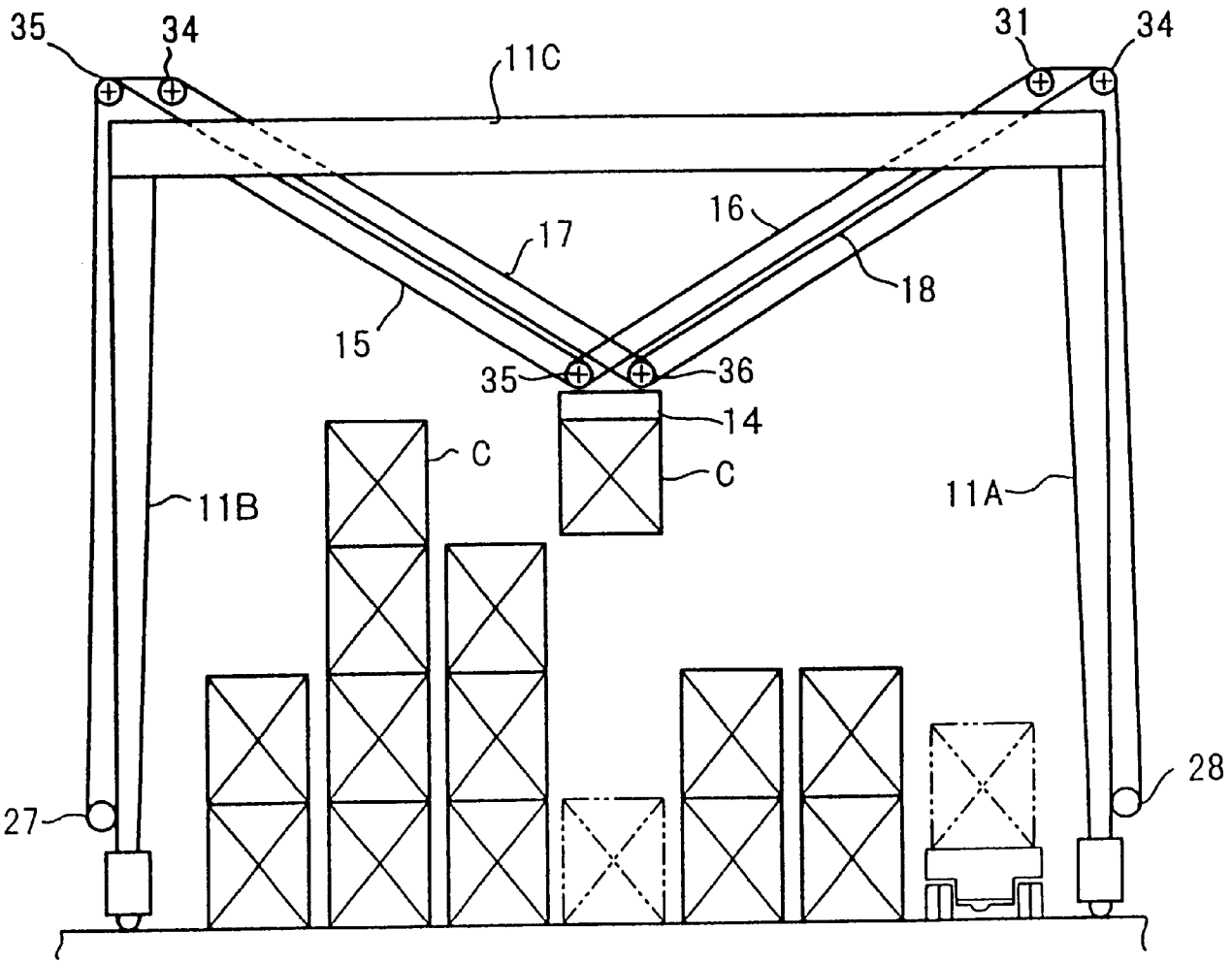
FIG. 10 is a constitution drawing of a third embodiment of the present invention.

FIG. 10 is their proposed crane system, its difference from FIGS. 8 and 9 being that the takeup drums 27, 28 present on the side beams 11*a*, 11*b* in FIGS. 8 and 9 are replaced by sheaves 33, 34, and sheaves 35, 36 are provided at the connection points on the hoisting accessory 14. The sheaves 35, 36 at the connection points are composed of two individual sheaves. In FIGS. 8 and 9, the wire ropes 15, 16, 17, 18 are fixed by turnbuckles at the connection points 14*a*, 14*b*. Whereas in FIG. 10 an end of each of the wire ropes 15, 16, 17, 18 is fixed, for example, to a transverse girder 11*c*. Thus, the wire ropes 15, 16, 17, 18 are passed over the sheaves 35, 36 at the connection points on the hoisting accessory 14, and then wound round drums 28, 27, provided on legs 11A, 11B, via sheaves 30, 31, 33, 34.

This constitution shown in FIG. 10 is also different from the aforementioned second embodiment only in terms of the positions of the sheaves 35, 36 on the hoisting accessory 14 and the positions of the drums 27, 28. Thus, this constitution is enough to produce the same effects as in the second embodiment.

Figure 11:
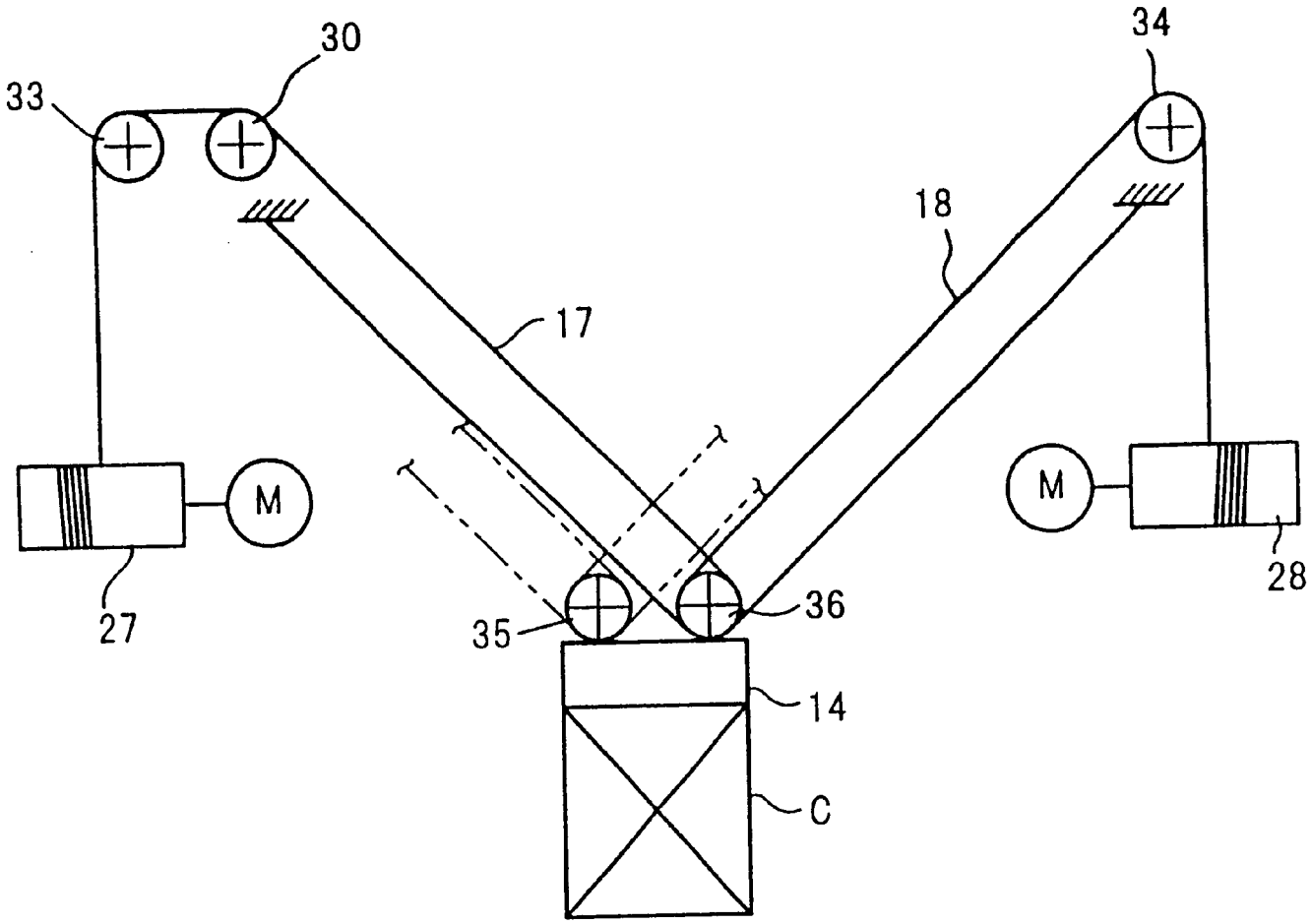
FIG. 11 is a schematic view for explaining FIG. 10.

FIG. 11 focuses on the sheave 36 at the right connection point on the hoisting accessory 14 in the constitution shown in FIG. 10, and schematically illustrates the passing of the wire ropes 17, 18 around the sheave 36. One end of the wire rope 18 is fixed to the transverse girder of the body frame, and further passed round one of the sheaves 36 on the hoisting accessory 14, and then the other end of the wire rope 18 is wound round the takeup drum 28 on a lower portion of a leg via the sheave 34 situated on a side beam of the body frame. Likewise, one end of the wire rope 17 is fixed to the transverse girder of the body frame, and further passed round the other sheave 36 at the connection point on the hoisting accessory 14, and then the other end of the wire rope 17 is wound round the takeup drum 27 on a lower portion of a leg via the sheaves 30, 31 situated on a side beam of the body frame.

Because of this constitution, motors M are driven to take up or pay out the takeup drums 27, 28 similarly, whereby the hoisting accessory 14 can be hoisted or lowered in an up-and-down direction. Alternatively, one of the takeup drums, 27 or 28, is taken up, and the other takeup drum 28 or 27 is paid out, whereby the hoisting accessory 14 can be caused to traverse in a right-and-left direction. In this case, as the hoisting accessory 14 comes closer to the leg, i.e., as the hoisting accessory 14 leans rightward or leftward, adjustment in the hoisting or lowering (upward or downward) direction becomes necessary during traversing, and adjustment in the traversing (rightward or leftward) direction becomes necessary during hoisting or lowering. This is as have been described regarding coordination in the first and second embodiments.

In the third embodiment shown in FIGS. 10 and 11, an example provided with the sheaves 30, 31 such that the wire ropes 15 and 17 and 16 and 18 are parallel to each other has been shown as a modification of the example shown in FIGS. 8 and 9. However, an example provided only with the sheaves 33, 34 corresponding to the members in FIGS. 5 and 6 without providing these sheaves 30, 31 can also be applied, although adjustment is tiresome to make.

In this third embodiment, the sheaves 35, 36 on the hoisting accessory 14 have been shown to be provided at four sites, i.e., four corners. However, these sheaves are also applicable to the embodiment shown in FIG. 7.

The description offered until now shows the embodiments provided with the connection points 14*a*, 14*b* on the hoisting accessory 14 in connection with FIGS. 5, 6, 8 and 9, and shows the embodiment provided with the sheaves 35, 36 at the connection points on the hoisting accessory 14 in FIGS. 10 and 11. These embodiments have been described as having the takeup drums 19, 20, 21, 22 or 27, 28 provided on the side beams or legs on both sides of the body frames 11. The present invention has applied further improvement for decreasing a driving force.

Figure 12:
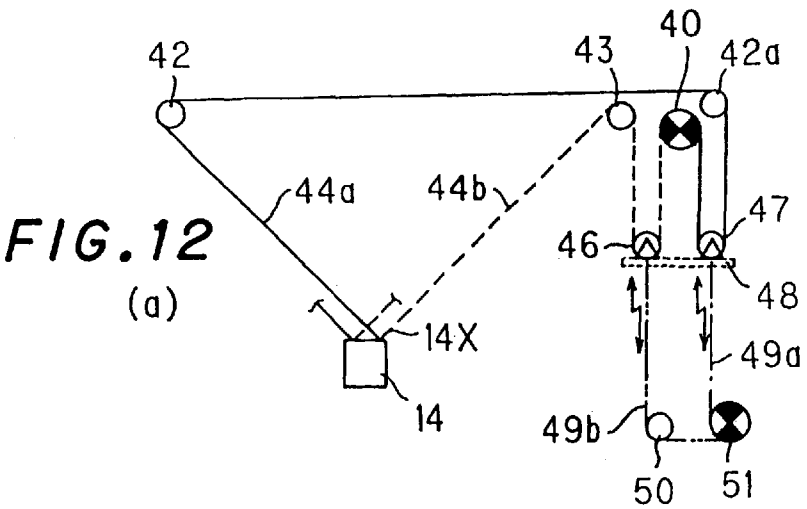
FIGS. 12(*a*) to 12(*d*) are schematic views showing fourth and fifth embodiments of the present invention and their modifications.
Figure 12:
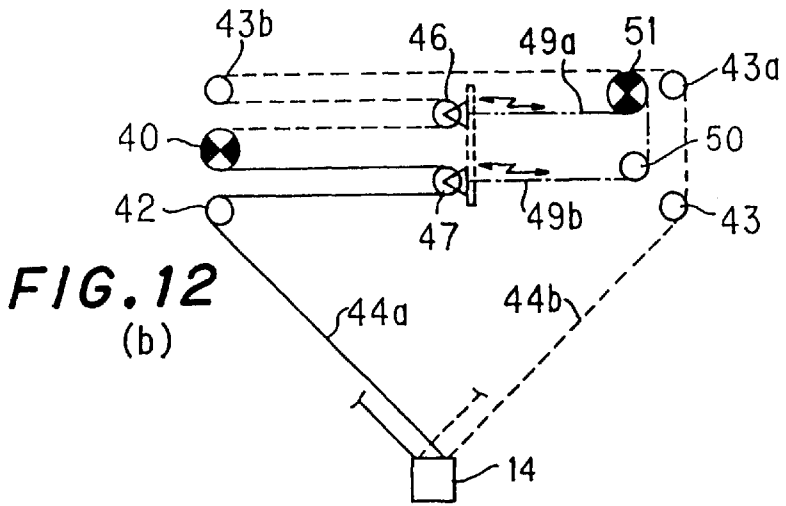
Figure 12:
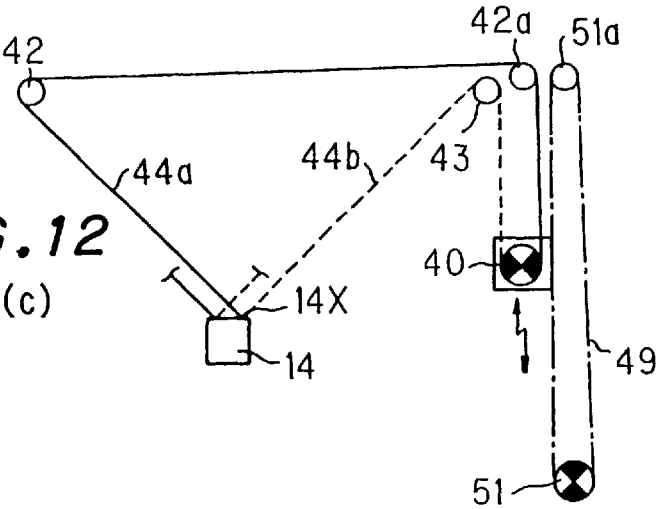
Figure 12:
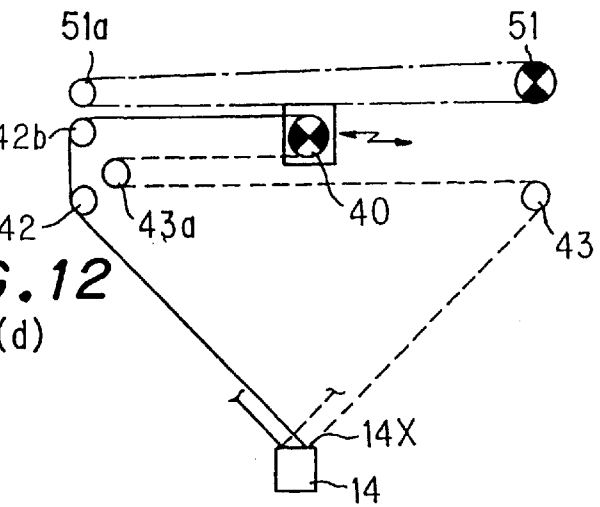

FIGS. 12(*a*) to 12(*d*) show another embodiment of a newly improved traversing-hoisting/lowering coordinated type crane system. FIGS. 12(*a*) to 12(*d*) schematically show the system in which takeup drums are divided into a traversing drum and a hoisting/lowering drum, and a loop is formed with a wire rope (i.e., a state in which the wire rope is routed in a loop form between the same drums and a hoisting accessory).

FIGS. 12(*a*) to 12(*d*) also mainly show the arrangement of sheaves relative to a hoisting accessory 14, and the use of a traversing drum 40 and a hoisting/lowering drum 51. FIG. 12(*a*) shows a fourth embodiment in which wire ropes 44*a*, 44*b* fixed to a connection point 14X on the hoisting accessory 14 are passed over right and left sheaves 42 and 43 provided on upper portions of legs of body frames or on side beams. Further, the wire rope 44*a* on the left sheave 42 is passed over a right sheave 42*a*. The wire ropes 44*a*, 44*b* on the sheave 43 and the sheave 42*a* are wound round the traversing drum 40 in opposite directions via movable pulleys 46, 47 such that one of these wire ropes is taken up, while the other wire rope is paid out.

Thus, when the traversing drum 40 is rotationally driven, the wire rope 44*b* or 44*a*, for example, is paid out, while the wire rope 44*a* or 44*b* is taken up, so that the hoisting accessory 14 traverses leftward or rightward.

Further, the movable pulleys 46, 47 are supported upwardly or downwardly movably by a support plate 48, and engaged with wire ropes 49*a*, 49*b*. The wire rope 49*b* is further wound round the hoisting/lowering drum 51 in the same direction via a sheave 50.

Thus, when the hoisting/lowering drum 51 is rotationally driven, the wire ropes 49*a*, 49*b* are simultaneously taken up or paid out to move the movable pulleys 46, 47. In other words, the upward or downward movement of the movable pulleys 46, 47 results in the hoisting or lowering (upward or downward movement) of the hoisting accessory 14.

In the present embodiment, the wire ropes 44*a*, 44*b* are looped as traversing wire loops, and the traversing drum 40, the hoisting/lowering drum 51, and the movable pulleys 46, 47 are installed concentratedly at the right side of the body frames. In this manner, a lateral installation mode with the movable pulleys moved is constructed.

FIG. 12(*b*) shows a modification of the fourth embodiment in FIG. 12(*a*). In FIG. 12(*b*), the same parts as in FIG. 12(*a*) are designated by the same numerals. To turnbuckles at the connection point 14X on the hoisting accessory 14, the wire ropes 44*a*, 44*b*are fixed. The wire rope 44*a* is wound round the traversing drum 40 via the sheave 42 and the movable pulley 47, while the wire rope 44*b* is wound round the traversing drum 40 via the sheave 43, sheaves 43*a*, 43*b* and the movable pulley 46. The wire ropes 44*a*, 44*b* are wound round the traversing drum 40 in opposite directions. Thus, following the rotational driving of the traversing drum 40, the wire rope 44*a* or 44*b* is taken up, and the wire rope 44*b* or 44*a* is paid out. As a result, the hoisting accessory 14 traverses rightward or leftward.

The movable pulleys 46, 47 are adjusted using the wire ropes 49*a*, 49*b* via the support plate 48, and the wire ropes 49*a*, 49*b* are wound round the hoisting/lowering drum 51 via the sheave 50 or directly. In this case, the wire ropes 49*a*, 49*b* are wound round the hoisting/lowering drum 51 in the same direction.

Upon the rotational driving of the hoisting/lowering drum 51, the wire ropes 29*a*, 29*b* are simultaneously taken up or paid out to hoist or lower the hoisting accessory 14.

FIG. 12(*b*), showing the modification of the fourth embodiment, lacks the sheave 42*a*, and additionally has the sheaves 43*a*, 43*b*, in comparison with FIG. 12(*a*). In FIG. 12(*a*), the traversing drum 40, the hoisting/lowering drum 51, and the movable pulleys 46, 47 are placed at the right side of the body frames. In FIG. 12(*b*), on the other hand, these members are provided at an upper portion of the crane system. In this manner, an upper installation mode with the movable pulleys moved is constructed.

In FIGS. 12(*a*) and 12(*b*), traversing is mainly performed by driving the traversing drum 40, while hoisting or lowering is performed mainly by the movement of the movable pulleys 46, 47 due to the driving of the hoisting/lowering drum 51.

FIGS. 12(*c*) and 12(*d*) show a fifth embodiment and its modification. FIG. 12(*c*) concerns the fifth embodiment, in which the wire ropes 44*a*, 44*b* are connected to the turnbuckles at the connection point 14X on the hoisting accessory 14, the wire rope 44*a* is wound round the traversing drum 40 via the sheaves 42, 42*a*, and the wire rope 44*b* is wound round the traversing drum 40 via the sheave 43. In this case, the wire ropes 44*a*, 44*b* are wound round the traversing drum 40 in opposite directions. When the wire rope 44*a* or 44*b* is wound by the rotational driving of the traversing drum 40, the wire rope 44*b* or 44*a* is paid out, so that the hoisting accessory 14 traverses in the right-and-left direction.

The traversing drum 40 is directly joined to a wire rope 49. The wire rope 49 is looped between a hoisting/lowering drum 51 and a sheave 51*a*, and following the rotational driving of the hoisting/lowering drum 51, the entire traversing drum 40 is moved in the up-and-down direction (hoisting/lowering direction). Thus, the rotational driving of the hoisting/lowering drum 51 results in the hoisting or lowering of the hoisting accessory 14 in the up-and-down direction.

In the fifth embodiment shown in FIG. 12(*c*), unlike FIGS. 12(*a*) and 12(*b*), the traversing drum 40 is directly moved, and the traversing drum 40 and the hoisting/lowering drum 51 are placed on the right side of the body frames. In this manner, a lateral installation mode with the drums directly moved is constructed.

FIG. 12(*d*), showing a modification of the embodiment in FIG. 12(*c*), additionally has a sheave 43*a* and includes a sheave 42*b*, in comparison with FIG. 12(*c*). In FIG. 12(*c*), the traversing drum 40 and the hoisting/lowering drum 51 are placed at the right side of the body frames. In FIG. 12(*d*), on the other hand, these members are provided at an upper portion of the crane system. In this manner, an upper installation mode with the drums directly move is constructed.

As noted above, FIGS. 12(*a*), 12(*b*), 12(*c*), 12(*d*) show configurations in which the wire ropes 44*a*, 44*b* form a loop involving the traversing drum 40. In FIGS. 12(*a*), 12(*b*), 12(*c*), 12(*d*) as well, the hoisting/lowering drum 51 or the traversing drum 40 is driven during traversing or during hoisting or lowering. That is, as the hoisting accessory 14 leans rightward or leftward, hoisting or lowering motion is increased during traversing, or traversing motion is increased during hoisting or lowering. In this manner, the traversing drum 40 and the hoisting/lowering drum 51 are coordinated to move the hoisting accessory 14 straightly rightward or leftward, or vertically upward or downward.

In the embodiments shown in FIGS. 12(*a*), 12(*b*), 12(*c*), 12(*d*), the wire ropes 44*a*, 44*b* are stretched obliquely relative to the hoisting accessory 14. This constitution contributes to anti-sway, and the coordination between the traversing drum 40 and the hoisting/lowering drum 51 can smooth the movement of the hoisting accessory 14. Besides, the weight of the hoisting accessory 14 and the suspended load (not shown) is supported by the traversing drum 40 and the hoisting/lowering drum 51. Moreover, the tensions of the right and left wire ropes 44*a* and 44*b* work in directions in which they counteract. Thus, when the hoisting accessory 14 and the suspended load are present at the center in the right-and-left direction of the body frames, for example, the torques of the drums become null as a result of counteraction. Even when the hoisting accessory 14 and the suspended load lean rightward or leftward, the difference in tension is exerted on the traversing drum 40, so that the volume of the traversing drum 40 can be made small. This means a further improvement in power saving as compared with the first, second and third embodiments shown in FIGS. 5, 6, 8, 9, 10 and 11 that are different from the loop configurations illustrated in FIGS. 12(*a*), 12(*b*), 12(*c*) and 12(*d*). This is a great contribution to reduction in the drum power consumption.

FIGS. 12(*a*),12(*b*), 12(*c*) and 12(*d*) show the loop configurations in which the wire ropes 44*a*, 44*b* form a loop involving the traversing drum 40. Next, FIGS. 13(*a*), 13(*b*), 13(*c*), 13(*d*) show embodiments in which wire ropes 44*a*, 44*b* form a loop involving a hoisting/lowering drum 51.

Figure 13:
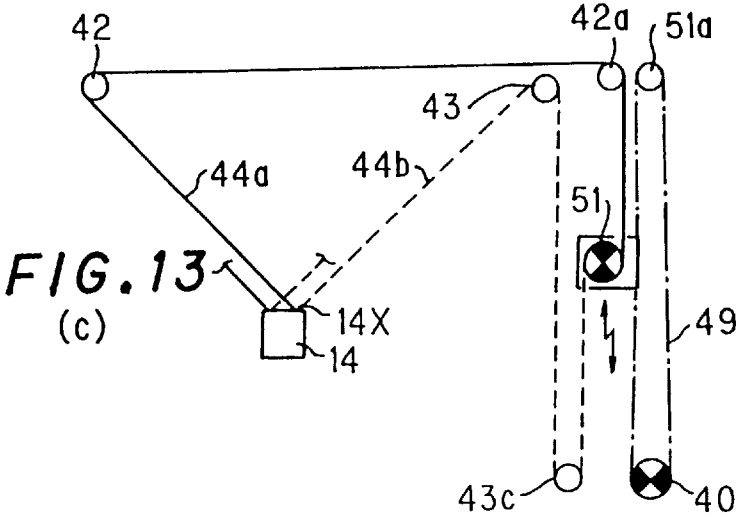
FIGS. 13(*a*) to 13(*d*) are schematic views showing sixth and seventh embodiments of the present invention and their modifications.
Figure 13:
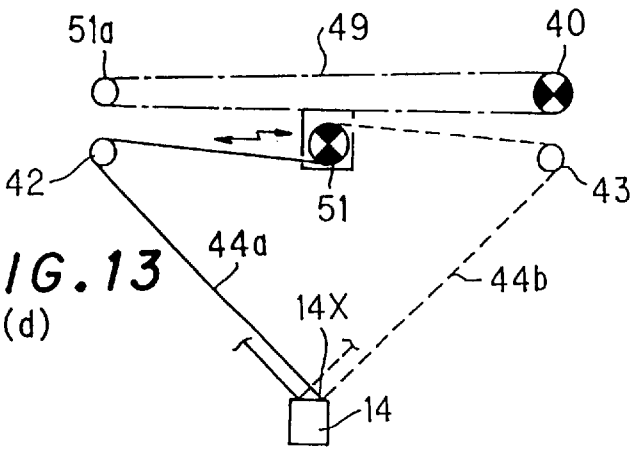
Figure 13:
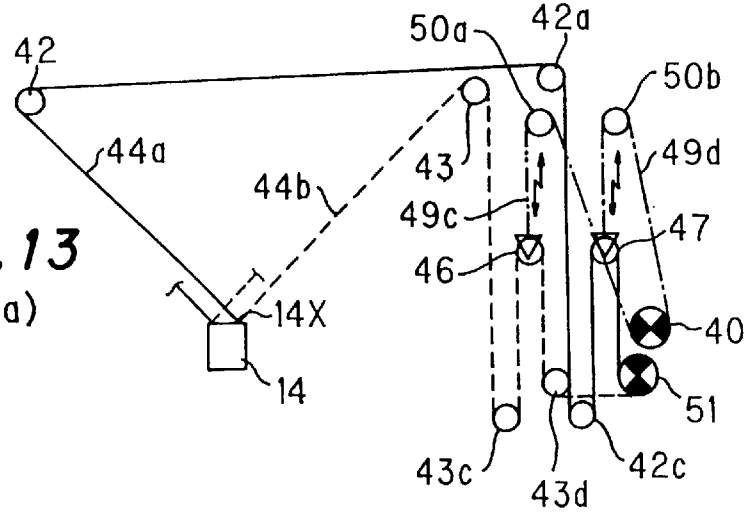
Figure 13:
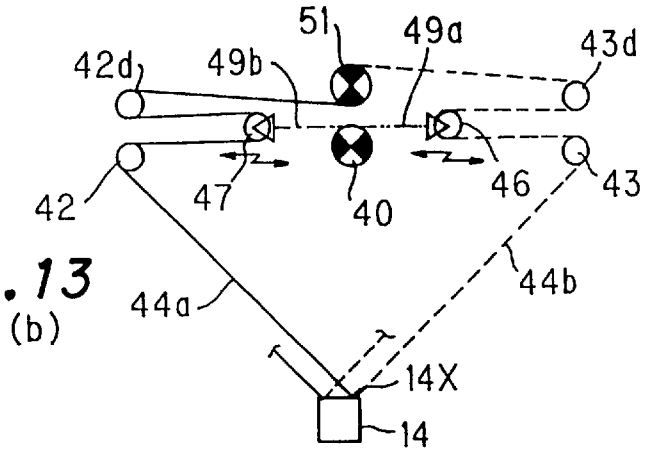

FIG. 13(*a*) shows a sixth embodiment, in which the wire ropes 44*a*, 44*b* are connected to turnbuckles at a connection point 14X on a hoisting accessory 14. The wire rope 44*a* is wound round the hoisting/lowering drum 51 via sheaves 42, 42*a*, 42*c* and a movable pulley 47, while the wire rope 44*b* is wound round the hoisting/lowering drum 51 via sheaves 43, 43*c*, a movable pulley 46, and a sheave 43*d*. In this case, the wire ropes 44*a*, 44*b* are wound round the hoisting/lowering drum 51 in the same direction. As a result of the rotational driving of the hoisting/lowering drum 51, the wire ropes 44*a*, 44*b* are simultaneously taken up or paid out, so that the hoisting accessory 14 is moved upward or downward (hoisted or lowered).

The movable pulley 46 is connected to a wire rope 49*c*, this wire rope 49*c* is wound round a traversing drum 40 via a sheave 50*a*, and a wire rope 49*d* is wound round the traversing drum 40 via a sheave 50*b*. In this case, the wire ropes 49*c*, 49*d* are wound round the traversing drum 40 in opposite directions. When the wire rope 49*c* or 49*d* is taken up, the wire rope 49*d* or 49*c* is paid out, whereupon the hoisting accessory 14 is caused to traverse via the movable pulleys 46, 47.

Figure 14:
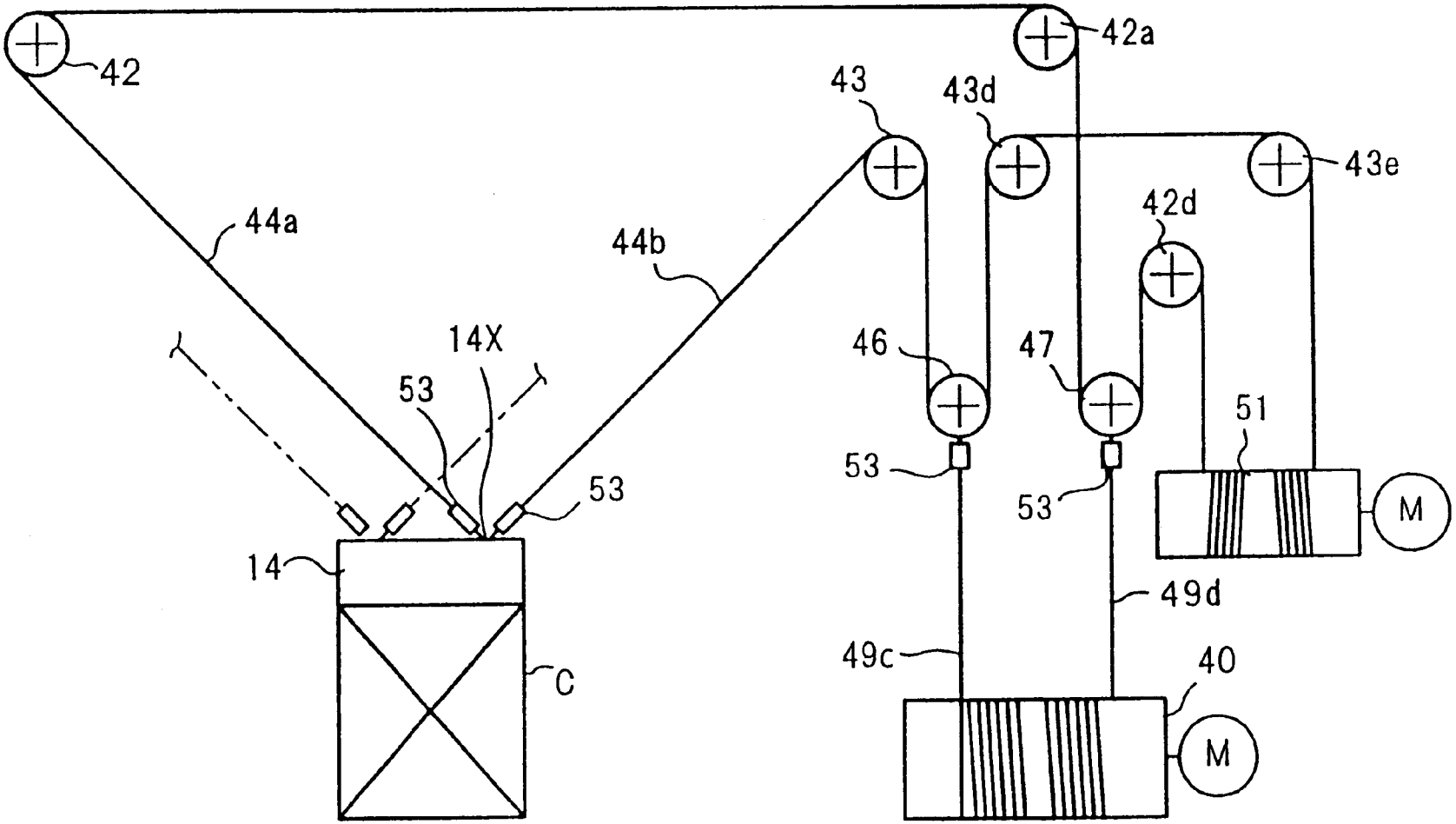
FIG. 14 is a concrete schematic view of the sixth embodiment shown in FIG. 13(*a*)

FIG. 14 shows an even more concrete form of the constitution shown in FIG. 13(*a*). Compared with FIG. 13(*a*), FIG. 14 illustrates a concrete structure in which the connection point 14X and the wire ropes 44*a*, 44*b* are connected together by turnbuckles 53, the movable pulleys 46, 47 and the wire ropes 49*c*, 49*d* are connected together by turnbuckles 53, and the arrangement of the sheaves is slightly changed. As indicated in FIG. 14, the hoisting accessory 14 and a suspended load C are moved upward or downward by rotationally driving the hoisting/lowering drum 51, while the hoisting accessory 14 and the suspended load C are allowed to traverse by the upward or downward movement of the movable pulleys 46, 47 due to the rotational driving of the traversing drum 40. On this traversing drum 40 as well, counteracting forces act, since the wire ropes 49*c*, 49*d* are wound round it in opposite directions.

FIG. 13(*b*) shows a modification of FIG. 13(*a*) illustrating the sixth embodiment. A wire rope 44*a* connected to a hoisting accessory 14 is wound round a hoisting/lowering drum 51 via a sheave 42, a movable pulley 47, and a sheave 42d, while a wire rope 44*b* connected to the hoisting accessory 14 is wound round the hoisting/lowering drum 51 via a sheave 43, amovable pulley 46, and a sheave 43*d*. In this case, the wire ropes 44*a*, 44*b* are wound round the hoisting/lowering drum 51 in the same direction. The wire ropes 44*a*, 44*b* are simultaneously taken up or paid out by rotational driving to hoist or lower the hoisting accessory 14.

Wire ropes 49*c*, 49*d* connected to the movable pulleys 46, 47 are wound round a traversing drum 40 in opposite directions. Thus, the wire rope 49*c* or 49*d* is taken up or paid out by rotational driving of the traversing drum 40, whereupon the hoisting accessory 14 traverses in the right-and-left direction.

In the sixth embodiment shown in FIG. 13(*a*), the traversing drum 40, the hoisting/lowering drum 51, and the movable pulleys 46, 47 are arranged in a concentrated manner on the right-hand side of the body frames. In FIG. 13(*b*), by contrast, these members are provided on the body frames to constitute an upper installation mode with the movable pulleys moved.

FIG. 13(*c*) shows a seventh embodiment. In FIG. 13(*c*), a wire rope 44*a* connected to a turnbuckle at a connection point 14X on a hoisting accessory 14 is wound round a hoisting/lowering drum 51 via sheaves 42, 42*a*. A wire rope 44*b* is wound round the hoisting/lowering drum 51 via sheaves 43, 43*c*. Since the wire ropes 44*a*, 44*b* are wound round the hoisting/lowering drum 51 in the same direction, the rotational driving of the hoisting/lowering drum 51 results in simultaneous takeup or payoff of the wire ropes 44*a*, 44*b*, whereupon the hoisting accessory is moved upward or downward. The hoisting/lowering drum 51 is directly connected to a wire rope 49 looped between a traversing drum 40 and a sheave 51*a*. When the wire rope 49 is moved upon rotational driving of the traversing drum 40, the hoisting/lowering drum 51 is moved upward or downward as a whole. As a result, traversal of the hoisting accessory 14 in the right-and-left direction is carried out.

In this seventh embodiment, the hoisting/lowering drum 51 and the traversing drum 40 are gathered on the right side the body frames to constitute a lateral installation mode with the drums directly driven.

FIG. 13(*d*) shows a modification of the seventh embodiment. Wire ropes 44*a*, 44*b* connected to a hoisting accessory 14 are wound round a hoisting/lowering drum 51 in the same direction via sheaves 42, 43. Thus, the hoisting accessory 14 is hoisted or lowered by rotational driving of the hoisting/lowering drum 51.

The hoisting/lowering drum 51 is also directly connected to a wire rope 49 looped between a traversing drum 40 and a sheave 51*a*. Thus, when the traversing drum 40 is rotationally driven, the hoisting/lowering drum 51 as a whole is moved rightward or leftward. As the wire ropes 44*a* and 44*b* move accordingly, the hoisting accessory 14 is also moved.

In this case, the hoisting/lowering drum 51 and the traversing drum 40 are positioned on the body frames to constitute an upper installation mode with the drums directly driven.

In these sixth and seventh embodiments adopting a loop mode involving a hoisting/lowering drum shown in FIGS. 13(*a*), 13(*b*), 13(*c*), 13(*d*), the wire ropes 44*a*, 44*b* are stretched obliquely upwardly relative to the hoisting accessory 14. Thus, anti-sway becomes possible, and the coordination between the traversing drum 40 and the hoisting/lowering drum 51 can smooth the movement of the hoisting accessory 14. Besides, the weight of the hoisting accessory 14 and a suspended load (not shown) is supported by the traversing drum 40 and the hoisting/lowering drum 51. In FIGS. 13(*a*) and 13(*b*), moreover, forces act on the traversing drum 40 via movable pulleys in directions in which the tensions of the wire ropes 44*a*, 44*b* are counteracted. Thus, the volume of the traversing drum 40 can be decreased.

In the foregoing fourth, fifth, sixth and seventh embodiments and their modifications that are shown in FIGS. 12 to 14, the hoisting accessory 14 has been described in connection with single connection point 14X. However, the locations and the number of the connection points on the hoisting accessory 14 have already been stated in regard to the container hoisting accessory having connection points at the four corners (see FIG. 6). Actually, therefore, four of the structures of FIGS. 12(*a*) to 12(*d*), 13(*a*) to 13(*d*) and 14 are required in agreement with the number of the connection points. Depending on the type, etc. of the suspended load, moreover, various modes can be chosen, such as provision of a single, two or three connection points, or where necessary, the examples illustrated in FIG. 7. When three or more connection points are to be provided on the hoisting accessory, not only anti-sway, but also posture control can be effected, as stated previously.

There may be a case in which the connection points exist at a plurality of positions on the hoisting accessory 14 in such a manner as to be displaced in the width direction of the hoisting accessory. In this case, in addition to the sheaves 42, 43 on the side beams (not shown in FIGS. 12(*a*) to 12(*d*), 13(*a*) to 13(*d*), and 14) of the body frames, sheaves are provided for making the wire ropes from the sheave to the connection point on the hoisting accessory parallel to each other, as shown in FIG. 8. By this measure, the posture of the hoisting accessory 14, accordingly the posture of the suspended load, can be always made constant in the horizontal direction. This constitution is applicable in any of the embodiments in FIGS. 12(*a*) to 12(*d*), 13(*a*) to 13(*d*), and 14, if the connection points are present at a plurality of positions in the width direction of the hoisting accessory.

Figure 15:
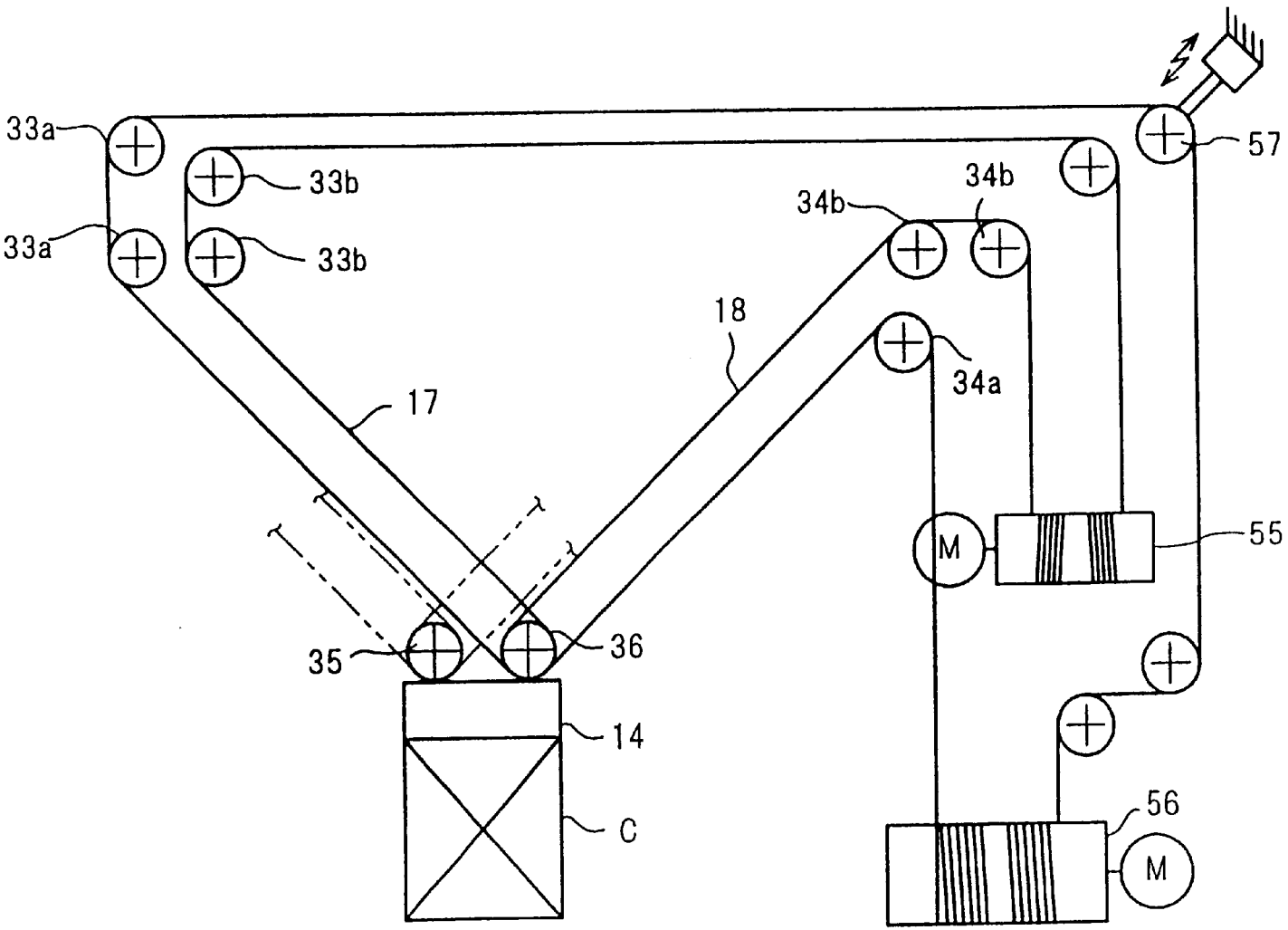
FIG. 15 is a schematic view of an eighth embodiment of the present invention.
Figure 16:
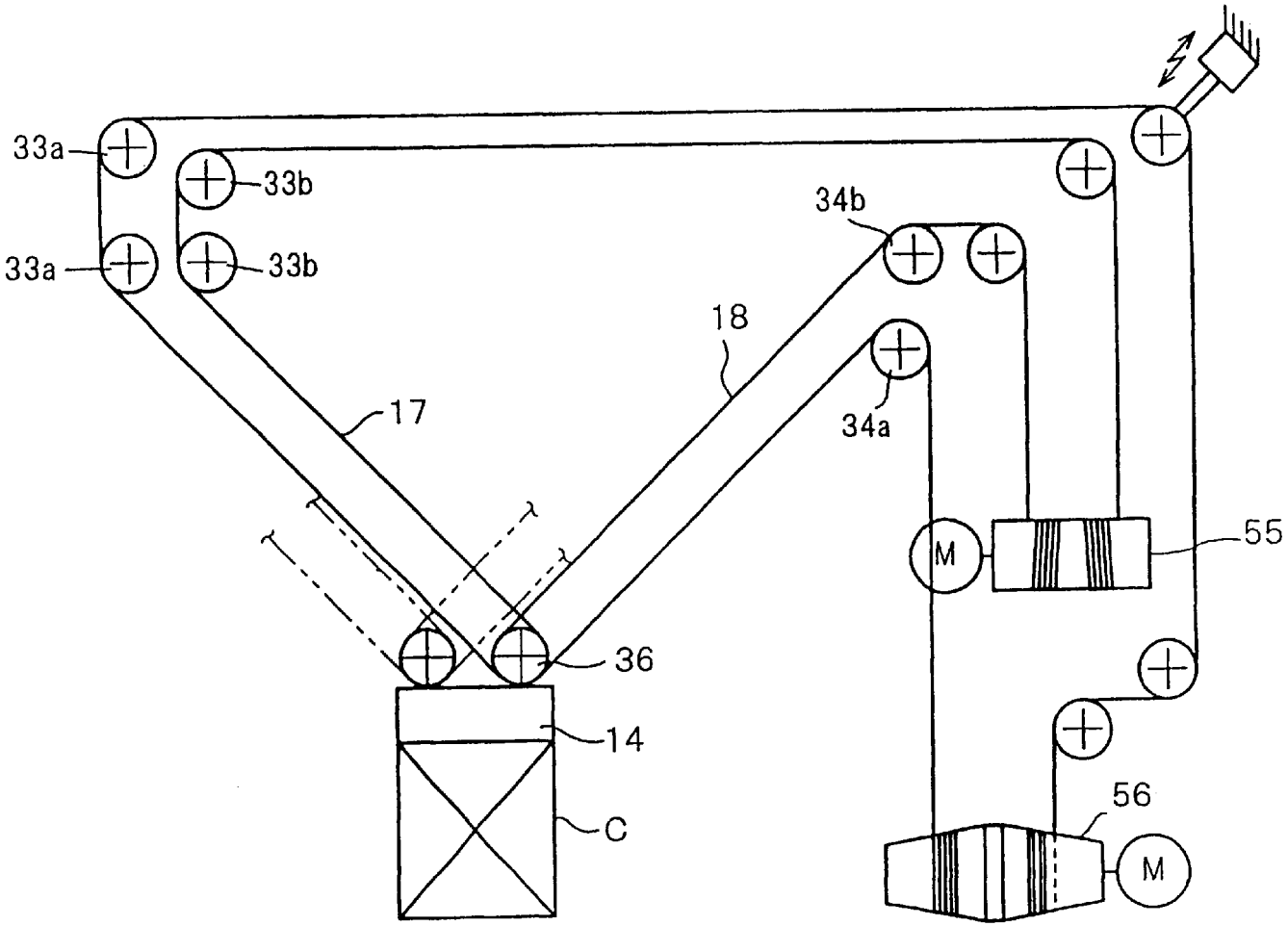
FIG. 16 is a schematic view of a modification of FIG. 15.

FIGS. 12(*a*) to 12(*d*), 13(*a*) to 13(*d*), and 14 have illustrated a total of eight examples, i.e., four embodiments and their modifications. Here, a description has been offered of a loop mode in which a wire rope is routed in a loop form between the same drums and a hoisting accessory, specifically, two types of loop mode, i.e., a traversing drum loop mode, and a hoisting/lowering drum loop mode. An embodiment in which sheaves are arranged at connection points on a hoisting accessory 14 as shown already in FIGS. 10 and 11 will now be described in FIGS. 15 and 16. This embodiment has been modified to form a loop mode, although not a complete loop mode, namely, a loop mode using the same drums. In FIGS. 15 and 16, two drums, i.e., a forward winding drum 55 and a reverse winding drum 56, are arranged. For example, one end of a wire rope 18 to be passed over a sheave 36 on a hoisting accessory 14 is wound round the forward winding drum 55, while the other end of the wire rope 18 is wound round the reverse winding drum 56.

FIG. 15 shows a constitution related to the sheave 36 located at the right front among the sheaves present at four sites, i.e., at the front, back, right and left, on the hoisting accessory 14. The sheave 36 at the right front side is composed of two individually rotating sheaves. The wire rope 18 passed over one of the sheaves is passed over sheaves 34*a*, 34*b*, and is wound at one end round the forward winding drum 55, and at the other end round the reverse winding drum 56.

A wire rope 17 passed over the other sheave of the sheave 36 is passed over sheaves 33*a*, 33*b*, and is wound at one end round the forward winding drum 55 via an initial length adjusting sheave 57, and at the other end round the reverse winding drum 56 via an initial length adjusting sheave 57.

Hence, when the forward winding drum 55 is rotationally driven, one end of each of the wire ropes 17, 18 are simultaneously taken up or paid out. When the reverse winding drum 56 is rotationally driven, on the other hand, the wire rope 18 is paid out if the other end of the wire rope 17 is taken up, or the wire rope 17 is paid out if the other end of the wire rope 18 is taken up.

Consequently, the suspended load can be hoisted or lowered in an up-and-down direction by rotationally driving the forward winding drum 55, while the suspended load can be caused to traverse in a right-and-left direction by rotationally driving the reverse winding drum 56.

With the above structure of FIG. 15, anti-sway of the hoisting accessory 14 can be achieved by pulling the wire ropes 17, 18 obliquely upwardly, and the posture of the hoisting accessory 14 can also be kept depending on the number of the sheaves on the hoisting accessory 14. The weight of the hoisting accessory 14 and a suspended load C is always shared between the forward winding drum 55 and the reverse winding drum 56. When the suspended load C is to be hoisted or lowered, the two wire ropes 17, 18 are actuated by the drum 55 and/or the drum 56. Thus, no matter what position the suspended load C is located at, the total power of the drums 55 and 56 is always constant, and can be used efficiently, so that the capacity of motors M can be decreased.

The reverse winding drum 56 mainly in charge of a traversing action is subjected to forces, which rotate in opposite directions, by the two wire ropes 17, 18. Thus, the tensions of the wire ropes 17 and 18 are offset, and only the moment due to their difference acts on the drum. Consequently, the capacity of the motor can be reduced.

The embodiment illustrated in FIG. 15 shows the sheaves disposed on the hoisting accessory 14, and the forward winding drum 55 and the reverse winding drum 56 arranged in the crane system. These drums 55 and 56 are concentrated on the left side of the body frames, constituting a so-called lateral installation mode. However, the drums 55, 56 and the wire ropes 17, 18 may be routed on the body frames to constitute a so-called upper installation mode.

The sheaves 35, 36 on the hoisting accessory 14 have been described as being provided at four sites. Depending on the suspended load, an embodiment as in FIG. 7 in which the number of the sites for provision of the sheaves is one, two, three, or else can be applied, as in the cases of FIGS. 12(*a*) to 12(*d*) and 13(*a*) to 13(*d*).

Further, the positions of the sheaves 34*a*, 34*b* and 33*a*, 33*b* located obliquely upwardly of the sheave positions on the hoisting accessory 14 are displaced to make the wire ropes stretched for the respective sheaves on the hoisting accessory 14 parallel to each other. By so doing, it becomes possible to keep the posture of the hoisting accessory in the same manner as in FIG. 10.

FIG. 16 shows a modification of FIG. 15. The modified embodiment of FIG. 16 differs from the embodiment of FIG. 15 in that the diameter of the reverse winding drum 56 is changed. That is, the reverse winding drum 56 mainly performs a traversing operation, and when rotationally driven, it takes up one of the two wire ropes 17 and 18, and pays out the other wire rope. In this case, so as to minimize a moment due to the difference between the tension of the wire rope 17 and the tension of the wire rope 18 acting on the reverse winding drum 56, the drum diameter on the side wound with the wire rope having the higher tension of the wire ropes 17, 18 is made smaller, while the drum diameter on the side wound with the wire rope having the lower tension is made larger. That is, when the hoisting accessory 14 is present at the center in the right-and-left direction of the body frames, the same amount of load is imposed on the wire ropes 17, 18 of the reverse winding drum 56. However, when the hoisting accessory 14 is located closer to the right side, a larger amount of load acts on the wire rope 18 than on the wire rope 17. If, at this time, the drum diameter on the side wound with the wire rope 18 is smaller, torque on the reverse winding drum 56 becomes that smaller. By thus making the winding diameter of the wire rope 17 relatively large, the imbalance between the moments of the forces imposed on the reverse winding drum 56 by the wire ropes 17 and 18 can be corrected.

Thus, the reverse winding drum 56 is shaped in a form inclined and tapered toward both sides as illustrated in FIG. 16. Furthermore, when the hoisting accessory 14 is located at the center in the right-and-left direction of the body frames, the wire ropes 17, 18 are wound at the same corresponding positions on the inclined portions of the drum. From this state, when the hoisting accessory 14 leans rightward, the wire rope 18 is wound in the direction in which the winding diameter decreases, while the wire rope 17 is paid out in the direction in which the winding diameter increases. When the hoisting accessory 14 leans leftward, on the other hand, the wire rope 18 is paid out in the direction in which the winding diameter increases, while the wire rope 17 is wound in the direction in which the winding diameter decreases.

In this manner, the shape of the reverse winding drum 56, the direction of winding onto the drum, and the direction of paying out from the drum are determined. By this measure, the load imposed on the reverse winding drum 56 can be uniformed. Even if the suspended load C and the hoisting accessory 14 lean leftward or rightward, torques acting on the reverse winding drum 56 can be counteracted.

The shape of the reverse winding drum 56, the direction of winding onto the drum, and the direction of paying out from the drum, stated about FIG. 16, can be applied to the traversing drum 40 shown in FIGS. 12, 13 and 14. By so doing, when the hoisting accessory 14 and the suspended load lean leftward or rightward, the difference in the loads of the wire ropes 44*a*, 44*b* imposed on the traversing drum 40 can be minimized or eliminated.

The embodiments provided with the plural sheaves on the hoisting accessory 14 in FIGS. 15 and 16 have been described with regard to the sheave 36. The same constitution is required for other sheaves, e.g., the sheave 35. In this case, if the sheaves on the hoisting accessory 14 are displaced in the width direction of the hoisting accessory 14, such as the sheaves 35 and 36, the mounting positions of the sheaves 33*a*, 33*b* and 34*a*, 34*b* provided on the body frames in correspondence with the displacements in the width direction of the hoisting accessory 14 are protruded like the positions of the sheaves 30 and 31 relative to the sheaves 33 and 34 in FIG. 10. By this measure, the wire ropes 17, 18 can be made parallel. Alternatively, sheaves for position adjustment may be provided separately, such as the sheaves 30 and 31 in FIG. 10. By so doing, even if the positions of the sheaves on the hoisting accessory 14 change, all the wire ropes 17, 18 become parallel, so that the posture of the hoisting accessory 14 can be effectively kept.

In the foregoing explanations, the traversing drum 40 and the hoisting/lowering drum 51 have been provided separately for the fourth and fifth embodiments and their modifications shown in FIGS. 12(*a*) to 12(*d*), and for the sixth and seventh embodiments and their modifications shown in FIGS. 13 and 14. Also, the forward winding drum 55 and the reverse winding drum 56 have been provided separately for the eighth embodiment and its modification shown in FIGS. 15 and 16.

The inventors have added further improvement to the drums. That is, an improvement has been made such that the traversing drum 40 and the hoisting/lowering drum 51, or the forward winding drum 55 and the reverse winding drum 56 in the previous embodiments are integrated.

Figure 17:
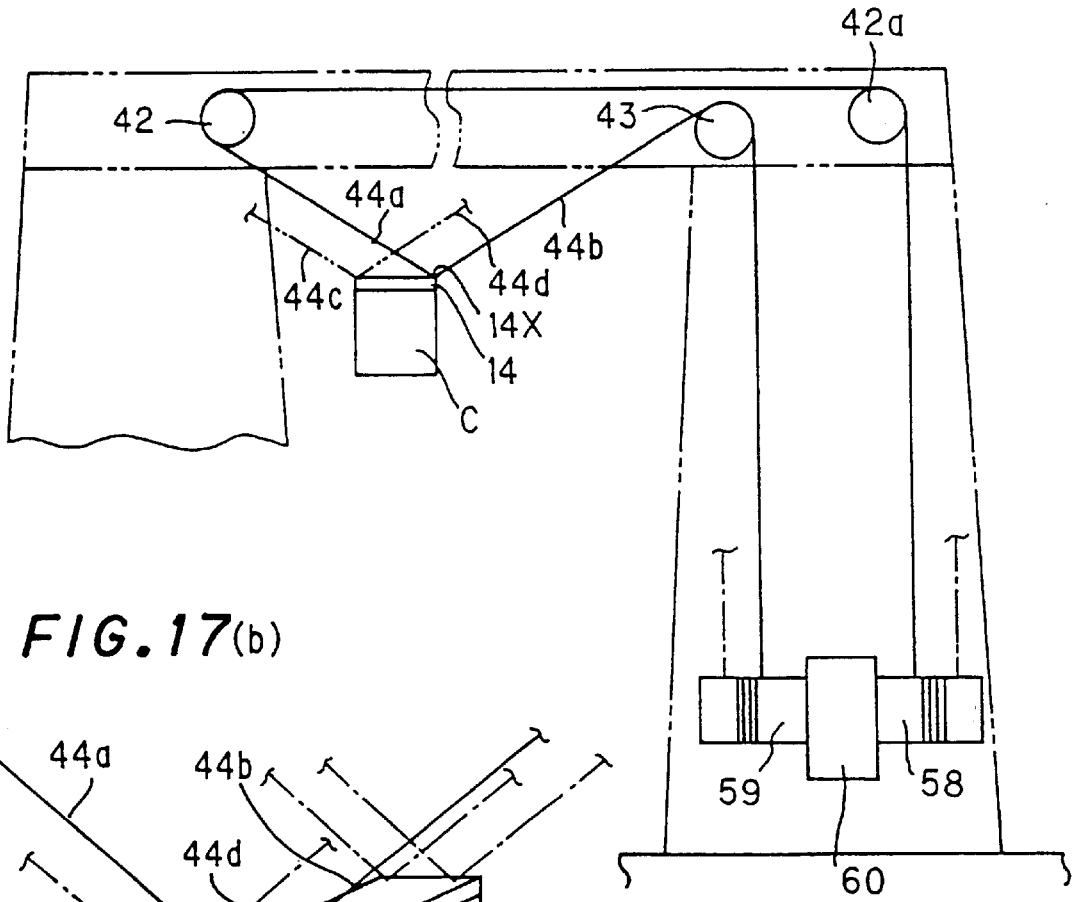
FIGS. 17(*a*) and 17(*b*) are explanation drawings for an integral type drum.
Figure 17:
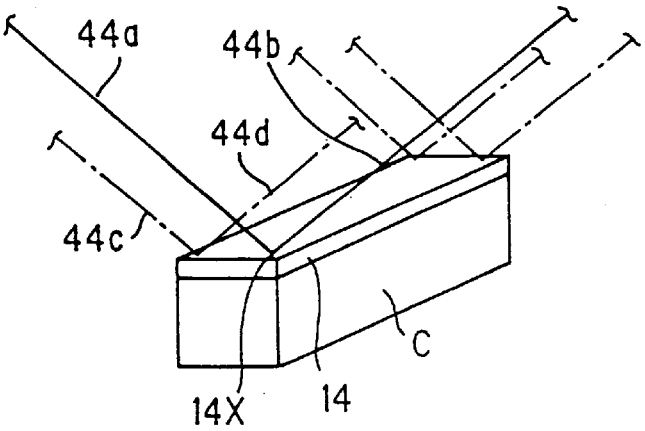

FIGS. 17(*a*) and 17(*b*) mainly show this improved integral type drum, and its drive portion. In FIGS. 17(*a*) and 17(*b*), if the same numerals and symbols as in FIG. 12 are used, a connection point 14X on a hoisting accessory 14 where a suspended load C is attached is connected to wire ropes 44*a*, 44*b* by turnbuckles. The wire rope 44*a* is wound round a right drum 58 via sheaves 42, 42*a*, while the wire rope 44*b* is wound round a left drum 59 via a sheave 43. The right drum 58 and the left drum 59 are provided with a rotation control device 60. The hoisting accessory 14 has the connection points at the four corners as shown in FIG. 17(*b*), and has a constitution shown in FIG. 17(*a*) adapted to the respective connection points.

Figure 18:
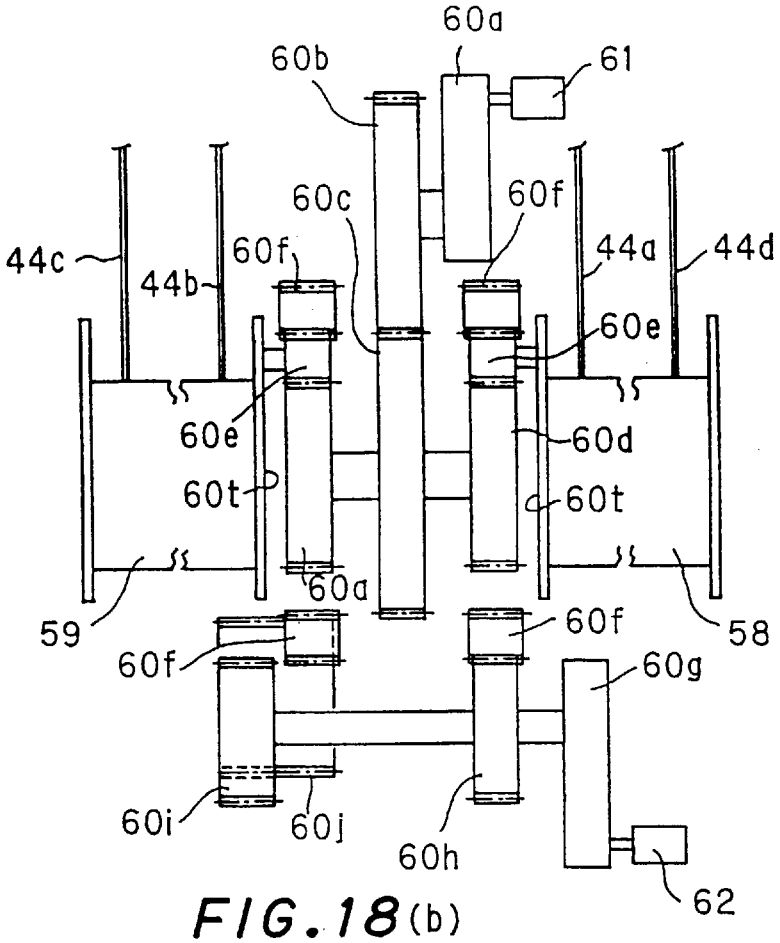
FIGS. 18(*a*) to 18(*c*) are constitution drawings of an example of a rotation control device shown in FIG. 17.
Figure 18:
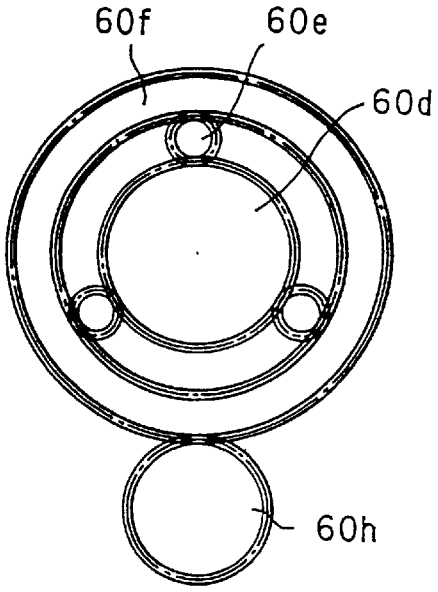
Figure 18:
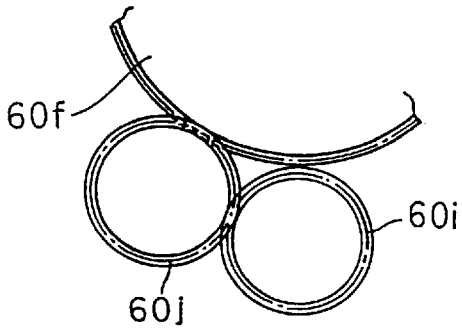
Figure 19A:
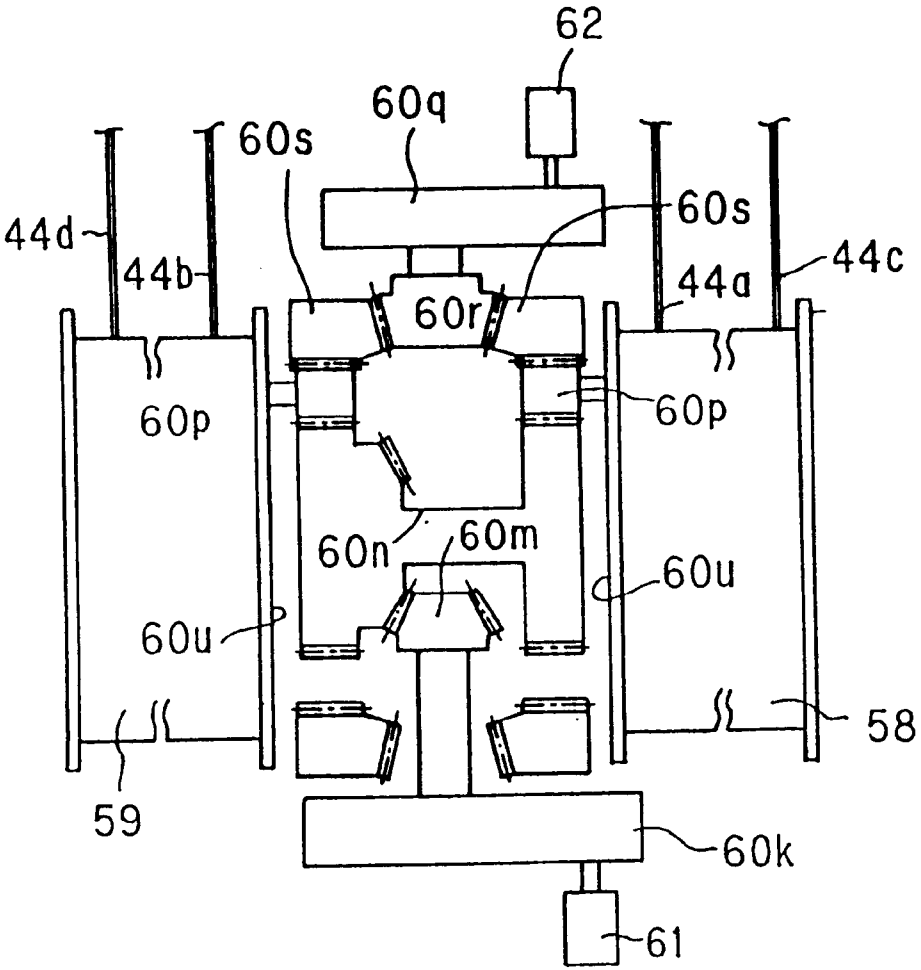
FIGS. 19(*a*) and 19(*b*) are constitution drawings of another example of the rotation control device.
Figure 19B:
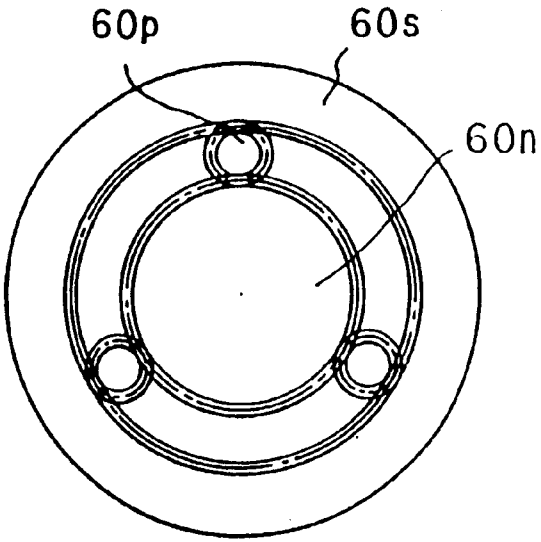

The concrete constitutions of the left drum 59, the rotation control device 60, and the right drum 58 are as illustrated in FIGS. 18(*a*) to 18(*c*) and FIGS. 19(*a*) and 19(*b*). FIGS. 18(*a*) to 18(*c*) show the rotation control device 60 using spur gears, which has a hoisting/lowering motor 61 for hoisting or lowering the right drum 58 and the left drum 59, and a traversing motor 62 for causing the right drum 58 and the left drum S9 to traverse. The hoisting/lowering motor 61 drives right and left planet gears 60e via a reduction gear 60*a*, spur gears 60*b*, 60*c*, and right and left sun gears 60*d*. These right and left planet gears 60*e* are connected to the right drum 58 and the left drum 59, respectively. The traversing motor 62 drives a right internal gear 60*f* via a reduction gear 60*g* and a spur gear 60*h*, and drives a left internal gear 60*f* via a spur gear 60*i* connected to the spur gear 60*h*, and a gear 60*j* .

According to the above constitution, the rotation of the hoisting/lowering motor 61 is transmitted from its input shaft to the sun gears 60*d* via the reduction gear 60*a*, the gears 60*b*, 60*c*, and the rotating shaft to rotate the right and left drums 58 and 59 simultaneously in the same direction. The rotation of the traversing motor 62 is transmitted from its input shaft to the right internal gear 60*f* via the reduction gear 60*g*, and the gear 60*h* to rotate the right drum 58. Simultaneously, the rotation of the traversing motor 62 is transmitted from the input shaft to the left internal gear 60*f* via the gears 60*i* and 60*j* to rotate the left drum 59 in the direction opposite to the direction of the right drum 58.

FIGS. 19(*a*) and 19(*b*) show a rotation control device 60 using bevel gears. That is, a hoisting/lowering motor 61 and a traversing motor 62 are disposed. The hoisting/lowering motor 61 drives a sun gear 60*n*, integrally formed from right and left parts, via a reduction gear 60*k* and a bevel gear 60*m*, to rotationally drive a right drum 58 and a left drum 59 simultaneously in a circumferential direction via right and left planet gears 60*p*. The traversing motor 62 drives right and left internal gears 60*s* via a reduction gear 60*q* and a bevel gear 60*r*, to rotationally drive the right drum 58 and the left drum 59 simultaneously in opposite directions via the right and left planet gears 60*p*.

In the examples shown in FIGS. 18(*a*) to 18(*c*) and 19(*a*) and 19(*b*), the planet gears 60*e*, 60*p* are disposed on an output shaft side, but may be disposed on an input shaft side. In either case, any of the sun gears 60*d*, 60*n*, the internal gears 60*f*, 60*s*, and carriers (60*t*, 60*u* in the drawings) which support the planet gears 60*e*, 60*p* may be connected to the input shaft or the output shaft.

The movement of a suspended load will be described in regard to such an integral type drum and the drive parts therefor. When a load C laid on the ground is to be lifted, or when the load C is to be landed, the hoisting/lowering motor 61 of the rotation control device 60 is driven. Then, the left and right drums 59 and 58 are simultaneously rotated in the same direction via the reduction gears to wind up or wind down the load C via the wire ropes 44*a*, 44*b*, thereby performing a predetermined operation. Even when the load C leans toward either leg, the load C is hoisted or lowered by the hoisting/lowering motor 61. In this case, however, the traversing motor 62 is also driven slightly depending on the degree of leaning of the load C, whereby vertical ascent or descent of the load C is performed. In this manner, the total power consumption of the motors 61, 62 becomes equal regardless of the position of the load C.

When causing the suspended load C to traverse toward the right leg or the left leg, the traversing motor 62 of the rotation control device 60 is driven. Then, the left and right drums 59 and 58 are simultaneously rotated in opposite directions via the reduction gears. For the traversal of the load C toward the right leg, the wire rope 44*b* is taken up, while the wire rope 44*a* is paid out, whereby the load C moves toward the right leg. In this case, the hoisting/lowering motor 61 is also driven slightly depending on the degree of leaning in the traversing direction, whereby traversal in a linear direction is carried out. During this traversing action, the tensions of the wire ropes 44*a*, 44*b* on the drums 58, 59 are counterbalanced by the gear in the rotation control device 60, e.g., the bevel gear 60*r* in FIG. 19. Thus, the motor capacity can be reduced as in the embodiments shown in FIGS. 14 and 15.

In the descriptions offered up to now, the left and right drums 59 and 58 wound with the wire ropes 44*a*, 44*b* connected to the turnbuckles at the single connection point 14X on the hoisting accessory 14 have been mentioned in FIGS. 17(*a*) and 17(*b*), 18(*a*) to 18(*c*), and 19(*a*) and 19(*b*). When there are four connection points at the four corners on the hoisting accessory 14, wire ropes 44*c*, 44*d* at a connection point 14Y adjoining in the width direction can be simultaneously wound round the left and right drums 59 and 58. In this case, sheaves (not shown) for the wire ropes 44*c*, 44*d* need to be mounted such that the wire ropes 44*b* and 44*d*, and the wire ropes 44*a* and 44*c* become parallel to each other.

In this way, the pair of wire ropes 44*a*, 44*b* and the pair of wire ropes 44*c*, 44*d*, stretched from the suspended load C in opposite directions and obliquely upwardly, are connected to the integrated left and right drums 59 and 58, and driven by the single rotation control device. When hoisting or lowering the load C, both drums are rotated simultaneously in the same direction mainly by the hoisting/lowering motor 61. When causing the load to traverse, both drums are rotated simultaneously in opposite directions mainly by the traversing motor 62. Thus, a rational constitution with minimal change in the power consumption of the motor allows a decrease in power as compared with earlier technologies. Moreover, the constitution of the system is also simplified to facilitate operation.

According to the integral type unit composed of the right and left drums and the rotation control device shown in the present embodiment, the single unit can perform hoisting/lowering and traversing at the same time. Thus, in the loop mode systems shown in FIGS. 12(*a*) to 12(*d*), 13(*a*) to 13(*d*) and 14, or modified loop mode systems shown in FIGS. 15 and 16, all the wire ropes 44*b*, 18 stretched obliquely rightwardly upwardly are wound round one of the drums, while all the wire ropes 44*a*, 17 stretched obliquely leftwardly upwardly are wound round the other drum. By this means, a single integral type drum can accomplish the necessary task, regardless of the number of the connection points or the sheaves on the hoisting accessory 14. Furthermore, when the connection points or sheaves are adjacent in the width direction of the hoisting accessory 14 as stated earlier, the wire ropes are made parallel as in FIGS. 8 and 9, whereby the wire ropes engaged with the two adjacent connection points or sheaves, or in some case, the wires ropes engaged with four connection points or sheaves, can be rotationally driven and controlled by a single integral type drum.

The number and locations of the connection points, or the number and locations of sheaves on the hoisting accessory may be applied in various forms to the integral type drum, similar to the descriptions given thus far.

Figure 20:
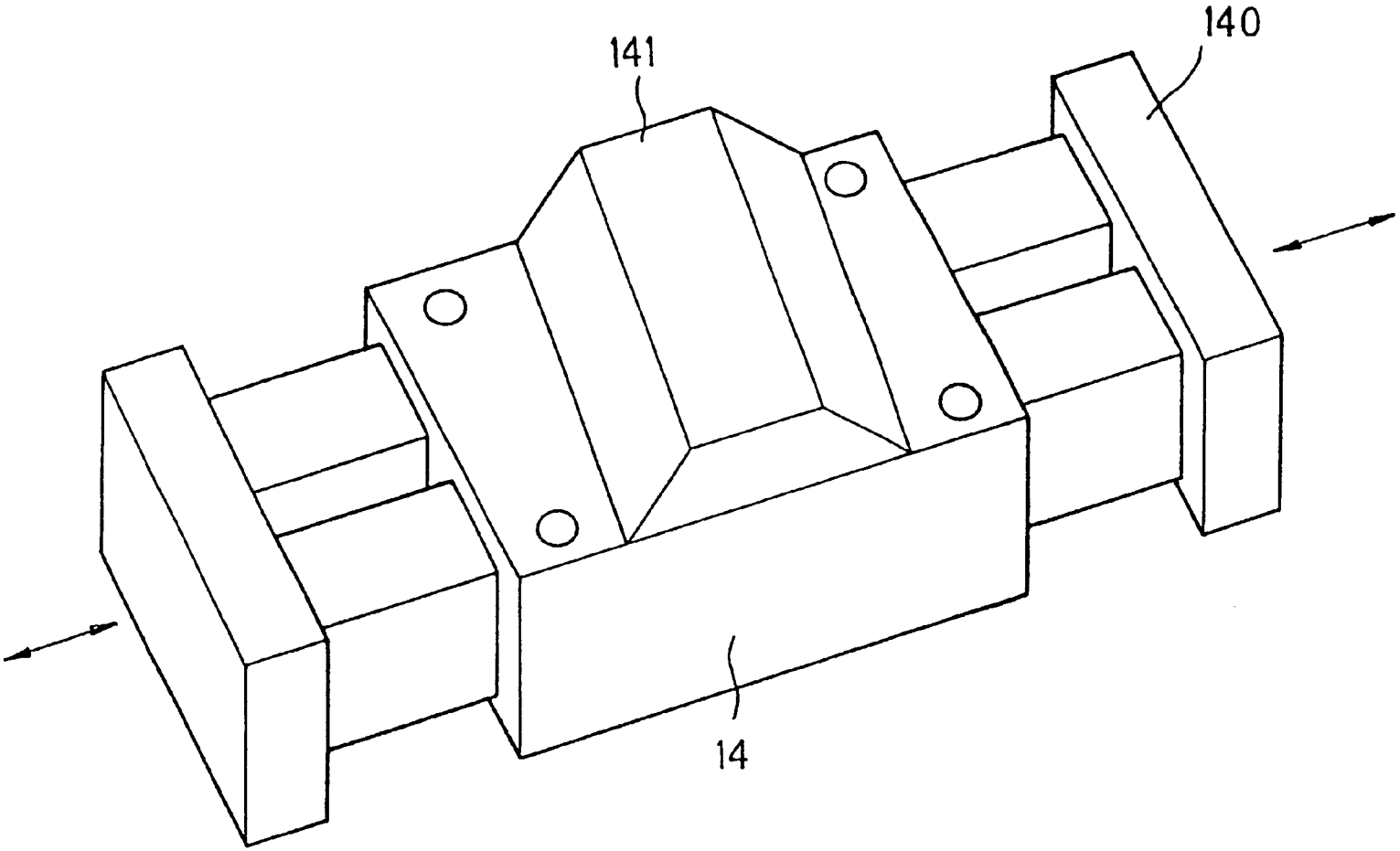
FIG. 20 PRIOR ART
FIG. 20 is a constitution drawing showing a conventional hoisting accessory for a container.

From other points of view, the invention will be disclosed in connection with improvements in the hoisting accessory. When the suspended load in any of the aforementioned crane systems is a container, for example, the container may be in various sizes. Actually, there is a container with a length (depth) of several meters to ten or so meters. Suspending points for the container are corner fittings at the four corners of the container. To attach this container to a hoisting accessory and move it actually, the hoisting accessory needs to be adapted for the size of the container. For this purpose, it has been customary practice to provide a hoisting accessory 14 with an expansion mechanism, as shown in FIG. 20, without changing the positions of the connection points (or the connection points of turnbuckles, or the positions of sheaves, if any), thereby accommodating changes in the size of the container. In this case, the expansion mechanism in FIG. 20 includes an expansible portion 140, and a driving portion 141 for driving the expansible portion 140. The longer the container, the greater moment acts on the hoisting accessory. To withstand the longest and heaviest container, the hoisting accessory should have high rigidity ensuring high strength. The hoisting accessory necessarily becomes heavy, and its weight may be as great as about ⅓ of the weight of the container. Thus, the inventors have applied improvements to the body frames in response to the size of the container, in addition to the aforementioned improvements, such as the routing structure of the wire ropes, the loop mode, and the integral type drum.

Figure 21:
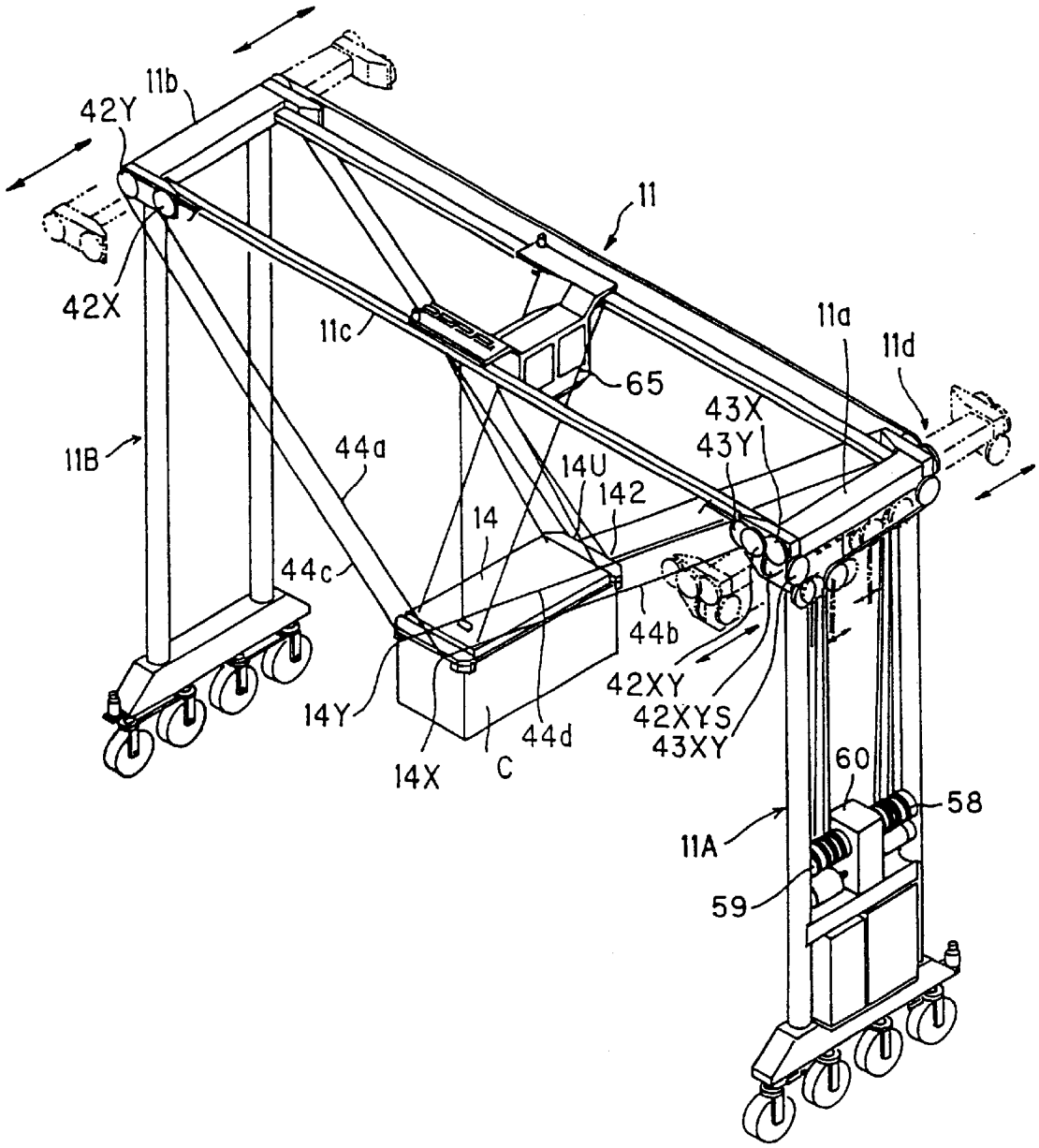
FIG. 21 is a perspective view of a crane system for explaining a size change mechanism.
Figure 22:
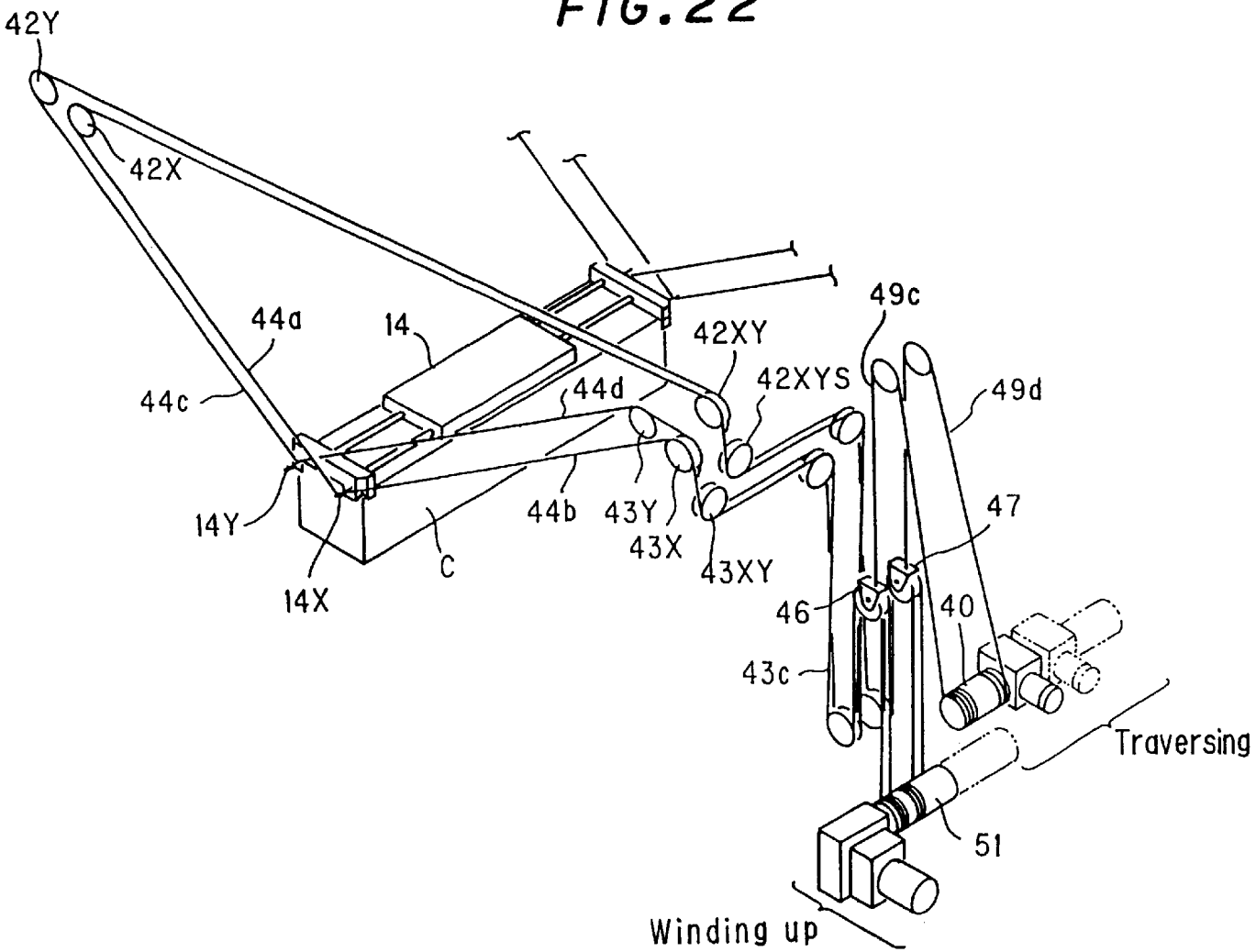
FIG. 22 is a partial exploded constitution drawing for facilitating explanation for FIG. 21.

FIGS. 21 and 22 show a size change mechanism added to the body frames in addition to the expansion mechanism of the hoisting accessory 14 itself shown in FIG. 20. FIG. 21 illustrates an example in which connection points 14X, 14Y, 14Z, 14U are present at four sites on a hoisting accessory 14. On transverse girders 11*c*, sheaves are disposed for parallel routing of wire ropes, and the aforementioned integral type drum mode is adopted.

FIG. 21 exemplifies an entire crane system having a size change mechanism on side beams 11*a*, 11*b* of a body frame 11. In FIG. 21, the body frame 11 includes right and left legs 11A and 11B, transverse girders 11*c* located at upper ends of the legs 11A, 11B and connecting these legs together, side beams 11*a*, 11*b* for connecting the front and rear legs 11A and 11B, and an operating room 65 mounted like a bridge between the front and rear transverse girders 11*c*. The right and left side beams 11*a* and 11*b* that connect the front and rear legs 11A and 11B are each provided with an expansion mechanism 11*d* which extends and contracts on both sides in a front-and-back direction (in the depth direction). On the side of the expansion mechanism 11*d*, sheaves are provided which are engaged with wire ropes routed in obliquely upper right and upper left directions from the connection points 14X, 14Y, 14Z, 14U fixed to the hoisting accessory 14.

In this case, the expansion mechanism 11*d* has a structure in which straight shafts coaxial with the side beams 11*a*, 11*b* extend from and contract into the side beams 11*a*, 11*b* serving, for example, as sleeves. The expansion and contraction is performed by a driving portion (not shown) which includes a motor and a speed reduction portion. The straight shafts that extend and contract are enough rigid to support the container C and the hoisting accessory 14 portably, and are heavy materials. These straight shafts are usually supported by the legs 11A, 11B, and are not always portably moved, unlike the hoisting accessory. Furthermore, the side beams 11*a*, 11*b* require only the addition of comparable structures as the straight shafts in terms of space. Thus, the straight shafts are useful from various aspects.

The sheaves disposed on the side of the expansion mechanism 11*d* will be described, for example, in connection with the connection points 14X, 14Y on the front side (forward side) of the hoisting accessory 14. Wire ropes 44*a*, 44*c* routed parallel in an upper left direction from the connection points 14X, 14Y arrive at sheaves 42X, 42Y of the expansion mechanism 11*d* of the left side beam 11*b*, and are then passed over a sheave 42XY of the expansion mechanism 11*d* of the right side beam 11*a*. Then, the wire ropes 44*a*, 44*c* are changed in direction by a sheave 42XYS, and further wound round a left drum 58 of an integral type drum.

On the other hand, wire ropes 44*b*, 44*d* routed parallel in an upper right direction from the connection points 14X, 14Y are passed over sheaves 43Y, 43X of the expansion mechanism 11*d* of the right side beam 11*b*, changed in direction by a sheave 43XY, and wound round a right drum 59 of an integral type drum.

Thus, the drum constitution in this case is such that the drums 28, 27 in the second embodiment shown in FIGS. 8 and 9 are formed into an integral type drum, with the left drum 27 being disposed on the right, and having the wire rope passed round these drums. In this manner, the left drum 59 and the right drum 58 in FIG. 21 take up or pay out the wire ropes simultaneously in the same direction to carry out vertical hoisting or lowering. When one of these drums takes up the wire rope, and the other drum pays out the wire rope in the reverse direction, traversing is performed.

When a container longer than the container C shown in FIG. 21 is to be moved, a connecting portion of the hoisting accessory 14 extends in agreement with the increased length. Responsive to the extension of the hoisting accessory 14, the straight shafts of the expansion mechanisms 11*d* on the side beams 11*a*, 11*b* are expanded, whereupon the sheaves 42X, 42Y, and the group of sheaves 42XY, 42XYS, 43X, 43Y, 43XY are together expanded in the front-and-back direction.

The hoisting accessory 14 has the suspending points and the connection points for the container C positioned in proximity to each other, and these points integrally extend or contract. Thus, moment due to the suspended weight minimally acts on the hoisting accessory 14. Consequently, the necessary rigidity for the hoisting accessory 14 may be the one enough to position the points of expansion and contraction. This leads to a marked decrease in weight.

FIG. 22 clarifies the sheave arrangement of the size change mechanism in connection with the routing of wire ropes and the drum constitution of the sixth embodiment shown in FIGS. 13(*a*) to 13(*d*) and 14. Parallel wire ropes 44*a*, 44*c* stretched leftwardly upwardly from connection points 14X, 14Y are passed over sheaves 42X, 42Y of an expansion mechanism of a left side beam, and then passed over sheaves 42XY, 42XYS of an expansion mechanism of a right side beam. Then, the wire ropes 44*a*, 44*c* are passed over a movable pulley 47, and wound round a hoisting/lowering drum 51. On the other hand, parallel wire ropes 44*d*, 44*b* stretched rightwardly upwardly from the connection points 14X, 14Y are passed over sheaves 43X, 43Y, 43XY of an expansion mechanism of a right side beam, engaged over a movable pulley 46, and wound round the hoisting/lowering drum 51.

Wire ropes 49*c*, 49*d* of the movable pulleys 46, 47 are wound round a traversing drum 40 in opposite directions.

In this case, too, as part of the size change mechanism, the sheaves 42X, 42Y are mounted on a side portion of a left expansion mechanism 11*d*, and the group of sheaves 42XY, 42XYS, 43X, 43Y, 43XY are mounted on a side portion of a right expansion mechanism 11*d*. In this manner, the sheaves of the expansion mechanisms are arranged so as to be movable, as a single unit, in the front-and-back direction in collaboration with the hoisting accessory 14 in agreement with the length of the container C.

By so constructing the size change mechanism shown in FIGS. 21 and 22, it becomes unnecessary to consider the necessity for the rigidity enough to withstand the moment due to the great weight of the hoisting accessory. A lightweight, simple hoisting accessory suffices. The light weight of the hoisting accessory means a reduction in the tension of the wire ropes. Thus, the power of the motor and the rigidity of the body frames can be decreased. Furthermore, the weight of the entire crane can be markedly reduced, and the rigidity of the travel drive system as well as the driving force can be decreased.

The size change mechanism is intended to accommodate dimensional changes in the longitudinal direction of the hoisting accessory 14. Thus, the connection points are needed at least at two sites in the longitudinal direction of the hoisting accessory 14. A constitution, in which only one connection point is present, or the connection points are gathered at one site, is difficult to apply.

In addition to the structure shown in FIGS. 21 and 22 having turnbuckles as the connection points on the hoisting accessory, the size change mechanism of the present embodiment can be applied to a structure having sheaves as the connection points on the hoisting accessory, if these sheaves are present at two sites in the longitudinal direction of the hoisting accessory.

Figure 23:
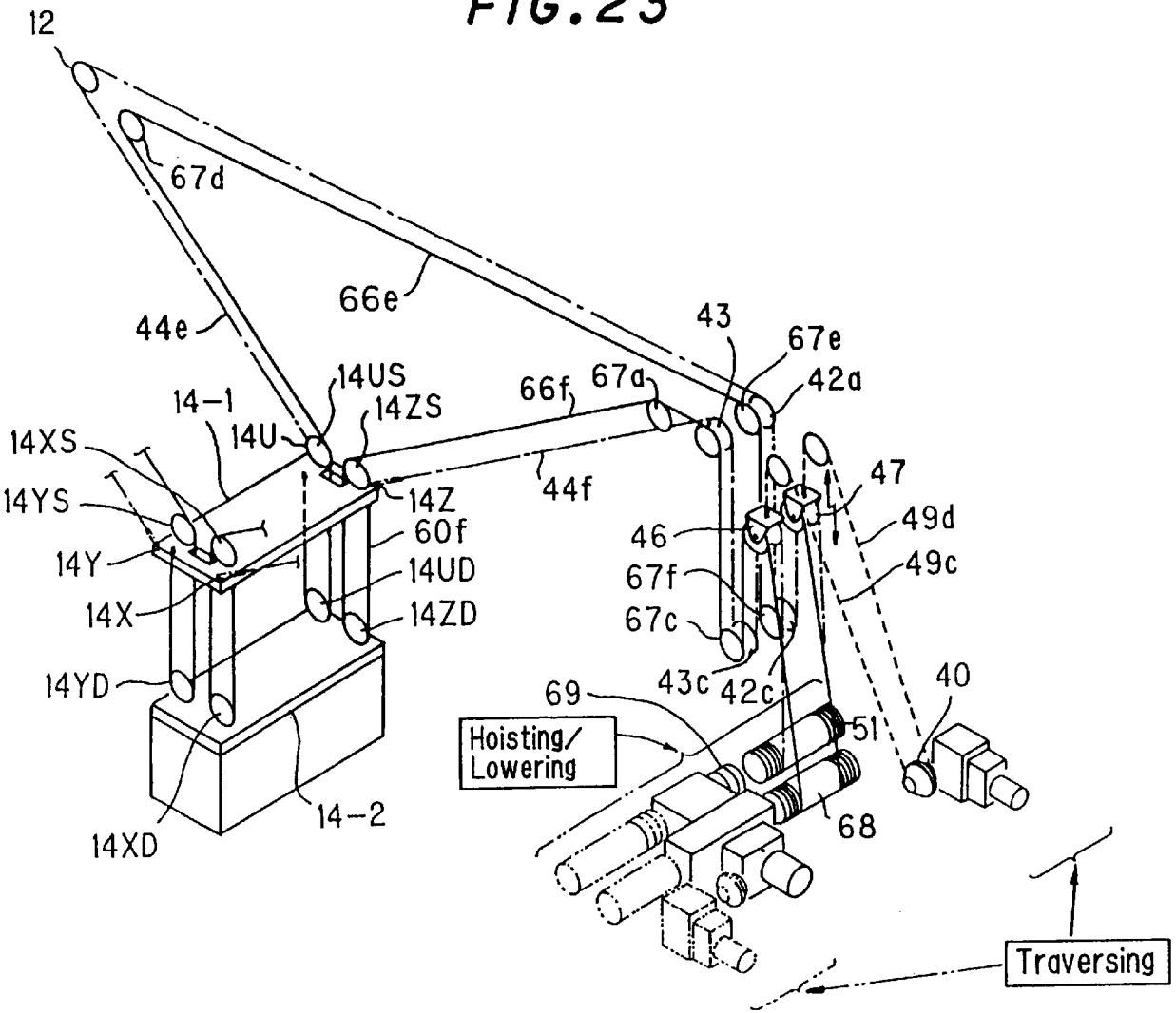
FIG. 23 is a partial perspective view of a crane system for explaining a double hoisting accessory.
Figure 24:
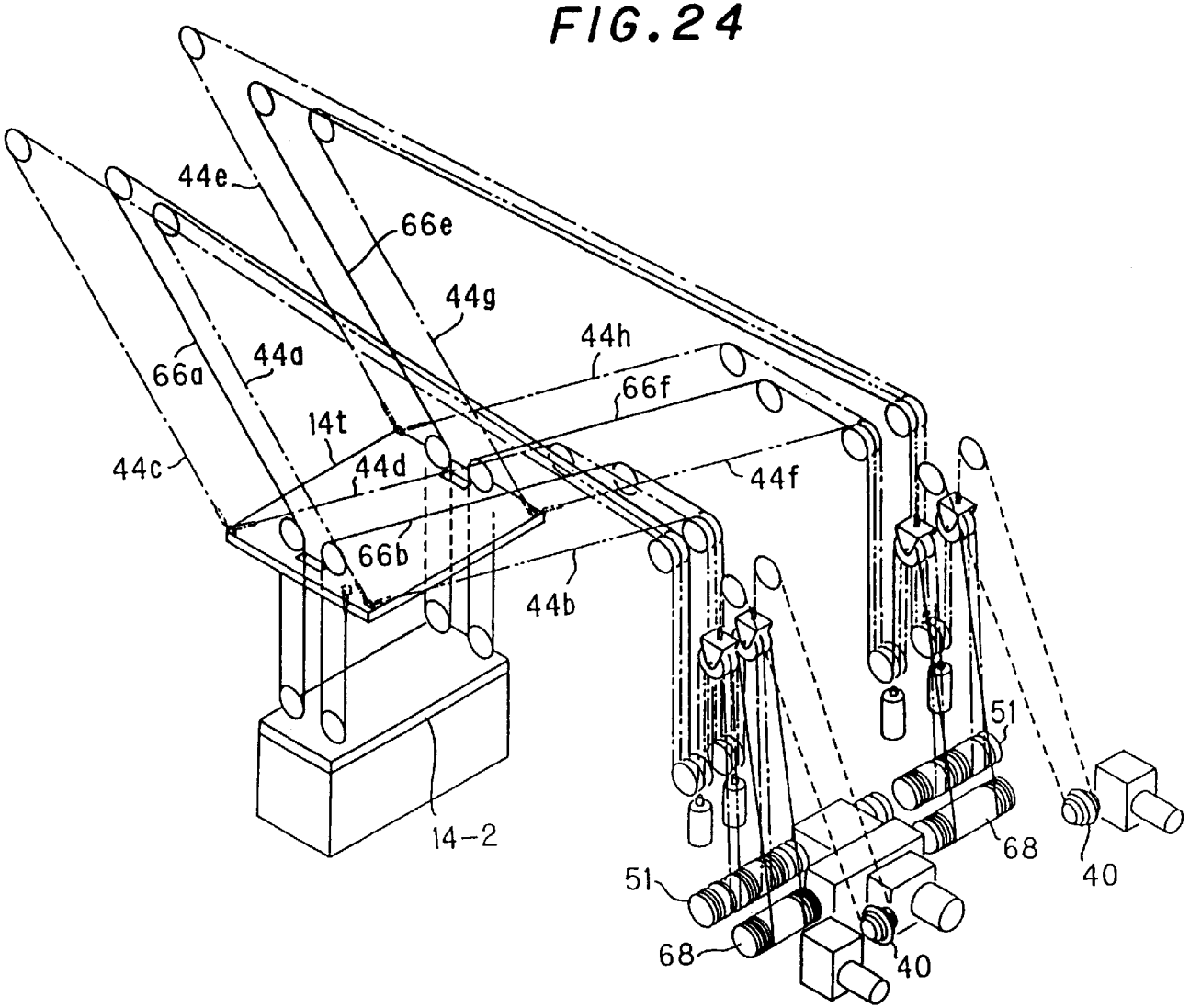
FIG. 24 is a view of the portion of FIG. 23 enlarged to the whole.

FIGS. 23 and 24 show a crane system during loading or unloading of cargo, such as containers, into or out of a ship's hold, for example. One of the basics of the present invention is to perform anti-sway by stretching wire ropes obliquely upwardly from a suspended load. According to this constitution, however, when the load is lowered toward a concave place such as the ship hold, the event that the obliquely stretched wire ropes are snagged occurs.

A structure free from this event is shown in FIGS. 23 and 24. In FIG. 23, a hoisting accessory 14 is divided into two portions, i.e., an upper hoisting accessory 14-1 and a lower hoisting accessory 14-2. In the upper hoisting accessory 14-1, connection points 14X, 14Y, 14Z, 14U are provided at the four corners, and sheaves 14XS, 14YS, 14ZS, 14US are disposed at the four corners. In the lower hoisting accessory 14-2, sheaves 14XD, 14YD, 14ZD, 14UD are mounted in correspondence with the sheaves on the upper hoisting accessory 14-1.

For the above-mentioned hoisting accessory, routing of wire ropes will be described in regard to the connection points 14Z, 14U, for example. From the connection point 14Z, a wire rope 44*f* is stretched in an obliquely upper right direction, passed over sheaves 43, 43*c*, then over a movable pulley 46, and wound round a hoisting/lowering drum 51. From the connection point 14U, a wire rope 44*e* is stretched in an obliquely upper left direction, passed over sheaves 42, 42*a*, 42*c*, then over a movable pulley 47, and wound round the hoisting/lowering drum 51. Wire ropes 49*c*, 49*d* from the movable pulleys 46, 47 are wound round a traversing drum 40 in opposite directions. This arrangement of the drums and this routing of the wire ropes are concerned with the sixth embodiment shown in FIGS. 13(*a*) and 13(*b*).

Over the sheave 14ZS on the upper hoisting accessory 14-1 and the sheave 14ZD on the lower hoisting accessory 14-2, a wire rope 66*f* is passed which has one end fixed to the back of the upper hoisting accessory 14-1. The wire rope 66*f* is stretched in an obliquely upper right direction, passed over sheaves 67*a*, 67*b*, 67*c* and the movable pulley 46, and wound round an auxiliary drum 68. Over the sheave 14US on the upper hoisting accessory 14-1 and the sheave 14UD on the lower hoisting accessory 14-2, a wire rope 66*e* is passed which has one end fixed to the back of the upper hoisting accessory 14-1. The wire rope 66*e* is stretched in an obliquely upper left direction, passed over a sheave 67*d*, turned rightward and looped over sheaves 67*e*, 67*f* and the movable pulley 47, and wound round the auxiliary drum 68. The wire ropes 66*f*, 66*e* running from the auxiliary drum 68 to the upper hoisting accessory 14-1 follow the same path as that for the wire ropes 44*f*, 44*e*. Thus, when the hoisting/lowering drum 51 and the auxiliary drum 68 are rotated in the same direction, the wire ropes 66*f*, 44*f* and the wire ropes 66*e*, 44*e* are paid out or taken up in the same amount.

In this manner, the hoisting/lowering drum 51 and the auxiliary drum 68 are rotationally driven in synchronism, whereby the upper hoisting accessory 14-1 and the lower hoisting accessory 14-2 are hoisted or lowered at the same time.

Furthermore, the hoisting/lowering drum 51 is provided with a clutch 69 for cutting off the hoisting/lowering drum 51 from a drive source. When the hoisting/lowering drum 51 and the auxiliary drum 68 rotate together, for example, the upper hoisting accessory 14-1 and the lower hoisting accessory 14-2 make the same movement. However, when the clutch 69 is cut off, the wire ropes 44*f*, 44*e* on the hoisting/lowering drum 51 stop, and only the auxiliary drum 68 is rotationally driven. Thus, only the wire ropes 66*f*, 66*e* are paid out or taken up. As a result, the lower hoisting accessory 14-2 descends or ascends relative to the upper hoisting accessory 14-1, or moves in the up-and-down direction.

Consequently, when the upper hoisting accessory 14-1 and the lower hoisting accessory 14-2 come to certain positions, only the lower hoisting accessory 14-2 can be moved up or down from this position, so that movement of cargo in a place such as a ship's hold becomes possible.

In the above description, the auxiliary drum 68 is moved in association with the hoisting/lowering drum 51, but can be associated with the traversing drum 40. That is, the movement of one of the wire ropes wound in opposite directions may be interlocked with the movement of the wire ropes 66*e*, 66*f*.

FIG. 23 offers explanations concerning the two connection points 14Z, 14U of the four connection points. Whereas FIG. 24 shows all the wire ropes for hoisting/lowering and the wire ropes for the auxiliary drum in connection with the four connection points 14X, 14Y, 14Z, 14U. That is, by rotating two hoisting/lowering drums 51 and two auxiliary drums 68 simultaneously, wire ropes 44*b*, 44*a*, 66*b* from the connection point 14X, wire ropes 44*c*, 44*d*, 66*a* from the connection point 14Y, wire ropes 44*f*, 44g, 66*f* from the connection point 14Z, and wire ropes 44*e*, 44h, 66*e* from the connection point 14U all move in the same amount, whereupon upper and lower hoisting accessories 14-1 and 14-2 and a container C are hoisted or lowered in the up-and-down direction.

When the two hoisting/lowering drums 51 are cut off with a clutch, on the other hand, the rotation of the hoisting/lowering drums 51 is stopped. Also, the rotation of the auxiliary drums 68 results in the upward or downward movement of the lower hoisting accessory 14-2 relative to the upper hoisting accessory 14-1, so that the load can be hoisted or lowered.

Figure 25:
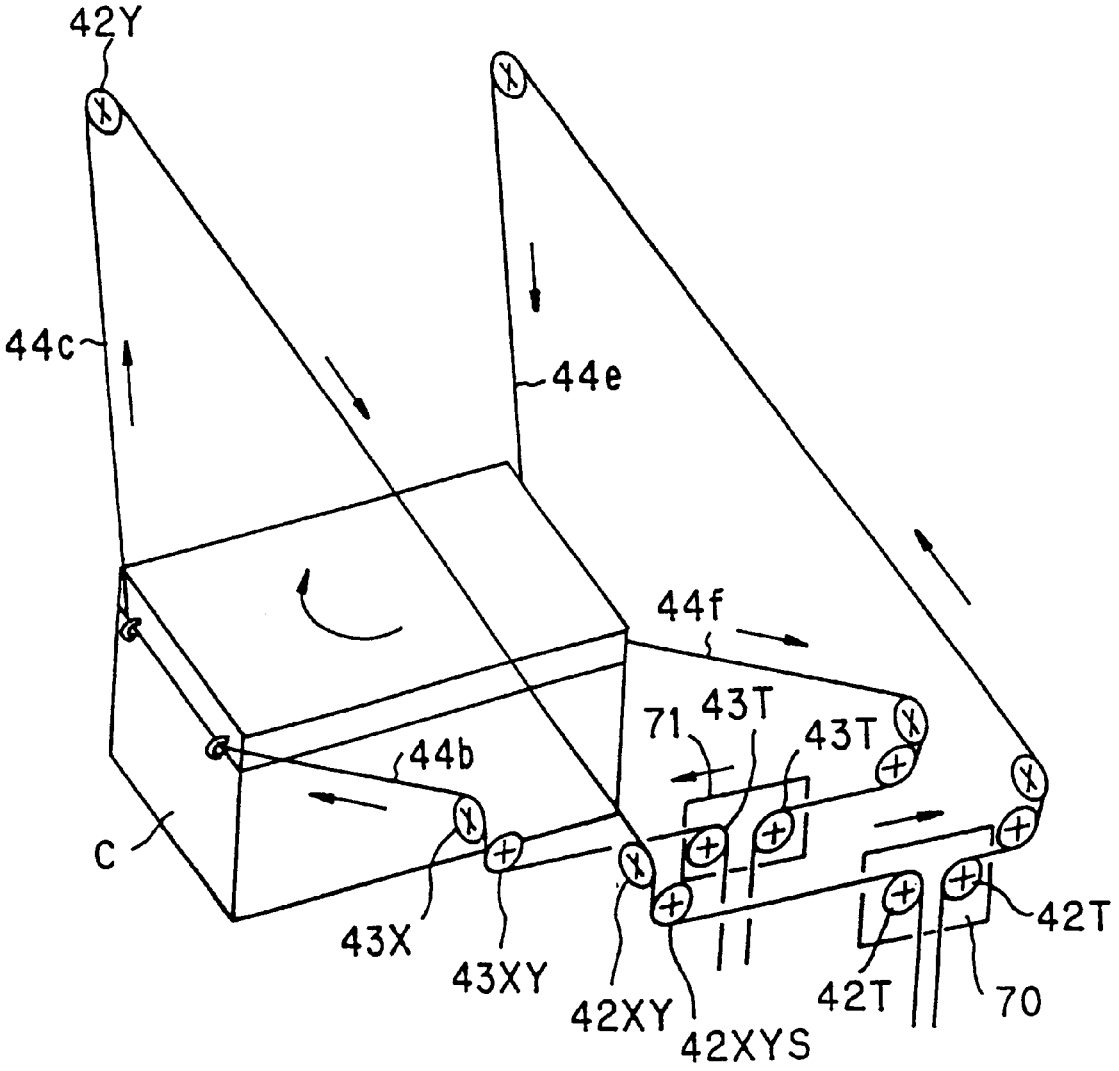
FIG. 25 is a schematic constitution drawing concerning a small turn of a hoisting accessory 14.

FIG. 25 shows FIG. 21 in a partially divisible manner, and explains a small turn of a hoisting accessory 14.

A crane system is a cargo handling machine for unloading or loading cargo from or onto a vehicle, for example. Thus, the positions of the crane system and the vehicle need to be brought into agreement during loading or unloading for reasons, such as smooth operation.

However, the direction of the vehicle at a halt is often not in agreement with the crane system, and sometimes, loading or unloading must be performed in this state.

In the present embodiment, a small turn mechanism for the hoisting accessory 14 is provided for performing loading or unloading at an exact position even in the above state. This small turn mechanism will be described in connection with wire ropes 44*b*, 44*c*, 44*e*, 44*f* connected to connection points at the four corners of the hoisting accessory 14 in FIG. 25. The wire rope 44*c* is passed over a left sheave 42Y, a right sheave 42XY, a direction change sheave 42XYS, and a direction change sheave 42T which changes the direction of the wire rope 44*c* toward the direction of the drum. The wire rope 44*b* is passed over a right sheave 43X, a direction change sheave 43XY, and a direction change sheave 43T which changes the direction of the wire rope 44*b* toward the direction of the drum.

This sheave arrangement also applies to the wire ropes 44*e*, 44*f*, and the wire ropes 44*e*, 44*f* are passed finally over the sheaves 42T, 43T to be changed in direction.

The sheave 42T for the wire rope 44*c* and the sheave 42T for the wire rope 44*e* are supported by the same support plate 70. The sheave 43T for the wire rope 44*b* and the sheave 43T for the wire rope 44*f* are also supported by the same support plate 71.

These support plates 70, 71 are adapted to be movable in the front-and-back direction of the crane (the right-and-left direction of the support plates).

According to such a constitution, when the support plates 70 and 71 are slightly moved in opposite directions, e.g., in directions indicated by arrows, the wire ropes 44*b* and the wire rope 44*e* are loosened, and the wire ropes 44*f* and 44*c* undergo forces in directions in which they are pulled. As a result, the hoisting accessory 14 undergoes a clockwise turning force. Thus, in accordance with the amount of movement of the support plates 70, 71, the amount of turning of the hoisting accessory 14 is obtained, with the result that the hoisting accessory 14, accordingly, the suspended load, changes its direction obliquely relative to the crane.

In this manner, when one wishes to cause the suspended load to make a small turn at the current position, the support plates 70 and 71 are simultaneously moved in opposite directions, with the amounts of their movements being increased according to the amount of turn. By this measure, the suspended load or hoisting accessory can be positioned, for example, in agreement with the direction of the vehicle.

For a small turn of the hoisting accessory, the connection points need to be present in the front-and-back direction. At least, it is necessary for two connection points to exist in the front-and-back direction of the hoisting accessory. Otherwise, turning is impossible.

The descriptions offered thus far have shown the embodiments covering the arrangement of the drums/sheaves, the constitution of the driving portion, the size change mechanism, and the small turn mechanism for performing necessary functions.

Figure 26:
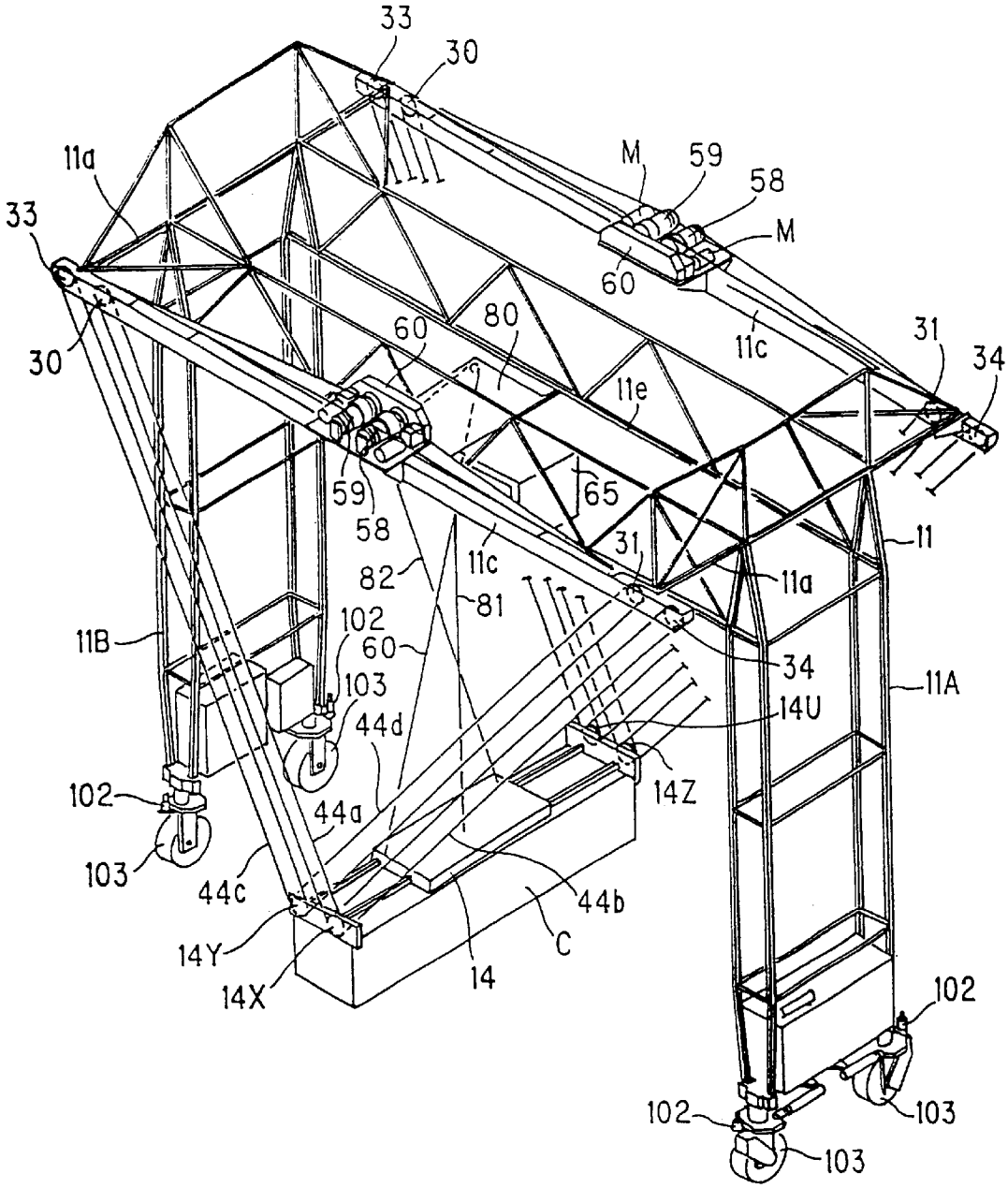
FIG. 26 is a concrete overall constitution drawing.

A concrete constitution making the utmost use of their advantages is shown in FIG. 26. A hoisting accessory 14 is lightweight, and expansible along with four sheaves 14X, 14Y, 14Z, 14U. Each of these sheaves is, actually, composed of two sheaves.

The two sheaves bear two wire ropes, one of which is passed over an obliquely upper right sheave, and the other being passed over an obliquely upper left sheave. For the sheave 14X, for example, there are a wire rope 44*b* stringed in an obliquely upper right direction, and a wire rope 44*a* stringed in an obliquely upper left direction. One end of the wire rope 44*b* is fixed to a right end portion of a transverse girder 11*c* mounted on a body frame, while the other end thereof is wound round a takeup drum 58 via the sheave 14X and a sheave 34 at the end portion of the transverse girder. The wire rope 44*a* stringed in an obliquely upper left direction is symmetrical to the wire rope 44*b* stringed in an obliquely upper right direction. One end of the wire rope 44*a* is fixed to a left end portion of the transverse girder 11*c*, while the other end thereof is wound round a takeup drum 59 via the sheave 14X and a sheave 30.

In short, one end of the wire rope 44*b* stringed in an obliquely upper right direction among the wire ropes is wound round the takeup drum 58. Whereas one end of the wire rope 44*a* stringed in an obliquely upper left direction among the wire ropes is wound round the takeup drum 59.

The distance between the sheaves 30 and 33 or between the sheaves 31 and 34 provided at both end portions of the transverse girder 11*c* is set to be the same as the distance between the sheaves 14X and 14Y or between the sheaves 14Z and 14U of the hoisting accessory 14. Thus, the wire rope passed over the sheaves 30, 33 or 31, 34, and sheaves 14X, 14Y or 14Z, 14U, or the wire rope passed over the wire rope fixing portion at the end portion of the transverse girder 11*c* and the sheaves 14X, 14Y or 14Z, 14U, forms a parallelogram, regardless of the position of the suspended load C, as in the embodiment shown in FIG. 10, for example.

The takeup drum installed in the present embodiment is an integral type drum which comprises the drums 58, 59 modified to be arranged parallel, and which includes a rotation control device 60. The integral type drum is disposed at the center, in a longitudinal direction, of each of the front and rear transverse girders 11*c*.

That is, the front and rear transverse girders 11*c*, the integral type drums 58, 59 mounted thereon, and the sheaves 30, 31, 33, 34 together perform the function of a cooperative type crane. The transverse girder 11*c* is movable in the front-and-back direction on rails (not shown) provided at end portions, in the front-and-back direction, of side beams

11*a*. The so constituted transverse girder 11*c* functions as a size change mechanism similar to that shown in FIG. 21 stated earlier.

The drums 58, 59 are each wound with two wire ropes in the same direction. The drums 58, 59 each have grooves flighted in opposite directions so that the center of the length of the drum defines a symmetric line when taking up or paying out the two wire ropes. By this means, no bending force acts on the transverse girder 11*c*. The mechanism of action behind this advantage will be described with a single drum being picked up. The surface of the drum is flighted in opposite directions so that the wire ropes are taken up or paid out at equidistant positions from a base point set at the center in the longitudinal direction of the drum. This constitution enables the transverse girder 11*c* not to undergo a bending force.

The sheaves 30, 33 and 31, 34 fixed at both end portions of the transverse girder 11*c* are arranged such that the support portions for the transverse girder 11*c* (i.e., the junctions between the side beams 11*a* and the transverse girder 11*c*) are located on center lines drawn between the sheaves 30 and 33 and between the sheaves 31 and 34. This arrangement is designed to avoid a bending force acting on the transverse girder 11*c*.

Thus, compressive forces due to the horizontal component of force of the suspended weight imposed on the wire ropes are counterbalanced. The transverse girder 11*c* is acted on only by the vertical component of force of the suspended weight, as well as the bending force due to the own weight of the integral type drum 58, 59 and rotation control device 60 mounted at the center of the transverse girder 11*c*. Hence, the crane can be constructed of a lightweight structure.

On front and rear transverse beams 11e of the body frame, rails are provided. A trolley 80 mounted like a bridge between these front and rear rails is movable transversely along the rails.

The trolley 80 is equipped with an operating room 65, a power supply cable 81 for power supply to the hoisting accessory 14, wire ropes 82, and an anti-sway device (not shown) for anti-sway in the front-and-rear direction (the extending and contracting direction of the hoisting accessory). Two of the wire ropes 82 from the anti-sway device are fixed to the hoisting accessory 14 so as to obliquely cross in the front-and-rear direction, and are kept always at constant tension by a torque motor. If sway of the hoisting accessory 14 due to an external force occurs, and the wire ropes 82 are paid out, a one-way mechanical clutch in the anti-sway device is actuated and works as a brake. As a result, a further increased holding torque is produced to suppress sway. This one-way mechanical clutch also acts as a brake when paying out the wire ropes in order to lower the hoisting accessory 14 or the suspended load during operation of the crane.

The structure of the body does not have the conventional trolley, and the hoisting accessory is also lightweight. Thus, the body is given a truss structure with light weight to decrease the weight of the crane markedly. In accordance with this, the load on the traveling wheels 103 is also reduced. Hence, the number of the wheels is four, and each wheel is provided with a traction motor 102 to construct a four-wheel-drive system.

Figure 27:
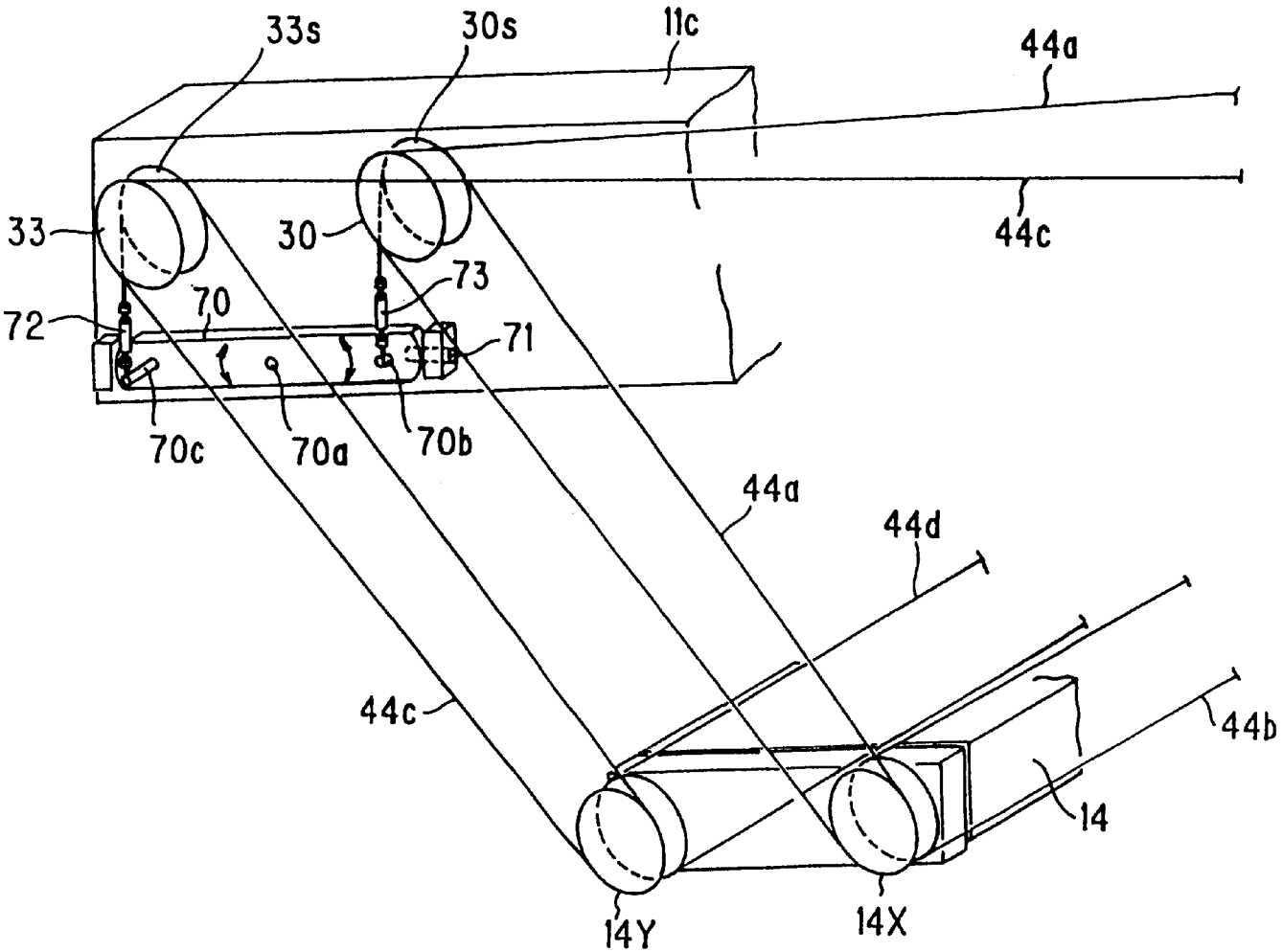
FIG. 27 is a constitution drawing concerning the adjustment of the length of a wire rope.

FIG. 27 shows a detailed constitution of one end portion of the transverse girder 11*c* shown in FIG. 26.

Each of the two sheaves 30 and 33 at the end portion includes two sheaves located coaxially, and the two coaxial sheaves with the same diameter are individually rotatable.

Of two wire ropes 44*a*, 44*c* paid out from a drum 59, the wire rope 44*a* is fixed to a turnbuckle 73 via a sheave 30, a sheave 14X of a hoisting accessory, and a sheave 30*s*. The other end of the turnbuckle 73 is fixed to a pin 70*b*.

Likewise, the other wire rope 44*c* is fixed to a turnbuckle 72 via a sheave 33, a sheave 14Y, and a sheave 33*s*. The other end of the turnbuckle 72 is fixed to a pin 70*c*.

The pins 70*b*, 70*c* are fixed to a rotating plate 70, which is supported rotatably by a pin 70*a* located at the center in its longitudinal direction. The pin 70*a* is fixed to the transverse girder 11*c*. Turning of the rotating plate 70 is stopped by a pin 71.

Pins at the other end portion of the transverse girder 11*c* are configured as described above.

The rotating plate 70, turnbuckles 72, 73, and sheaves 30*s*, 33*s* are provided to adjust the lengths of the wire ropes during maintenance or replacement of the wire ropes. Next, a method of adjustment will be described.

In the present embodiment, the eight wire ropes support the hoisting accessory 14. Of these wire ropes, total two wire ropes are simultaneously operated via the two sheaves 30 and 33, or 31 and 34, at one of the ends of the transverse girder for one of the rotatable four drums 58 and 59.

For this purpose, the lengths of the two wire ropes operated by each drum are equalized by the rotating plate 70. In this state, adjustment of the wire rope lengths for the entire crane is made by rotation of the drum.

For adjustment of the wire rope length, the hoisting accessory is landed to release the tension of the wire ropes. In this condition, the pins 71 located at the four sites are all removed to allow the rotating plates 70 rotatable. The adjacent two wire ropes on the rotating plate 70 that has become rotatable are tied together; i.e., they have the same tension.

Then, the drums are rotated and adjusted so that the hoisting accessory 14 is lifted to a parallel posture, and the degree of stretching of the wire ropes from the four drums becomes equal.

Thereafter, the rotating plate 70 is fixed at each of the end portions of the transverse girders.

In this case, when one of the turnbuckles, 72 or 73, is extended, the rotating plate 70 is turned in the same amount in a direction in which the other turnbuckle 73 or 72 is contracted, so that no change occurs in the position or posture of the hoisting accessory 14. In this manner, the rotating plate 70 is adjusted to rest on a fixed position. Then, the pin 71 is inserted to fix the rotating plate 70.

In the present embodiment, the equalization of the tension of the two wire ropes by the rotating plate 70, and the positioning of the rotating plate 70 to a fixed position by the turnbuckles 72, 73 have been described in regard to the method of fixing by the pin 71. However, other methods may be used.

The sheaves 30*s*, 33*s* may also be replaced by other means, if a parallelogram defined by the contacts of these sheaves with the wire ropes and the sheaves 14X, 14Y can be retained, as stated earlier.

The constitution of the crane system has been described thus far, and its operating action will be explained.

Travel of the crane body is the same as that of a conventional crane system, and the hoisting/lowering and traversing of a suspended load are as shown regarding the integral type drum of FIG. 17. Thus, these actions are omitted.

First, a description will be presented of the movement of the trolley 80 in tune with a traversing motion of the hoisting accessory 14.

When handling a container C, the trolley 80 and the hoisting accessory 14 are to move in synchronism. Even if the trolley 80 and the hoisting accessory 14 misalign in the right-and-left direction, it is sufficient for the power supply cable 81 and the anti-sway wire rope 82 not to contact containers stacked on the floor. Thus, spatial margin can be secured. When the power supply cable 81 and the anti-sway wire rope 82 are stretched between the trolley 80 and the hoisting accessory 14 at the center in their right-and-left direction, moreover, that margin can be increased, with no trouble caused by displacement of the trolley 80 or the hoisting accessory 14 more than a half of their width in the right-and-left direction. Thus, the positioning of the trolley 80 relative to the hoisting accessory 14 can be performed by simple feed forward control.

The trolley 80 also has a self-operating function by which the operator moves to a position for higher visibility when aligning the chassis and the container.

In the absence of the above-mentioned contact problem in uses other than involving a container, the operating room 65 and the trolley 80 need not be moved, but may be fixed at the center.

At the time of size change, the two transverse girders 11*c* are moved in accordance with the extension or contraction of the hoisting accessory 14.

In the case of size change shown in FIGS. 21 and 22, when the side beams 11*a*, 11*b* are extended, for example, the oblique wire ropes that support the hoisting accessory 14 are taken up by the amounts of their extensions. As a result, the hoisting accessory 14 is lifted.

In the present embodiment, wire is routed in a plane including one of the transverse girders 11*c*, and the sheaves 14X, 14Y of the hoisting accessory. Thus, upward or downward movement of the hoisting accessory 14 during size change does not occur. Hence, it becomes possible to make unnecessary an expanding/contracting drive source for adjusting the upward or downward position of the hoisting accessory 14. It also becomes possible to lift the hoisting accessory 14 nearly to a height where it contacts the transverse girder 11*c*, and to extend or contract the hoisting accessory 14 in the front-and-back direction in association with the forward or rearward driving of the transverse girder 11*c*.

By causing the front and rear transverse girders 11*c* to traverse rightward and leftward in opposite directions, e.g., the front transverse girder 11*c* to traverse rightward and the rear transverse girder 11*c* to traverse leftward, a turning motion can be made. That is, turning can be carried out by operating the wire ropes in opposite directions for the respective drums 58, 59 of the integral type drums on the front and rear transverse girders 11*c*, for example, by tightening the wire rope with the left drum 59 while loosening the wire rope with the right drum 58 of the front integral type drum, and simultaneously loosening the wire rope with the left drum 59 while tightening the wire rope with the right drum 58 of the rear integral type drum.

A guide system is constituted to enable the transverse girder 11*c* to be moved such that the amount of its movement can become slightly different between the rightward movement and the leftward movement of the transverse girder 11*c*. An error in the travel or stoppage of the crane can be fully corrected by controlling the amounts of rightward and leftward movements of the transverse girder 11*c*.

Thus, the present crane is a very capable crane which can easily correct all of errors in the positions of travel and stoppage of the crane or chassis, and errors in storage and stacking of containers.

The operating actions have been described above. The present crane is free from sway, and can perform various actions for alignment easily and quickly. Hence, it is suitable as a semiautomatic or full automatic crane.

In the case of the semiautomatic crane, either the operator rides on the operating room, or some cameras are provided instead of the operator to do monitoring at other place, such as a centralized control center. Tasks to be performed are to issue directions on the contents of work, and to carry out final alignment after movement. Thus, burden on the operator can be markedly reduced, and a person other than a skilled technician can fully operate the crane.

In the case of the full automatic crane, semiautomatic sensor functions provided in place of the operator can fulfill the required tasks. The necessary functions are automatic steering along a white line for crane travel or by magnetic guide, recognition of the state of containers in storage by laser scanning or the like, and recognition of the original position or normal position of the hoisting accessory.

Next, control of drum rotation will be described. In performing control, the crane system is placed on rectangular coordinates, and a manual command is converted into an actual speed command on the basis of the coordinates of the current position of the hoisting accessory. This speed command is integrated to set the current target position. Zero output of the manual command means that the target position has been reached. Thus, calculation is made per notch of the manual command to perform command-based speed control, such as control for acceleration, constant speed, or deceleration.

Figure 28:
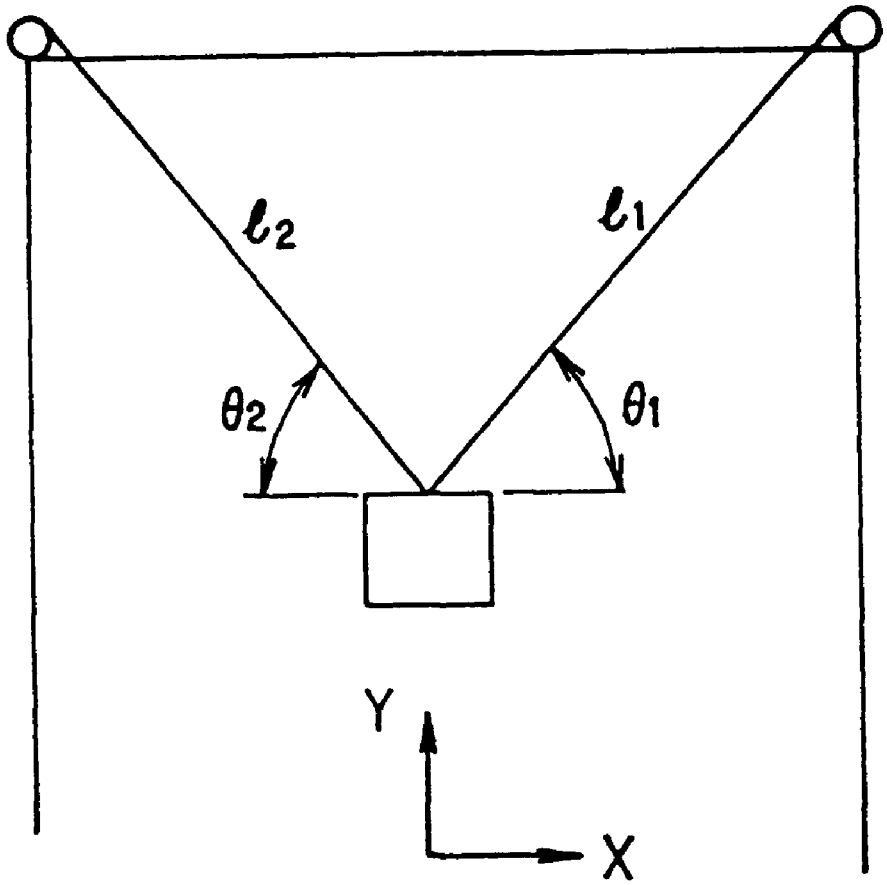
FIG. 28 is an explanation drawing for rotation control of a drum.

Incidentally, in rectangular coordinates shown in FIG. 28, calculation of the speed for hoisting/lowering or traversing when the lengths of wire ropes=$l_1$ and $l_2$ is performed according to the following equation:

$$l_1=-\dot{x}\cos\theta_1-\dot{y}\sin\theta_1$$

$$l_2=\dot{X}\cos\theta_2-\dot{y}\sin\theta_2$$

where $l_1$, and $l_2$ take positive values when the wire ropes are paid out.

Because of the weight of the hoisting accessory or suspended load, or the own weight of the wire rope, an event such as extension or sag occurs in the wire rope. Thus, such an event needs to be corrected using the above equation, and the values of the $l_1$ and $l_2$ in the equation are substantially changed.

The foregoing descriptions have been offered on condition that the hoisting accessory is present. However, they can, of course, be applied when the connection points are present on a suspended load itself.

Figure 29:
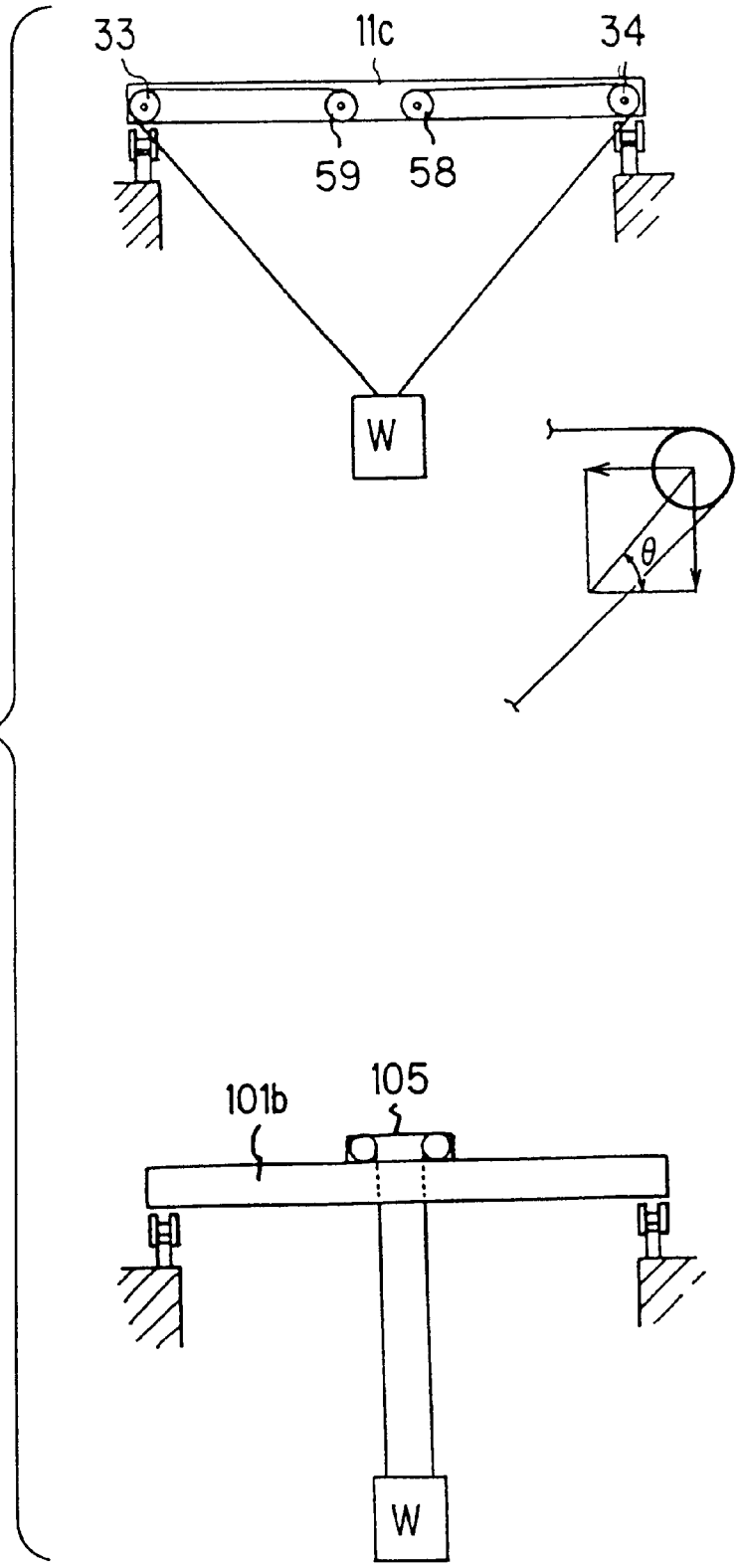
FIG. 29 is an explanation drawing of overhead traveling cranes according to an earlier technology and the present invention.

Also, the descriptions given thus far are relevant to gantry cranes. However, these descriptions are applicable, needless to say, to overhead traveling cranes, and other cranes performing traversal and hoisting/lowering. FIG. 29 shows an example of an overhead traveling crane applied to the present invention and an earlier technology. According to the example of the invention, a rail is laid along a building as a body frame (along the front-to-back direction of the sheet face of FIG. 29), a transverse girder 11*c* moves on this rail, and sheaves 33, 34 and drums 58, 59 hoist or lower a suspended load, or cause the suspended load to traverse. In this case, the weight of the suspended load is imposed on the sheaves 33, 34 at right and left ends of the transverse girder. The vertical component of force of the weight acts on the rail, while its horizontal component of force acts on the transverse girder as a compressive force. In the example of the earlier technology, therefore, a trolley 105 imposes a bending force on a transverse girder 101*b*. In the example of the invention, by contrast, only a compressive force acts on the transverse girder, and no bending works thereon, so that the crane of the invention can be made lightweight.

Industrial Applicability

As described above, the present invention has obtained a gantry crane or an overhead traveling crane, as a rope crane, which lifts a suspended load obliquely by the use of wire ropes stretched from right and left ends of a transverse girder, and which actually permits hoisting/lowering or traversing operation while performing anti-sway, with the wire ropes being coordinated with each other.

What is claimed is:

1. A crane system, comprising:

a body frame having an upper rectangular surface and legs extending downward at corners thereof;

a hoisting accessory having four connection points thereon, two connection points provided at both ends of the hosting accessory;

a plurality of sheaves attached near corners of the upper surface of the body frame, one sheave provided near each corner;

a first drum for taking up and paying out wire rope attached at a first corner of the upper surface of the body frame, between at least one sheave and said first corner;

a second drum for taking up and paying out wire rope attached parallel to said first drum at a second corner of the upper surface of the body frame, between at least one sheave and said second corner;

a first pair of wire ropes each attached at one end to a corresponding connection point on said hoisting accessory, one wire rope of said first pair being connected at its other end directly to said first drum, the other wire rope connected at its other end to said first drum via one of said sheaves; and a second pair of wire ropes each attached at one end to a corresponding connection point on said hoisting accessory, one wire rope of said second pair being connected at its other end directly to said second drum, the other wire rope connected at its other end to said second drum via another of said sheaves.

2. The crane system of claim 1, wherein an outer diameter of said plurality of sheaves is equal to an outer diameter of said first and second drums.

3. The crane system of claim 1, wherein said first drum pays out and/or takes up said first pair of wire ropes simultaneously, and wherein said second drum pays out and/or takes up said second pair of wire ropes simultaneously.

4. The crane system of claim 1, wherein one of said first pair of drums at said one end on the upper surface of the body frame acts in coordination with one of said second pair of drums at said other end on the upper surface of the body frame to move said hoisting accessory.

5. The crane system of claim 1, wherein the connection points are arranged either at each of the four corners of the hoisting accessory, or in pairs of two points parallel to each another and centered at both ends of the hoisting accessory;

wherein, if the connection points are arranged at the four corners of the hosting accessory, a distance between two connection points at two corners of; one end of the hoisting accessory, each connected to a corresponding corne of said first pair of wire ropes, is equal to a distance between where said one wire rope of said first pair contacts said first drum directly, and where said other wire rope of said first pair contacts said one sheave before said first drum; and wherein, if the connection points are arranged in parallel pairs and centered at ends of the hoisting accessory the distance between a connection point on the hoisting accessory that corresponds to said one wire rope that directly contacts the drum, and the contact point at the drum, is longer than the distance between the connection point corresponding to said other wire rope that contacts said one sheave first before the drum, and its contact point at said one sheave.

6. The crane system of claim 5, wherein, if the connection points are arranged at the four corners of the hosting accessory, distances between connection points for each of said second pair of wire ropes, and between contact points of said second drum and sheave for said second pair of wire ropes are-also equal; and wherein, if the connection points are arranged in parallel pairs and centered at ends of the hoisting accessory the distance between a connection point on the hoisting accessory that corresponds to said one wire rope of said second pair that directly contacts the drum, and the contact point at the drum, is longer than the distance between the connection point corresponding to said, other wire rope of said second pair that contacts said one sheave first before the drum, and its contact point at said one sheave.

7. The crane system of claim 1, wherein an amount of takeup and/or payout of said first and second pair of wire ropes is adjusted in a coordinated manner between said first and second drums.

8. The crane system of claim 1, wherein the four connections points are configured in sets of two, a first pair provided at one end of said hoisting accessory at either each corner of said one end, or centered on the hoisting accessory at said one end, and a second pair at the other end of said hoisting accessory at either each corner of said other end, or centered on the hoisting accessory at said other end, and wherein, if the two pairs are arranged at corners of the ends of the hoisting accessory, the connection points composing the first pair are offset from one another when viewing the hoisting accessory in a plan view, and likewise for said second,pair.

9. The crane system of claim 1, wherein said hoisting accessory has a width and depth direction as viewed from above, and carries a container, and wherein said hoisting accessory protrudes relative to the container in the depth direction, so that said first and second pairs of wire ropes are prevented from contacting other containers that are stacked in the vicinity of the crane system.

10. The crane system of claim 1, wherein the rectangular body frame further comprises front and rear frames with a pair of transverse girders therebetween, the frames and girders being attached to said legs, and wherein said front and rear frames are configured so as to be movable in a forward and rearward direction.

11. The crane system of claim 10, wherein said legs are provided with rotationally driven wheels to enable forward and rearward movement of said front and rear frames.

* * * * *